US012690727B2

(12) United States Patent
Wozny et al.

(10) Patent No.: US 12,690,727 B2
(45) Date of Patent: Jul. 28, 2026

(54) DISPENSER SYSTEMS

(71) Applicant: Kimberly-Clark Worldwide, Inc., Neenah, WI (US)

(72) Inventors: Loic Wozny, Rouen (FR); Willem Johan van den Brink, Hoevelaken (NL); Jonathan Green, Rossett (GB)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 425 days.

(21) Appl. No.: 18/041,230

(22) PCT Filed: Aug. 10, 2021

(86) PCT No.: PCT/GB2021/052069
§ 371 (c)(1),
(2) Date: Feb. 10, 2023

(87) PCT Pub. No.: WO2022/034312
PCT Pub. Date: Feb. 17, 2022

(65) Prior Publication Data

US 2023/0263344 A1 Aug. 24, 2023

(30) Foreign Application Priority Data

Aug. 10, 2020 (FR) ..... 2008403
Nov. 11, 2020 (GB) ..... 2017800

(51) Int. Cl.
*A47K 10/38* (2006.01)
*B65H 75/18* (2006.01)

(52) U.S. Cl.
CPC ..... *A47K 10/3818* (2013.01); *B65H 75/185* (2013.01); *B65H 2701/1924* (2013.01)

(58) Field of Classification Search
CPC ..... A47K 10/3818; B65H 75/185
See application file for complete search history.

(56) References Cited

U.S. PATENT DOCUMENTS 3,547,367 A 12/1970 Brazeale et al.
3,914,900 A 10/1975 Bigelow et al.
(Continued)

FOREIGN PATENT DOCUMENTS

CN 206244193 U 6/2017
DE 4413810 A1 10/1994
(Continued)

OTHER PUBLICATIONS

International Search Report and Written Opinion for PCT/GB2021/052069 dated Nov. 9, 2021.
(Continued)

*Primary Examiner* — Gene O Crawford
*Assistant Examiner* — Ayodeji T Ojofeitimi
(74) *Attorney, Agent, or Firm* — Dority & Manning, P.A.

(57) ABSTRACT

A moulded fibrous end plug (3) and dispenser system comprising the same, the end plug for use in mounting a roll of sheet material to a dispenser and having a roll facing side comprising formations configured to be insertable into an opening in an end of a roll of sheet material and for securing the end plug to the roll of sheet material, the end plug further comprising an opposite dispenser facing side comprising formations configured to cooperate with formations of a roll holder portion of a dispenser in use for mounting the end plug to the dispenser. The formations of the roll facing side configured to be insertable into the opening in the end of the roll of sheet material include a plurality of domes (7). The formations of the roll facing side for securing the end plug to the roll of sheet material include protuberances (26) configured to provide an interference fit securing the end plug to the roll.

18 Claims, 25 Drawing Sheets

(56) References Cited

U.S. PATENT DOCUMENTS

| | | | | |
|---|---|---|---|---|
| 4,874,139 | A | 10/1989 | Kewin | |
| 4,875,636 | A | 10/1989 | Kewin | |
| 4,977,930 | A | 12/1990 | Munk | |
| 5,337,895 | A | 8/1994 | Mitelman et al. | |
| 5,351,825 | A | 10/1994 | Duffy | |
| 5,393,010 | A | 2/1995 | Renck | |
| 5,791,588 | A | 8/1998 | Lindstrand | |
| 5,812,915 | A | 9/1998 | Farkash | |
| 6,276,528 | B1 | 8/2001 | Nowotny et al. | |
| 6,375,116 | B1 | 4/2002 | Askins et al. | |
| 6,521,151 | B2 | 2/2003 | Boney, Jr. | |
| 6,612,473 | B1 | 9/2003 | Newby et al. | |
| 6,805,240 | B2 | 10/2004 | Smarr et al. | |
| 6,820,835 | B2 | 11/2004 | Cavaliere et al. | |
| 7,879,274 | B2 | 2/2011 | Larsson | |
| 8,167,228 | B2 * | 5/2012 | Kobayashi | B41J 15/04 242/420.5 |
| 8,511,600 | B2 | 8/2013 | Formon et al. | |
| 8,556,932 | B2 | 10/2013 | Ziobro | |
| 2006/0261076 | A1 * | 11/2006 | Anderson | A47K 10/3818 221/33 |
| 2012/0138723 | A1 | 6/2012 | Lewis et al. | |
| 2014/0259960 | A1 * | 9/2014 | Rotter | B24D 11/005 51/307 |
| 2015/0320267 | A1 | 11/2015 | Pour | |
| 2018/0194582 | A1 | 7/2018 | Rozek et al. | |
| 2018/0332972 | A1 * | 11/2018 | Jaeckel | A47C 7/622 |
| 2021/0163198 | A1 * | 6/2021 | Kuiper | B65D 65/466 |

FOREIGN PATENT DOCUMENTS

| | | | |
|---|---|---|---|
| EP | 1284231 | | 2/2003 |
| EP | 1938727 | A2 | 7/2008 |
| GB | 888860 | | 2/1962 |
| JP | 2948226 | B2 | 9/1999 |
| JP | 2010105701 | A | 5/2010 |
| JP | 2015083824 | A | 4/2015 |
| WO | WO2007069998 | A1 | 6/2007 |

OTHER PUBLICATIONS

Korean Office Action Corresponding to Application No. 10-2023-7007384 on Sep. 5, 2025.

Gamm, Round plug TSF, Retrieved from https://www.directindustry.com/prod/gamm/product-18032-467847.html, 2019, 4 pages.

Indiamart, Shakti Polypropylene Core Plug, Retrieved from https://www.indiamart.com/proddetail/polypropylene-core-plug-14499422397.html, 2019, 7 pages.

* cited by examiner

DISPENSER SYSTEMS

This application claims priority from French Patent Application No. 2008403, which was filed in the French Patent and Trademark Office on Aug. 10, 2020, UK Patent Application No. 2017800.0, which was filed in the UK Intellectual Property Office on Nov. 11, 2020, and PCT/GB2021/052069, which was filed in the UK Intellectual Property Office on Aug. 10, 2021, all of which are incorporated by reference herein in their entireties.

The present invention relates to an end plug for use in mounting a roll of sheet material to a dispenser, and to methods of manufacturing and using such an end plug. The invention also extends to a dispenser system including such an end plug and to a system comprising a roll of sheet material having such an end plug inserted in an opening in an end of the roll.

End plugs may be used to mount a roll of sheet material to a dispenser. An end plug may be associated with one or both ends of the roll, and is used to connect the respective end of the roll to the dispenser. Typically one side of the end plug (the roll facing side) is configured to be inserted into an opening in a respective end of the roll of sheet material, while the other side of the end plug (the dispenser facing side) is configured to be mounted to a roll holder portion of the dispenser. End plugs may be used with a range of dispenser types, and are may be used with wall mounted dispensers (whether manually operated or of an electronic "hands-free" type).

End plugs may facilitate obtaining secure mounting between the roll and the dispenser. The dispenser facing side of an end plug may be configured such that the end plug only fits a particular type of dispenser. For example, the dispenser facing side of the end plug and a roll holder portion of the dispenser may comprise complementary formations, e.g. intended to mate with one another. In this way, an end plug may be used to ensure that only a type of roll of sheet material with which the dispenser is intended to be used may be inserted into the dispenser, helping to provide improved operation of the dispenser system. For example, a dispenser may be designed to operate most effectively with certain types of roll, e.g. including material of a particular basis weight, and/or of a given size. If a different roll type is used with the dispenser, it may not operate effectively e.g. the material may tend to jam, or may give a perception of lower quality. In the case of an electronic dispenser, use of an inappropriate roll size may cause the motor to be overloaded or to operate at a sub-optimal power consumption.

A roll of sheet material may be supplied with an end plug inserted in one or both ends thereof. This may provide a refill for a dispenser.

A dispenser system for rolled sheet material products including end plugs is described in US 2012/0138723A1 (Lewis at al), published on 7 Jun. 2012 (and which corresponds to WO 2012/073203A2, referenced below).

The Applicant has realised, however, that there is scope to provide an improved end plug for use in mounting a roll of sheet material to a dispenser.

In accordance with a first aspect of the present invention there is provided;

a moulded fibrous end plug for use in mounting a roll of sheet material to a dispenser, wherein the end plug has a roll facing side comprising formations configured to be insertable into an opening in an end of a roll of sheet material, the formations of the roll facing side including formations for securing the end plug to the roll of sheet material in use; and an opposite dispenser facing side comprising formations configured to cooperate with formations of a roll holder portion of a dispenser in use for mounting the end plug to the dispenser.

The present invention therefore provides an end plug formed by moulding a fibrous material. In contrast to previous end plugs, such as those described in the above-mentioned US 2012/0138723A1 (Lewis at al), which are made from a plastics material, the end plug of the present invention is provided by a moulded fibrous structure. This provides a more sustainable end plug which is advantageously biodegradable.

The end plug of the present invention may also provide advantages in terms of ease of recycling. An end plug is typically removed from the dispenser along with a roll core (where provided) for disposal once a roll of sheet material has depleted. The end plug may remain inserted in the end of the core. The roll core is typically made of cardboard, paperboard or similar fiber based material. If the end plug is made of a plastics material, it may need to be removed from the core to ensure that the core may be recycled without risk of contaminating the core recycling waste stream. The plastic end plug may or may not itself be recyclable depending upon plastic recycling availability in a given area. Even if recycling is possible, in many cases a plastic end plug would need to be separated from the core to ensure that both the core and plug may be effectively recycled without contaminating a particular recycling waste stream. For example, recycling processes often require the separation of plastic and paper materials into separate streams, whether on disposal by a user or subsequently during the recycling process. Providing an end plug that cannot easily be recycled along with a roll core may therefore result in a user either failing to recycle either part, and instead putting the core along with the end plug into a non-recyclable waste stream, or placing both parts as a unit into a recycling waste stream that is inappropriate for one or other of the materials.

In contrast, the end plug of the present invention may be disposed of together with a roll core (where provided) into a single recycling waste stream, without risk of contamination. The end plug and core may be recycled as a unit using widely available recycling services for non-plastic materials. This provides greater convenience for the user, and reduced environmental impact, increasing the likelihood of successful recycling. Even where the end plug is used without a core, the ability to readily recycle the end plug e.g. with paper waste, provides improved sustainability in contrast to plastic end plugs.

In some embodiments at least, the end plug is biodegradable, and may be compostable, providing further advantages. This may facilitate disposal whether by the consumer, or following a commercial recycling process.

The end plug of the present invention is a moulded end plug for use in mounting a roll of sheet material to a dispenser. The end plug connects an end of the roll to a roll holder portion of the dispenser in use. The end plug may extend between the end of the roll and the roll holder portion of the dispenser to connect the roll and the roll holder portion of the dispenser. A portion of the end plug may be sandwiched between the end of the roll and a portion of the roll holder portion of the dispenser.

The end plug has opposed roll facing and dispenser facing sides comprising formations configured respectively to be insertable into an opening in an end of a roll of sheet material and including formations for securing the end plug to a roll of sheet material, and for mounting the end plug to a holder portion of a dispenser in use.

The end plug defines an axial direction and a radial direction. The end plug has a central axis. The central axis of the end plug may be aligned with a central axis of a roll (and where applicable, of a core of the roll) when mounted thereto in use. A circumferential direction is defined as a circumferential direction with respect to the axis of the end plug.

A reference to upper, higher, top or increasing height etc, herein in respect of the roll facing side of the end plug refers to the direction/positions further from the dispenser facing side of the end plug, while, conversely, references to lower, bottom, decreasing height etc. refer to the direction/positions closer to the dispenser facing side of the end plug. The base of the roll facing side corresponds to the region closest to the dispenser facing side. The base may be defined by a planar portion or portions of the roll facing side. Points within the base region may all be of the same height. The base may be a continuous region or may include more than one discrete region. The base may define a rear face of the roll facing side i.e. a face furthest from the roll as the end plug is inserted into the roll.

The end plug is a moulded fibrous end plug. The formations associated with the roll facing and dispenser facing sides thereof are moulded formations. The end plug is an integrally moulded end plug. The moulded formations are integrally moulded formations.

At least some of the formations of the dispenser facing side may produce reverse formations on the roll facing side of the end plug, and vice versa. At least some of the formations of the dispenser facing side that cooperate with formations of the dispenser may be provided by the reverse side of formations of the roll facing side.

The roll facing side of the end plug comprises formations configured to be insertable into an opening in an end of a roll of sheet material. These formations insertable into the opening in the end of the roll of sheet material may be referred to as "formations of the roll facing side". These formations include formations for securing the end plug to the roll of sheet material. The formations of the roll facing side for securing the end plug to the roll of sheet material may comprise formations configured to provide an interference fit securing the end plug to the roll. The interference fit is between the formations and the outer periphery of the opening in the end of the roll. This may be defined by a core of the roll in embodiments using a cored roll, or, for a coreless roll, may be defined by a portion of the sheet material of the roll in which the opening is defined. The formations for providing the interference fit may comprise protuberances. The protuberances are radially projecting protuberances. Each protuberance is able to resiliently deflect to provide interference fit. The protuberance will deflect radially inwardly upon insertion of the end plug into the opening before recovering to grip the periphery of the opening and secure the end plug within the opening. The interference fit may be such that the end plug cannot easily be removed from the roll. This may mean that the end plug is typically disposed along with any residual part of a depleted roll e.g. a core, where used. The present invention facilitates recycling of an end plug along with such a residual roll part. A plurality of protuberances are provided. The protuberances are discrete protuberances. Any suitable number of protuberances may be provided, for example from 2-6 (two to six), from 2-4 (from two to four), and optionally 4 protuberances are used. The protuberances may be evenly spaced in a circumferential direction of the end plug. However, other arrangements may be possible.

The moulded formations of the roll facing side are three-dimensional moulded formations. The formations may have contoured surfaces.

Preferably the formations of the roll facing side insertable into the opening of the roll include a plurality of domes. The domes define protrusions on the roll facing side of the end plug. In embodiments in which the formations of the roll facing side insertable into the opening of the roll include a plurality of domes, the surface of the roll facing side may define a pattern of alternating peaks and troughs. The surface may define a pattern of alternating peaks and troughs across a radial direction, a circumferential direction or preferably across both radial and circumferential directions. The domes may impart the surface with the pattern of alternating peaks and troughs. The peaks may be provided by the domes and the troughs by regions between the domes.

In any of the embodiments in which the roll facing side includes a plurality of domes, the domes are moulded domes. The end plug may comprise recesses corresponding to the domes on the dispenser facing side. Thus, the walls of the domes may have a first surface on the roll facing side of the end plug and an opposite second surface on the dispenser facing side of the end plug.

The provision of domes on the roll facing side of the end plug has been found to be advantageous in providing an end plug of moulded fibrous material which may have similar strength properties to a plastic end plug. The domes may assist in strengthening the overall structure of the end plug. The domes provide the end plug with increased robustness and the ability to withstand forces which may arise in use when the end plug is used to mount a roll to a dispenser. For example, such forces may include forces arising where the end plug rotatably mounts a roll to a dispenser roll holder portion. Regardless of whether or not the end plug rotatably mounts a roll to a dispenser roll holder portion, the domes may assist in stabilising formations associated with the dispenser facing side e.g. an annular formation which cooperate with formations of the dispenser to mount the end plug thereto. The domes may also assist in maintaining integrity of the end plug when pushed into an opening in an end of a roll in use. Such a step may be achieved using an automated technique during production of a roll refill product for a dispenser. The end plug must be able to withstand considerable forces without deformation when being handled and then pushed into the end of a roll by machine.

The domes may be of any suitable shape and size. In embodiments, the domes are identical in construction. However, other arrangements may be contemplated.

The number of domes provided on the roll facing side may be selected as desired. There may be from 2 to 6 (2-6), and optionally from 2 to 4 (2-4) domes. In preferred embodiments 4 domes are provided. The domes may be evenly spaced in a circumferential direction of the end plug. However, this need not be the case.

The domes may extend by any desired angle around the axis of the end plug.

The domes extend circumferentially and radially with respect to an axis of the end plug. The domes also have a height extending in an axial direction.

At least some of the surfaces of the domes may be contoured surfaces.

In some embodiments each dome defines a planar surface at the top end thereof. The side edges of the top surface of the dome may diverge with distance from an axis of the end plug. However, in other embodiments, it is envisaged that the top end may be curved.

Each dome is upstanding from a base of the roll facing side of the end plug. Preferably the end plug comprises a flange around the periphery thereof. The flange may be a continuous flange. The base may comprise (or be defined by) a roll facing surface of a peripheral flange of the end plug. The flange may vary in width around the circumference of the end plug. The roll facing surface of the peripheral flange may be a planar surface.

In embodiments, the domes surround a central portion of the roll facing side of the end plug. The central portion is recessed relative to the tops of the domes. The central portion extends around and includes an axial centre of the end plug. The material of the end plug may extend throughout the central portion i.e. such that the central portion is free from openings extending from through the end plug from the roll facing side to the dispenser facing side. The central portion may define a planar roll facing surface. The central portion may be substantially circular. The radially innermost portions of the domes may be separated by the central portion. The central portion is defined by a roll facing surface of a portion e.g. wall of the end plug.

The central portion may be located at a level between the base of the roll facing side of the end plug and the tops of the domes. In embodiments the base of the roll facing side of the end plug is defined by a roll facing surface of a peripheral flange of the end plug. The base of the roll facing side of the end plug may lie in a first plane, and the central portion may lie in a second plane, and the tops of the domes may lie in a third plane, wherein the second plane is located between the first and third planes.

Each dome may be located between the central portion of the roll facing side and a periphery of the roll facing side. For example, each dome extends between the central portion of the roll facing side and a periphery of the roll facing side. The dome may extend between the central portion of the roll facing side and a roll facing surface of a peripheral flange of the end plug. An outer edge of each dome may be spaced inwardly from a peripheral edge of the roll facing side of the end plug. The distance may correspond to a width of the flange at that point.

Each dome may comprise an inner wall (on the roll facing side of the end plug) connecting the dome to the central portion and an outer wall (on the roll facing side of the end plug) connecting the dome to the base of the roll facing side of the end plug. The inner and outer walls are radially inner and outer walls respectively. The outer wall may have a greater height than the inner wall. The domes may include sidewalls connecting the inner and outer walls thereof. The sidewalls may diverge from one another with distance from the central axis of the end plug. Each wall (whether an inner, outer or side wall) may comprise more than one portion, which portions may be inclined with respect to one another. The wall may include planar and/or curved portions. The wall may impart the dome with a contoured shape.

The spacing of the domes from one another in a circumferential direction may be selected as desired. For example, it is envisaged that the domes may be contiguous with one another. However, in embodiments, the domes are spaced from one another in a circumferential direction on the roll facing side of the end plug. The domes may be spaced from one another in the circumferential direction by connecting portions of the roll facing side of the end plug. The connecting portions may extend to a height less than the height of the domes relative to the base of the roll facing side. Each connecting portion may extend between (e.g. connect) a central portion of the roll facing side of the end plug and the base thereof e.g. relative to a roll facing surface of a peripheral flange of the end plug. The connecting portion may extend between sidewalls of adjacent domes.

Each connecting portion may comprise one or more sloping portion. Thus, at least a portion of each connecting portion may be inclined relative to a base of the roll facing side of the end plug e.g. relative to a roll facing surface of a peripheral flange of the end plug. The sloping portion may be a planar portion, or may be curved (in either or both of the axial and circumferential directions). The sloping portion slopes radially inwardly with increasing height from the base and distance from the periphery of the end plug. The sloping portion of the connecting portion is inclined inwardly toward the axial centre of the end plug with increasing height away from the base of the roll facing side of the end plug. The sloping portion may include converging side edges.

The connecting portion may define one or more sloping roll facing surface on the roll facing side thereof. Each such surface may be oriented as described above in relation to the sloping portion.

The surface of the connecting portion (or a sloping roll facing surface thereof) may be continuous or discontinuous over an area of the connecting portion.

At least some, and in some embodiments, each connecting portion present may comprise an opening. The opening extends from the roll facing side to the dispenser facing side of the end plug. The opening may provide a window through the connecting portion. A sloping portion of the connecting portion may include such an opening. The sloping portion may then be considered to include the opening, having a slope defined by a plane in which the opening lies. In other embodiments, at least some, and optionally each connecting portion is free from openings extending from the roll facing side to the dispenser facing side of the end plug. The presence of opening(s) through the material of the end plug in one or more of the connecting portions may be used to control the strength of the end plug. The opening(s) may also be used in some embodiments to provide a keyed mounting of the end plug to a roll holder portion of a dispenser, cooperating with formations of the roll holder portion to inhibit rotation of the end plug relative to the roll holder portion as described below.

In some embodiments, whether or not the connecting portion comprises an opening, a sloping portion of the connecting portion extends over the full height of the connecting portion. In other embodiments, the connecting portion may comprise a base portion which is upstanding from the base of the roll facing side of the end plug, and an upper, sloping portion. The base portion may extend substantially perpendicular to the base of the roll facing side. Any smooth transition between the connecting portion and the base of the roll facing side may be disregarded in determining the relative orientation of the base and connecting portion. Alternatively or additionally, the sloping portion may extend over the full width of the connecting portion in the circumferential direction of the end plug, or the connecting portion may include other portions on either or both sides thereof, which may or may not slope in the same manner. For example, the sloping portion may be a circumferentially central portion of the connecting portion.

Each dome may comprise a base portion and an upper portion. An outer wall of the dome may define an inflection point at a transition between the base and upper portions of the dome or may define a smooth transition between the base and upper portions. The outer wall refers to a radially outer wall of the dome on the roll facing side of the end plug. In embodiments the outer wall of the dome comprises a first portion in the base portion of the dome upstanding from the base of the roll facing side of the end plug and a second, sloping portion in the upper portion of the dome inclined relative to the first portion. The first portion of the outer wall may extend substantially perpendicular to the base. (Any smooth transition between the outer wall and base may be disregarded in determining the orientation of the wall). The second, sloping portion is inclined inwardly toward an axial centre of the end plug with increasing height away from the base of the roll facing side of the end plug. The second, sloping portion may extend from the top of the base portion to a top of the dome (which may be defined by a flat top surface). The angle subtended between the first and second portions of the wall may be selected as desired. For example, the angle may be in the range of at least 20 degrees, and may be in the range of less than 50 degrees, or less than 40 degrees. In some exemplary embodiments the angle is in the range of from 20-40 degrees, such as 30 degrees. Where a smooth transition is provided between the base and upper portions, the transition region should be disregarded in determining the angle defined between the base and upper portions.

In accordance with any of the embodiments including domes on the roll facing side of the end plug, the formations for securing the end plug to the roll may be disposed in any suitable location. In some embodiments the formations comprise protuberances projecting outwardly from the domes e.g. from the outer walls thereof. Thus, each protuberance may project outwardly from a respective one of the domes. For example the protuberances may project from base portions of the outer walls of the domes. In these embodiments, the dome may assist in maintaining the end plug in place within the opening in the end of a roll, supporting the protuberance which engages the periphery of the opening e.g. to provide an interference fit. A protuberance may be associated with any one or ones of the domes, and preferably a protuberance is associated with each dome. The protuberance may be located at any desired point along the outer edge of the dome. In some embodiments, each protuberance has a height extending over at least a portion of a height of a base portion of the dome. Each protuberance may have a height at least as great as a height of the base portion of the dome. This may provide further advantages in the ability of the dome to support the protuberance and thus assist in obtaining a more secure interference fit. Thus, each protuberance may extend over at least a portion and optionally the full height of a first portion of an outer wall of the dome where the outer wall includes first and second portions as described above. The protuberance may optionally extend into a transition region between the first and second portions of the outer wall if present.

In alternative embodiments, the formations e.g. protuberances for securing the end plug to the roll are located between the domes. For example, the formations e.g. protuberances may project outwardly from connecting portions extending between the domes. Where a connecting portion includes a base portion, and a sloping upper portion, the protuberance may, for example, extend over at least a portion, and optionally the full height of the base portion.

It will be appreciated that all components of the roll facing side e.g. domes, protuberances for providing an interference fit, connecting portions, central portion, roll facing surface of a peripheral flange, base etc. may be considered to be formations of the roll facing side. Such formations are all produced in the moulding process used to manufacture the end plug. These formations include the formations which are configured to be insertable into the opening in the end of a roll e.g. the domes, connecting portions, protuberances for providing an interference fit, central portion etc. The formations include formations for securing the end plug to the roll. The formations of the roll facing side may also provide overall structure and strength properties to the end plug.

The configuration of the formations on the roll facing side of the end plug may be rotationally symmetric.

The dispenser facing side of the end plug comprises formations configured to cooperate with formations of a roll holder portion of a dispenser (i.e. the roll facing side thereof) for mounting the end plug to the dispenser. The formations of the dispenser facing side of the end plug enable the end plug to be mounted on to a roll holder portion of a dispenser with which the end plug is intended to be used without constraint, and may also aid in providing overall structure to the end plug.

The formations of the dispenser facing side of the end plug and the formations of the roll holder portion which cooperate with one another may comprise at least one respective set of one or more formations of the dispenser facing side of the end plug and of one or more formations of the roll holder portion that are complimentary to one another. The respective sets of one or more formations may each define one of a pair of complimentary parts.

Where not explicitly stated, and unless the context demands otherwise, any structure of the dispenser facing side of the end plug or of the (roll facing side) of the roll holder portion may be defined by one or more formations of that side of the end plug or roll holder portion.

At least some of the respective cooperating formations of the end plug and roll holder portion may be arranged to engage one another to mount the end plug to the dispenser. For example, a mating engagement may be provided. The end plug may provide a female part and the roll holder portion the male part of the mating connection. However, it will be appreciated that not all of the cooperating formations of the dispenser facing side of the end plug and formations of the roll holder portion need necessarily engage one another for mounting the end plug to the dispenser.

At least some of the cooperating formations of the dispenser facing side of the end plug and roll holder portion may cooperate with one another in that they do not interfere with the interaction between others of the cooperating formations of the dispenser facing side of the end plug and roll holder portion required to mount the end plug to the roll holder portion of a dispenser with which the end plug is intended to be used e.g. by enabling complimentary sets of one or more formations of the dispenser facing side of the end plug and the roll holder portion to properly engage one another to provide a secure mounting. For example, cooperating formations of the dispenser facing side of the end plug and the roll holder portion surrounding an annular structure of the dispenser facing side of the end plug which receives a projection of the roll holder portion may cooperate with one another such that they do not preclude the projection being fully received in the annular structure. The formations of the dispenser facing side and the roll holder portion may or may not engage one another in doing this. Where appropriate, the formations of the dispenser facing side of the end plug and the roll facing side of the roll holder portion may cooperate with one another to not preclude the projection being fully received in the annular structure, while permitting rotation of the end plug relative to the roll holder portion. It will be appreciated that the formations may, in this way, be used to ensure that the end plug may only be used with a roll holder portion with which they are intended to be used, preventing the end plug from being properly fitted onto other dispensers. Various features of the formations of the dispenser facing side of the end plug will now be described. These may be described by reference to features of the dispenser or roll holder portion thereof, with which they interact. The invention extends to the dispenser facing side having formations configured to interact with the dispenser/roll holding portion thereof in the manner described, and also extends to a dispenser system including the end plug and a dispenser.

The formations of the dispenser facing side may be configured to enable the end plug to be rotatably mounted to the roll holder portion. This will allow the end plug to rotate with the roll of sheet material relative to the roll holder portion during dispensing of sheet material. However, alternatively the formations of the dispenser facing side may be configured to enable the end plug to be fixedly mounted to the roll holder portion i.e. such that relative rotation between the roll holder portion of the dispenser and the end plug is prevented. In such embodiments, the roll holder portion may be adapted to be rotatable relative to a cooperating portion e.g. an adjacent portion of the dispenser to permit rotation of the roll relative to at least a portion of the dispenser once mounted for the dispensing of sheet material. The cooperating portion of the dispenser may, for example, be an arm of the dispenser. The roll holder portion may be mounted to the arm of the dispenser via a mounting portion, such as a hub, that is rotatable relative to the arm. The mounting portion may be disposed on the arm e.g. at the distal end of the arm.

In some embodiments the formations of the dispenser facing side may be configured to cooperate with the formations of the roll holder portion to enable the end plug to be mounted to the roll holder portion in a fixed rotational orientation relative to the roll holder portion. For example, the formations of the dispenser facing side may comprise formations configured to cooperate with formations of the roll holder portion to provide a keyed connection between the end plug and the roll holder portion. This may be achieved in any suitable manner. In some exemplary embodiments the dispenser facing side of the end plug comprises one or more recesses for receiving respective ones of one or more projections of the roll holder portion, the edges of the recesses cooperating with the respective ones of the one or more projections of the roll holder portion for providing a keyed connection between the roll holder portion and the end plug. The edges of the recesses cooperate with the projections to prevent rotation of the end plug relative to the roll holder portion.

The recesses may be closed ended recesses. Thus the recesses may not extend all the way through the end plug from the dispenser facing side to the roll facing side.

The keyed connection may be provided by cooperation between a recess on the dispenser facing side of the end plug and a projection of the roll holder portion. The projection may, for example, may be a sensor part of the roll holder portion. For example, in some embodiments, where the roll facing side of the end plug comprises a plurality of domes, the dispenser facing side of the end plug may comprise a plurality of recesses, each recess corresponding to the dispenser facing side of one of the domes. Thus each of the one or more recesses is provided by the reverse side of a respective one of the domes. In these embodiments, the recesses are closed ended recesses. One or more of these recesses may cooperate with a respective one of one or more projections of the roll holder portion (e.g. in the manner above described) to provide a keyed connection between the roll holder portion and the end plug. This may be achieved by configuring the dome such that it may receive the projection of the roll holder portion to provide the keyed connection. In some exemplary embodiments in which the roll facing side of the end plug comprises a plurality of domes, one of a plurality of recesses defined on the dispenser facing side of the end plug corresponding to the dispenser facing side of a dome receives a projecting sensor part of the roll holder portion to provide a keyed connection between the end plug and the roll holder portion.

In other embodiments, the recesses are openings extending through the end plug from the dispenser facing side to the roll facing side. The openings may be openings through connecting portions extending between domes where the roll facing side of the end plug comprises a plurality of domes with connecting portions therebetween. For example, a such recess may receive a sensor part of a roll holder portion of the dispenser.

In any of the embodiments in which a keyed connection between the roll holder portion and end plug is provided between the end plug and a sensor part of the roll holder portion, whether or not this involves a recess in the form of an opening, or being the reverse of a dome for receiving the sensor part, the sensor part may, for example, comprise a magnet. The sensor part may form part of a sensor arrangement of the dispenser for sensing rotation of the roll holder portion e.g. a number of rotations thereof in use. The sensor arrangement may then comprise a further part associated with the cooperating portion of the dispenser with respect to which the roll holder portion rotates. The cooperating portion may be an arm of the dispenser. The further part of the sensor arrangement may be associated with a mounting portion of the dispenser, such as a hub, provided on the cooperating portion of the dispenser e.g. the arm thereof. The mounting portion is then rotationally fixed with respect to the arm. The roll holder portion rotates relative to the mounting portion and hence relative to the cooperating portion e.g. arm of the dispenser. The further part of the sensor may be a probe for detecting the proximity of the magnet part of the sensor. The probe is rotationally fixed, and may be used to detect the passing of the magnet part of the sensor, and hence the rotation of the roll holder portion relative to the probe. The sensor part associated with the roll holder portion may provide the target part of the magnetic sensor arrangement for sensing rotation of the roll holder portion, and the cooperating portion of the dispenser may comprise the probe part of the sensor arrangement.

A single recess of the dispenser facing side of the end plug may cooperate with a single projection of the roll holder portion to provide a keyed connection therebetween. Of course, the dispenser facing side of the end plug may comprise additional recesses which may not necessarily cooperate with a projection of the roll holder portion to assist in providing a keyed connection therebetween. Where a plurality of recesses are provided, e.g. corresponding to respective ones of the domes, or in the form of openings, each recess may be configured to receive the projecting sensor part of the roll holder portion, enabling the end plug to be mounted more easily to the roll holder portion, without needing to ensure a specific orientation thereof. For example, where a plurality of domes of identical construction are provided, each may provide a recess on the reverse side thereof configured to receive the projecting part of the roll holder portion. Similarly where a plurality of recesses in the form of openings are provided, each may be configured to receive the projecting part.

Whether or not the end plug is configured to be rotatably mounted to the roll holder portion of the dispenser, the dispenser facing side of the end plug may comprise an annular structure defining a central bore for receiving a projection e.g. boss defined by the roll holder portion of the dispenser. The annular structure is defined by one or more formations of the dispenser facing side. The annular structure may be arranged to provide a snug fit to the projection. The projection of the roll holder portion may project from a base of the roll holder portion. The base may define a first or front e.g. roll facing face of the roll holder portion. The projection of the roll holder portion may be defined by one or more of the formations of the roll holder portion. The projection may be defined by a single formation i.e. a single element. However, it is envisaged that a segmented structure formed from multiple formations could be used. Thus, in these embodiments, the annular structure of the end plug and the projection of the roll holder portion are each provided by respective sets of one or more formations of the respective one of the dispenser facing side of the end plug and the roll facing side of the roll holder portion that are complimentary to one another. Each set of one or more formations defines one of a pair of complimentary parts. In the example, a single formation of the end plug is complimentary with the projection defined by a set of one or more formations of the roll holder portion.

In embodiments in which the dispenser facing side of the end plug comprises an annular structure, preferably the annular structure is provided by an annular formation of the dispenser facing side. Thus the annular structure may be provided by a formation in the form of a single annular element. The annular structure may be a tubular structure, such as a cylindrical structure e.g. element.

In some embodiments the end plug is able to rotate relative to the roll holder portion when the projection defined by the one or more formations of the roll holder portion is received in the annular structure defined by one or more formations of the end plug. The annular structure may be arranged to provide a snug fit to the projection during such rotation. However, as mentioned above, in other embodiments, one or more other formation of the dispenser facing side of the end plug may cooperate with one or more other formation of the holder portion to preclude such rotation.

In either case, the annular structure may define a central axis corresponding to a central axis of the end plug. The central bore and the annular structure may be coaxial with the axis of the end plug. The annular structure may be configured to receive a cylindrical projection defined by one or more formations of the roll holder portion. The cylindrical projection of the roll holder portion may be of circular or oval transverse cross-section. A cylindrical projection may be defined by a single formation of the roll holder portion, or may be defined by a plurality of the formations e.g. being a segmented cylinder. A cylindrical projection may be defined by an outer perimeter of a group of formations of the roll holder portion. In other embodiments a cylindrical projection of the roll holder portion may be defined by a single element e.g. a boss, which may be hollow or solid. However, regardless of whether it is defined by one or more of the formations of the roll holder portion, it will be appreciated that the projection of the roll holder portion need not be cylindrical. The projection may be of regular irregular shape in transverse cross section. A diameter of the projection may then be defined by a circle connecting the outermost points of each one of the formations defining the projection. The outer most points refer to the radially outermost points thereof.

Regardless of the construction of the projection with which it cooperates, the central bore of the annular structure is preferably a closed ended bore. A distal end of the bore is closed i.e. an end closer to the interior of the end plug. The end of the bore will then cooperate with the end of the projection of the roll holder portion to provide an end stop limiting the extent to which the end plug may be pushed onto the roll holder portion. The dimensions of the annular structure may be selected as desired depending upon the dimensions of the projection defined by the one or more formations of the roll holder portion of the dispenser with which the end plug is intended to be used. For example, the diameter of the bore may be selected by reference to a diameter of the projection to enable the bore to receive a projection defined by the one or more of the formations of the roll holder portion. This may enable the end plug to be used such that it will only fit certain types of dispenser having a projection dimensioned appropriately to be received by the bore.

As described above, in some preferred embodiments, the roll facing side of the end plug comprises a plurality of domes surrounding a central portion of the roll facing side of the end plug. Preferably the closed end of the bore is provided by a dispenser facing surface of a portion (e.g. wall) of the end plug whose opposite surface provides the central portion of the roll facing side of the end plug. Thus the dispenser facing surface of the central portion provides the closed end to the bore.

In some embodiments the formations of the roll holder portion include one or more formations defining an annular space at least partially surrounding the projection of the roll holder portion. The formations of the roll holder portion may define at least one circumferentially extending structure at least partially surrounding the projection to define the annular space. The circumferentially extending structure may fully surround i.e. encircle the projection of the roll holder portion. However, in other embodiments the circumferentially extending structure extends around only a portion of the circumference of the projection. The circumferentially extending structure may be continuous or discontinuous. The structure may be defined by one or more of the formations of the roll holder portion. However, in alternative embodiments, it is envisaged that radially extending formations could be used to define an annular space between the radially innermost ends of the formations and the projection. The formations may then be arranged as spokes surrounding the projection. However it is defined, the annular structure of the end plug may be configured such that it may be inserted into the annular space. The radial dimension of a wall (i.e. wall thickness) of the annular structure e.g. element of the end plug may be selected with regard to the dimensions of the annular space of a roll holder portion with which it is intended to be used to enable this. This may provide another feature preventing the end plug from being used with a dispenser with which it is not configured for use.

Where the formations of the roll holder portion include one or more formations defining a circumferentially extending structure, the circumferentially extending structure may comprise a circumferentially extending wall upstanding from the roll holder portion, wherein the annular space is defined between the wall and the projection. The circumferentially extending wall may be upstanding from a base of the roll holder portion. The wall may define an arc. The circumferentially extending structure may further comprise a ramp structure extending radially outwardly from the top of the wall to connect the top of the wall to the base of the roll holder portion. The ramp structure may facilitate mounting of a roll to the roll dispenser portion by a user.

The dispenser facing side of the end plug may further comprise one or more (and optionally a plurality of) sloping surfaces configured to cooperate with e.g. engage a surface of a ramp structure of the roll holder portion of the dispenser to enable the end plug to be mounted to the roll holder portion, preferably so as to be rotatably mounted thereto. The ramp structure may be defined by one or more formations of the roll holder portion. The sloping surface(s) may preclude mounting of the end plug to an inappropriate dispenser e.g. preventing the annular structure from being able to receive the projection of the dispenser. The sloping surface(s) may have an inclination corresponding to an inclination of the ramp structure of the roll holder portion with which they cooperate. The sloping surface(s) of the dispenser facing side of the end plug are inclined in a radial direction. The sloping surfaces are inclined toward an axial centre of the end plug. The sloping surface(s) may extend from a periphery of the end plug toward an axis thereof in the radial direction. The sloping surface(s) extend axially into an interior of the end plug (i.e. away from a front face of the dispenser facing side). Each sloping surface also extends circumferentially. Preferably a plurality of such sloping surfaces are provided. The surfaces may be spaced from each other around the circumference of the end plug. The surfaces may cooperate with the same or different ramp structures of the roll holder portion, depending whether the end plug is rotatably mounted thereto. For example, in some embodiments, the roll holder portion includes a single ramp structure, and different ones of a plurality of sloping surfaces of the dispenser facing side of the end plug engage with the ramp structure during rotation of the end plug relative to the roll holder portion.

At least some of the formations of the dispenser facing side of the end plug may be provided by a reverse i.e. dispenser facing side of formations of the roll facing side of the end plug. In preferred embodiments in which the end plug comprises a plurality of domes e.g. connected by connecting portions on the roll facing side thereof, the reverse side of the domes (and, where applicable, the connecting portions) may give rise to formations on the dispenser facing side of the end plug. The formations on the dispenser facing side of the end plug provided by the reverse side of formations of the roll facing side e.g. domes (and, where applicable, connecting portions) should be configured so as to at least not interfere with the cooperation e.g. engagement required between other formations of the dispenser facing side and formations of a roll holder portion of a dispenser to enable suitable mounting of the end plug to the roll holder portion. In some embodiments, at least some of the formations provided by the reverse side of formations of the roll facing side e.g. the domes (and, where applicable, connecting portions) may engage formations of the roll holder portion to assist in mounting the end plug to the dispenser. The reverse side of the formations of the roll facing side may define at least one set of one or more formations on the dispenser facing side of the end plug that is complimentary to a set of one or more formations of the roll holder portion.

Where the dispenser facing side of the end plug further comprises one or more (and optionally a plurality of) sloping surfaces configured to cooperate with e.g. engage a surface of a ramp structure of the roll holder, e.g. so as to be rotatably mounted thereto, the sloping surfaces may be provided by a reverse side of formations on the roll facing side of the end plug. For example, where the end plug comprises a plurality of domes connected by connecting portions on the roll facing side thereof, the reverse side of the domes and/or connecting portions may provide the one or more sloping surfaces of the dispenser facing side of the end plug configured to cooperate with the ramp structure of the roll holder.

Where the end plug comprises a plurality of domes connected by connecting portions comprising sloping portions on the roll facing side thereof, each sloping surface of the dispenser facing side of the end plug may be provided by the dispenser facing surface of a sloping portion of one of the connecting portions. The dispenser facing surfaces of the sloping portions may engage a ramp structure of a dispenser roll holder portion as described above.

Where the formations of the roll holder portion include formations defining a circumferentially extending structure raised relative to a base of the roll holder portion, the ramp structure may connect a top of the circumferentially extending structure to the base of the roll holder portion.

The end plug may comprise a peripheral flange. The flange may define a radially outermost edge of the end plug. The flange may comprise a planar surface on the dispenser facing side thereof. The dispenser facing side of the flange may define a front face of the dispenser facing side of the end plug. The flange is preferably a continuous flange extending around the entire circumference of the end plug. The flange may have a maximum radial width that corresponds to less than 20% or less than 15% of a diameter of the end plug.

The end plug may comprise a circumferentially extending peripheral wall supporting the flange (the "flange supporting wall portion"). The peripheral wall may extend into the interior of the end plug on the dispenser facing side thereof. The flange may be substantially perpendicular to the flange supporting wall. Any smooth transition between the supporting wall and the flange may be disregarded. Portions of the peripheral wall on the roll facing side of the end plug may define the outer walls of the domes, where provided, and any connecting portions associated with the roll facing side of the end plug.

The dispenser facing side of the end plug may comprise a plurality of reinforcing ribs. The ribs may extend between the annular structure and a peripheral region of the end plug on the dispenser facing side. The ribs may connect the annular structure to the periphery of the end plug. The ribs may act to reinforce the annular structure to help maintain integrity when used to mount the end plug to a dispenser, and, may also assist in enhancing overall structural resistance of the end plug. For example, in embodiments described below, the ribs may act to reinforce domes of the roll facing side where present.

The ribs are radially extending ribs. The ribs may help to enhance the strength of the end plug and reinforce an annular structure of the dispenser facing side of the end plug. The ribs may extend between a radially outer surface of the annular structure and a portion of a peripheral wall of the dispenser facing side of the end plug. The peripheral wall may be a wall to which a peripheral flange of the end plug is connected. The flange may extend substantially perpendicular to the wall. Any smooth transition region at an interface between the flange and peripheral wall may be disregarded in this regard. The ribs may extend from a radially outer surface of the annular structure e.g. formation to the radially inner surface of the peripheral wall portion.

In preferred embodiments in which the roll facing side of the end plug comprises a plurality of domes, each rib may extend across a recess in the dispenser facing side of the end plug corresponding to a dispenser facing side of the dome. The rib may reinforce the respective dome. One rib may be provided in respect of each dome. The rib may have a first radially extending surface closer to a roll in use, and an opposite second radially extending surface further from a roll in use. The first radially extending surface may extend along a dispenser facing surface of an upper portion of the dome, and may extend along the entire length of the dispenser facing surface of the upper portion of the dome. The rib may be configured to extend to the dispenser facing surface of a top of the dome. The use of reinforcing ribs is optional, and, where present, it is optional whether they extend across the recesses in the dispenser facing side of the end plug corresponding to the dispenser facing sides of the domes. For example, where a recess corresponding to the reverse side of a dome is to receive a projection e.g. sensor part of a roll holder portion, the recess may be free from such ribs to avoid any potential interference with the insertion of the projection into the recess. In such embodiments ribs may optionally still be provided between the domes on the dispenser facing side.

In embodiments including a plurality of domes on the roll facing side of the end plug, in which each dome comprises a base portion and an upper portion, the peripheral wall portion of the dispenser facing side of the end plug to which the rib is connected may correspond to a wall portion defining a base portion of a dome on the roll facing side of the end plug e.g. the wall portion may be a first portion of an outer wall of the dome.

Each rib may define a proximal end connected to the radially outer surface of the annular structure e.g. formation and a distal end connected to the dispenser facing surface of the peripheral wall portion. Each rib may extend at its proximal end over at least a portion of the height of the annular structure, such as at 10% or at least 20% of the height thereof, and/or may extend of no more than 80% or 60% or 50% of the height thereof. Each rib may have a height at the distal end thereof corresponding to at least a portion of the peripheral wall portion, such as at least 10% or at least 20% of the height thereof. Each rib may extend to the base of the annular structure.

It will be appreciated that the dispenser facing side of the end plug may define a first face. The first face may be referred to as the "front face". The first e.g. front face corresponds to the face of the end plug that engages a first surface or base of the roll holder portion when the end plug is mounted thereto. This corresponds to the face of the end plug that is closest to the roll holder portion as the end plug approaches the roll holder portion. The first e.g. front face of the dispenser facing side corresponds to a plane including a forward most point(s) of the formations associated with the dispenser facing side. The terms "forward" or "front" refer to the direction further from the roll when the end plug is used to mount a roll to a dispenser. In embodiments the front face of the dispenser facing side is defined by a plane in which the dispenser facing surface of a peripheral flange of the end plug lies. Where provided, an annular structure of the dispenser facing side may not extend beyond and may terminate in this plane. References to formations being "recessed" refer to the formations being recessed relative to the front face. The interior of the dispenser facing side refers to portions of the dispenser facing side away from the front face, in an axial direction of the end plug.

The present invention extends to a dispenser system comprising a moulded fibrous end plug in accordance with the invention in any of its aspects or embodiments and a dispenser comprising a roll holder portion comprising formations configured to cooperate with the formations of the dispenser facing side of the end plug for mounting the end plug to the dispenser in use. The formations of the roll holder portion are formations of a roll facing side of the roll holder portion. The roll facing side faces an end of the roll.

It will be appreciated that any of the further aspects of the invention may include any or all of the features of the invention described in relation to any other aspects and embodiments of the invention to the extent they are not mutually inconsistent therewith. In particular, it will be appreciated that the invention in the second and further aspects may comprise any or all of the features described in respect of the method of the first aspect of the invention, and vice versa.

The present invention further extends to a dispenser system comprising:

- a dispenser for a roll of sheet material, the dispenser comprising a roll holder portion;
- a roll of sheet material having an opening in an end thereof;
- and a moulded fibrous end plug in accordance with the invention in any of its aspects or embodiments secured to the end of the roll of sheet material;
- wherein the formations of the roll facing side of the end plug configured to be insertable into an opening in an end of a roll of sheet material are inserted into the opening in the end of the roll of sheet material;
- and wherein the formations associated with the dispenser facing side of the end plug cooperate with formations of the roll holder position of the dispenser to mount the end plug to the dispenser.

The end plug thus mounts the end of the roll to the roll holder portion of the dispenser. The roll holder portion may be in the form of a hub.

Formations of the roll facing side of the end plug are axially inserted into the opening at the respective end of the roll.

The formations of the roll facing side of the end plug that are insertable into an opening in an end of a roll comprise formations which secure the end plug to the roll of sheet material. Thus, the formations associated with the roll facing side of the end plug which are insertable into an opening in an end of a roll are inserted into the opening in the end of the roll of sheet material with the formations for securing the end plug to the end of the roll of sheet material securing the end plug to the end of the roll of sheet material. References herein to the formations associated with the roll facing side being inserted into the opening in the end of the roll of sheet material to secure the end plug to the end of the roll of sheet material should be understood in this way.

It will be appreciated that the roll facing side may include formations insertable into the opening which do not necessarily directly contribute to securing the end plug to the roll, but may support the securement of the end plug to the roll e.g. by enhancing the structural integrity of the end plug.

These further aspects and embodiments of the invention may incorporate any of the features described in relation to the earlier aspects and embodiments of the invention to the extent they are not mutually exclusive. The end plug, and the roll facing and dispenser facing sides thereof, may include any of the features described earlier. Likewise, the roll holder portion and roll may include any of the features previously described, and may cooperate with the end plug in any of the manners described.

In accordance with these further aspects and embodiments of the invention the roll of sheet material is rotatably mounted to the dispenser to enable rotation of the roll relative to at least a portion of the dispenser. In some preferred embodiments the dispenser facing side of the end plug cooperates with the roll holder portion to rotatably mount the end plug to the holder portion of the dispenser i.e. to permit rotation between the end plug and the roll holder portion. The roll facing side of the end plug may fixedly mount the end plug to the end of the roll of sheet material i.e. to prevent relative rotation between the end plug and roll.

In other embodiments, the dispenser facing side of the end plug may cooperate with the holder portion to fixedly mount the end plug to the roll holder portion of the dispenser i.e. to prevent relative rotation between the end plug and the roll holder portion. In such embodiments the roll holder portion of the dispenser may be rotatably mounted to a cooperating part e.g. an adjacent part of the dispenser whereby the roll, end plug and roll holder portion may rotate together to permit rotation of the roll relative to at least a portion (e.g. a main body) of the dispenser. The cooperating part may be a dispenser arm of the dispenser. Thus, the roll holder portion may be provided at a distal end of a dispenser arm, and may be rotatably mounted thereto. The roll holder portion may be in the form of a hub rotatably mounted to the distal end of the dispenser arm. The roll holder portion may be rotatably mounted to the dispenser arm (e.g. to a distal end thereof) via a mounting portion e.g. hub. The roll holder portion is then rotatably mounted to the mounting portion. The mounting portion is fixedly mounted to the dispenser arm. In this way the roll holder portion and end plug are rotatably mounted to the distal end of the arm.

As set out above, in embodiments the dispenser facing side of the end plug comprises one or more recesses for receiving respective ones of one or more projections of the roll holder portion, the edges of the recesses cooperating with the respective ones of the one or more projections of the roll holder portion for providing a keyed connection between the roll holder portion and the end plug. Where the roll facing side of the end plug comprises a plurality of domes, the dispenser facing side of the end plug may comprise a plurality of recesses, each recess corresponding to the dispenser facing side of one of the domes, wherein one of the plurality of recesses defined on the dispenser facing side of the end plug corresponding to the dispenser facing sides of a dome receives a projecting part of the roll holder portion to provide a keyed connection between the end plug and the roll holder portion. The projecting part of the roll holder portion may be a sensor part, for example comprising a magnet.

The end of the roll of sheet material may be a first end thereof, the moulded end plug a first end plug, and the roll holder portion a first roll holder portion of the dispenser. The roll of sheet material may further comprise an opening in a second end thereof, and a second moulded fibrous end plug in accordance with the invention in any of its aspects or embodiments secured to the second end of the roll of sheet material, wherein the formations of the roll facing side configured to be insertable into an opening in an end of a roll of sheet material are inserted into the opening in the second end of the roll of sheet material. Formations of the roll facing side of the end plug inserted into the second end of the roll of sheet material secure the end plug to the second end of the roll of sheet material. The first and second end plugs are distinct end plugs. The first and second end plugs may be identical. The formations associated with the dispenser facing side of the second end plug cooperate with formations of a second roll holder position of the dispenser to mount the end plug to the dispenser. The end plugs may rotatably mount the roll of sheet material to the dispenser to enable rotation of the roll relative to at least a portion of the dispenser in any of the manners described above. Each end plug may cooperate with its respective holder portion in the same manner i.e. to rotabably or fixedly mount the end plug thereto.

The dispenser may be of any suitable type. The dispenser may be an electronic dispenser e.g. for hands-free dispensing of sheet material, or may be manually operated. The dispenser may be operable to dispense a predetermined length of sheet material. The dispenser may be a wall-mounted dispenser.

The roll holder portion of the dispenser may be associated with a dispenser arm. For example, the roll holder portion may be provided at a distal end of a dispenser arm. In other embodiments, as discussed above, the roll holder portion may be rotatably mounted to a mounting portion associated with a dispenser arm e.g. at a distal end thereof. In either case, the dispenser may comprise a pair of dispenser arms, each having a roll holder portion associated with the distal end thereof. A space may be defined between the roll holder portions for receiving the roll of sheet material. The dispenser arms may be resiliently mounted to a portion of the dispenser e.g. to opposed sides thereof.

The end plug may be specific to the type of dispenser, such that the formations associated with the dispenser facing side of the end plug are configured to cooperate with formations of only that type of dispenser to mount the end plug to the dispenser. Providing a roll with end plug(s) inserted in the end(s) thereof may then help to ensure that the roll of sheet material is only usable with a type of dispenser with which it is intended to be used e.g. the ensure optimum operation.

A peripheral flange of the end plug may be engaged against the end of the roll when the end plug is inserted into the opening at the end thereof in use. The flange is located outside the opening in the roll. The flange may be sandwiched between opposed surfaces of the roll and the roll holder portion of the dispenser. The flange may have a radius corresponding to less than 50% or less than 30% or less than 20% or less than 10% of a radius of the sheet material surrounding the opening at the end of the roll.

The end plug of the present invention is associated with only a single roll.

The present invention extends, in a further aspect, to a roll product comprising a roll of sheet material having an opening in an end thereof, and a moulded fibrous end plug in accordance with the invention in any of its aspects or embodiments secured to the end of the roll with the formations of the roll facing side of the end plug configured to be insertable into an opening in an end of a roll of sheet material being inserted into the opening in the end of the roll. Formations of the roll facing side of the end plug inserted into the end of the roll of sheet material secure the end plug to the end of the roll of sheet material.

It will be appreciated that any of the further aspects of the invention may include any or all of the features of the invention described in relation to any other aspects and embodiments of the invention to the extent they are not mutually inconsistent therewith. In particular, it will be appreciated that the invention in the second and further aspects may comprise any or all of the features described in respect of the method of the first aspect of the invention, and vice versa.

The roll has first and second ends. The roll may comprise openings in both ends thereof. A moulded fibrous end plug in accordance with the invention in any of its aspects or embodiments is secured to at least one, and preferably each end of the roll, with the formations of the roll facing side of each end plug being inserted into the opening at the respective end of the roll. One end plug is secured to each end of the roll. The end plugs may be identical.

The or each opening is defined at an axial end of the roll. The roll may define openings in each axial end thereof i.e. at first and second ends thereof. The or each opening extends axially into the interior of the roll. The opening may be an end of a bore extending through the roll from one end to the other, or may, for example, be an indentation extending only along a portion of the length of the roll. The opening may be any opening to which an end plug can be secured by virtue of the formations associated with the roll facing side thereof.

The or each opening may have a central axis aligned with a central axis of the roll.

The or each opening may be defined by a core of the roll of sheet material. Thus, the roll may be a cored roll. In such cases the opening may be an end of a bore extending through the roll from one end to the other that is lined by a core. However, the end plugs described herein may equally be used with coreless rolls.

The end plug has a length corresponding to only a portion of a length of the roll in a direction connecting the ends of the roll. Where first and second end plugs are associated with first and second ends of the roll, the end plugs are spaced from one another along an axis of the roll.

The roll of sheet material may be any type of roll of sheet material. The roll may be a roll in which sheet material is dispensed from a periphery of the roll. The roll may define an axial direction. The length of the roll is measured in the axial direction. The axis extends from one end of the roll to the other. The roll is a central axis (i.e. radially central).

A flange of the or each end plug may have a radius corresponding to less than 50% or less than 30% or less than 20% or less than 10% of a radius of the sheet material surrounding the opening at the end of the roll.

The roll may be cylindrical. Where provided, a core may be a cylindrical core.

The sheet material may be any suitable web material. For example, the material may be paper, e.g. where the roll provides paper towels, toilet tissue or facial tissue, nonwoven material, e.g. where the roll provides wipers, or may be any other suitable web material. In some preferred embodiments the sheet material is a paper material for providing paper towels or toilet tissue. The roll of sheet material may or may not be perforated.

A roll of sheet material may be supplied to a consumer with end plug(s) inserted in the end(s) thereof, and preferably with end plugs inserted in openings at each end thereof for use in refilling a dispenser. The system may then provide a refill for a dispenser. The roll with the end plug(s) inserted in the end(s) thereof may be packaged in an outer packaging e.g. an outer wrap. The roll product may therefore provide a roll product refill for a dispenser. The end plugs may be inserted into the end of the roll during production of the roll product by machine.

In accordance with any of the aspects or embodiments of the invention, the end plug is preferably a single piece end plug. The end plug is integrally moulded. The end plug may be used without any additional components to securely mount a roll to a dispenser roll holder portion. Thus, the end plug has sufficient integrity to be self-supporting in use.

The end plug has a predetermined shape.

In some embodiments the end plug may be free from openings extending therethrough (i.e. from the dispenser facing side to the roll facing side), while in other embodiments, such openings may be present e.g. in regions between domes where the roll facing side comprises domes.

The end plug may have any desired dimensions to cooperate with a given roll and dispenser. By way of example only, the diameter of the end plug may be at least 3 cm or at least 4 cm. Alternatively or additionally, the diameter may be less than 8 cm, or less than 7 cm or less than 6 cm.

Alternatively or additionally the diameter of an axial bore defined by an annular structure of a dispenser facing side of the end plug may be at least 0.8 cm, or at least 1 cm. Alternatively or additionally, the diameter may be less than 2 cm, or less than 1.5 cm.

Alternatively or additionally the radial width of a wall of the annular structure may be less than 5 mm or less than 3 mm. Alternatively or additionally the radial width of the wall may be at least 1 mm or at least 2 mm.

Alternatively or additionally the height of the end plug may be at least 1 cm or at least 1.5 cm. Alternatively or additionally the height of the end plug may be less than 2.5 cm or less than 2 cm.

The end plug may be designed to have a strength such that it may not be removed from a roll after depletion of the roll e.g. from a core thereof without damage. The end plug may thus be intended to be used to mount only one roll to a dispenser and to then be disposed of after that roll is depleted.

The method extends to the use of an end plug in accordance with the invention in any of its aspects or embodiments to mount a roll of sheet material to a dispenser. The method may comprise inserting the formations of the roll facing side configured to be insertable into an opening in an end of a roll of sheet material into an opening in an end of the roll to secure the end plug thereto, and mounting the dispenser facing side of the end plug to the roll holder portion of a dispenser such that the formations thereof cooperate with formations of the roll holder portion to mount the end plug thereto, and thereby mount the roll to the dispenser. The formations of the roll facing side for securing the end plug to the roll of sheet material cooperate with the opening in the end of the roll to secure the end plug thereto when the formations of the roll facing side insertable into an opening are inserted into the opening in the end of the roll. The roll and dispenser may include any of the feature described herein.

It will be appreciated that any of the further aspects of the invention may include any or all of the features of the invention described in relation to any other aspects and embodiments of the invention to the extent they are not mutually inconsistent therewith. In particular, it will be appreciated that the invention in the second and further aspects may comprise any or all of the features described in respect of the method of the first aspect of the invention, and vice versa.

The end plug in accordance with any of the aspects or embodiments described herein may be formed from a material comprising a mixture of fibres and binder. Any suitable binder may be used which may act to bind the fibres together in a self-supporting structure. The binder is preferably biodegradable.

The binder is preferably a polymeric binder. The binder may comprise one or more biodegradable biopolymer. The binder may consist of a single biodegradable biopolymer, or any suitable mixture of biopolymers. A biopolymer as used herein refers to a polymer derived from natural sources. Thus the binder may comprise one or more natural polymer. In preferred embodiments the binder comprises starch. Any suitable starch e.g. industrial starch may be used. For example, in exemplary embodiments the starch may be selected from; potato starch, tapioca starch, maize starch, wheat starch, cassava starch, rice starch, or any combination thereof. In preferred embodiments the starch is potato starch or tapioca starch, and most preferably potato starch.

The binder may provide the end plug with a sufficient degree of rigidity to enable the end plug to retain a given moulded shape. The end plug may be semi-rigid.

The binder may provide a matrix holding the fibres of the moulded fibrous end plug in place. The matrix may provide a skeletal structure defining the shape of the end plug. The binder may then be of any suitable material which may form such a matrix under the conditions used to manufacture the end plug. A polymeric binder of any of the types described above may function in this manner. In embodiments the binder is a polymeric binder, wherein the binder is cross-linked and/or gelatinized to provide the matrix. The cross-linking and/or gelatinization process may enable the polymer(s) of the binder to set and provide the matrix. For example, in preferred embodiments in which the binder comprises starch, the starch may gelatinize when mixed with water during manufacture of the end plug. Other polymers may alternatively or additionally be used which may cross-link during manufacture of the end plug e.g. when heated to provide the matrix.

In embodiments, the moulded fibrous end plug is produced using a process in which heat is applied e.g. through baking to cause the polymeric material of the binder to cross link and/or gelatinize.

The moulded fibrous plug may have been produced through a process in which the mixture of fibres and binder has been moulded and baked. The baking may occur in the mould. Exemplary processes are described below.

The fibres used in making the end plug may be of any suitable type. The fibers are preferably biodegradable fibers. The fibers are preferably natural fibers. The fibres may include virgin fibres, but for improved sustainability, may comprise or consist of recycled fibers. For example, fibers may be obtained from waste paper or any other fiber containing source of waste material. Waste paper or other waste material such as wood or vegetable waste, or any combination thereof, may advantageously provide a source of e.g. cellulosic fibers for use in producing the end plugs described herein.

The fibers may be of any suitable length. By way of example and not limitation, the fibers may comprise or consist of fibers having a length of up to 50 mm or up to 20 mm or up to 10 mm or up to 5 mm. The fibres may have a length of at least 0.5 mm or at least 1 mm.

The end plug preferably comprises cellulosic fibers. In exemplary embodiments the end plug is formed from a material comprising a mixture of cellulosic fibres and starch. The cellulosic fibers may include wood pulp or non wood pulp fibers. Non-wood pulp fibers such as bamboo, bagasse, straw etc. may be used. Such alternative non-wood pulp cellulosic fibers are increasingly used in papermaking. Other types of natural fibers may be used e.g. wool, silk etc. or other non plant based fibers. In exemplary embodiments, whether or not they comprise cellulosic fibers, the fibers of the end plug may comprise papermaking fibers.

The end plug may comprise one or more additional substances. For example, these may be residue from substances used to facilitate manufacture and/or may be substances added to impart the finished end plug with desired properties. The end plug may comprise one or more of; at least one colouring agent, at least one preservative, at least one strengthening agent, at least one stabilizer, at least one filler and at least one rising agent. Preferably any such additional substances are natural and/or biodegradable substances. For example, the end plug may comprise a rising agent in the form of yeast. Alternatively or additionally, the end plug may comprise residual liquid e.g. water from the manufacturing process.

The composition of the moulded end plug may be selected as desired, depending upon the properties required of the end plug and other factors e.g. process requirements etc. The end plug may comprise at least 10% fibers based on total solids content. The end plug may comprise less than 40% fibers based on total solids content, less than 30% fibers based on total solids content, or less than 25% fibers based on total solids content. The end plug may comprise from 10-40% or 10-30% or 10-25% fibers based on total solids content.

Alternatively or additionally the end plug may comprise at least 50% binder based on total solids content, and optionally at least 55% or at least 60% binder based on total solids content. The end plug may comprise less than 75%, or less than 70% or less than 68% binder based on total solids content. The end plug may comprise from 50% to 75% binder based on total solids content, optionally from 55% to 70%, or from 60% to 70% based on total solids content. In some exemplary embodiments the end plug comprises from 63% to 68% binder based on total solids content, such as around 65% by based on total solids content binder.

The total % starch and fibers may not add up to 100%. For example, in exemplary embodiments the end plug may comprise up to 25% or up to 22% by dry weight % residual additive substance(s) as described above. The end plug may comprise at least 5%, or at least 10% or at least 12% based on total solids content of the set of one or more additive substances. The end plug may comprise from 12 to 23% based on total solids content of the set of one or more additive substances, such as from 15-20% based on total solids content of the set of one or more additive substances.

The end plug is preferably plastic free. The end plug is preferably free from thermoplastic fibers. The end plug preferably contains only natural fibers.

The material of the moulded end plug may comprise a foamed structure.

Examples of materials which may be used in producing the end plug are described in U.S. Pat. No. 5,849,152A entitled "Process for the production of shaped bodies from biodegradable material and shaped body" of Rapido Waagen-und Maschinenfabrik GmbH. By way of example only, one suitable material for the moulded end plug is PaperFoam® obtainable from the company PaperFoam® with headquarters in the Netherlands (currently of Hermesweg 22, 3771 ND Barneveld, The Netherlands).

The moulded fibrous end plug of the invention in any of its aspects and embodiments may be readily recycled e.g. with a waste paper recycling stream.

Preferably the end plug is biodegradable. For example, the end plug may be compostable, e.g. home compostable. The end plug may be such that it may be recycled with paper products. This enables the end plug to be recycled along with a roll core when used. Biodegradable and/or compostable embodiments may provide yet further benefits in terms of sustainability.

A biodegradable end plug in accordance with the invention in any of its aspects or embodiments may comply with any one or ones (and preferably with each) of the following standards; EN 13432, ASTM D6868, TÜV Austria OK Industrial Compost or TÜV Austria OK Home Compost. The end plug may alternatively or additionally be certified as biobased in accordance with any one or ones of; USDA Certified Biobased Product, TÜV Austria OK Biobased (rank 4). The end plug may alternatively or additionally be UL validated as recyclable. The end plug may be UL validated as recyclable with a 99% recovery rate of available fibers, The end plug is a moulded end plug. Any suitable moulding process may be used. The end plug may be a moulded pulp end plug.

The present invention extends to a method of manufacturing the moulded fibrous end plug in accordance with any of the embodiments described herein.

Suitable methods include so-called "pulp moulding" processes.

The present invention extends to a method of manufacturing a moulded fibrous end plug in accordance with any of the aspects or embodiments of the invention described herein.

The method comprises providing the moulded fibrous end plug using a moulding process. The moulding process may, for example, be an injection moulding process. An injection moulding process refers to a process in which material from which the end plug is to be formed is injected into a mould in producing the end plug. In embodiments the moulded fibrous end plug is an injection moulded end plug.

A method of manufacturing the end plug may comprise;

providing a slurry comprising fibers, binder and liquid;

introducing the slurry into a mould;

and heating the slurry in the mould to provide the moulded fibrous end plug.

The present invention in this further aspect may include any or all of the features described in relation to the other aspects and embodiments of the invention to the extent they are not mutually exclusive.

In these further aspects and embodiments the method of forming the moulded fibrous end plug may comprise providing a slurry comprising fibers, binder and liquid. The binder may be in solid form, and is preferably in the form of a powder. The liquid may be an aqueous medium, and is preferably water. In embodiments the fibers are recycled fibers. The fibers may be obtained from waste paper or other waste material. The fibers may be obtained from comminuted waste material e.g. waste paper. The comminuting of waste material to provide the fibers may be performed in an initial step.

As described above, in exemplary embodiments, the fibers are biodegradable and/or natural fibers, e.g. cellulosic fibers, and the binder comprises one or more biodegradable biopolymers e.g. starch. The binder may be powdered starch. The fibers and binder may be of any of the forms described above. The slurry may comprise one or more additives to facilitate the moulding process. For example, one or more colouring agent, one or more emulsifier, one or more preservative, one or more strengthening agent, one or more filler and/or one or more rising agent may be included in the slurry. Preferably one or more rising agent is included. In exemplary embodiments a rising agent in the form of yeast is included in the slurry. This may be helpful where a foamed type of material is required. Any additives used are preferably biodegradable, and/or natural substances. This may help to optimise sustainability of the resulting end plug.

The method may optionally comprise combining the components of the slurry in a mixing tank to provide the slurry, and only introducing the slurry to a mould after a given time period has elapsed. The slurry may be agitated e.g. by stirring while in the mixing tank. The time period may be in the range of from 2 to 5 minutes, such as around 3 minutes. For example, the slurry may be in the form of a thick paste. The slurry may optionally be transferred from the mixing tank to a holding tank for storage and/or transport to a moulding station. Delaying introduction of the slurry to the mould, and the accompanying heating process, may also be advantageous in allowing any rising agent to take effect e.g. where a "foamed" type material is required. This is in a similar manner to making waffles from batter.

In accordance with the method in any of its aspects or embodiments, the method may comprise introducing the slurry into a mould and heating e.g. baking the mixture in the mould to provide the moulded fibrous end plug. The slurry may be introduced into the mould in any suitable manner, and preferably is injected under pressure into the closed mould. For example, the slurry may be pumped from a tank e.g. a storage tank into the closed mould. The heating step dries the slurry to provide the moulded fibrous end plug. At least some of the liquid content of the slurry introduced into the mould may evaporate from the mould during the heating step. The heating may bake the slurry in the mould. The step of baking the slurry in the mould may resemble a waffle baking process. The material of the resulting moulded end plug may comprise a foamed structure. Heating the slurry in the mould to provide the final moulded fibrous end plug may impart the resulting end plug with improved surface finish.

The heating process may cause the binder material to form a matrix holding the fibres in place and retaining the resulting end plug in its moulded shape. In some embodiments the heating step causes gelatinization and/or cross-linking of a polymeric binder material (e.g. a binder material comprising on or more biodegradable biopolymers). For example, in preferred embodiments, the heating step causes gelatinization of a binder comprising starch. Where gelatinization occurs, it is envisaged that some pre-gelatinization may occur prior to introduction of the slurry into the mould, such that it is not necessary that all gelatinization occurs in the mould (although in some embodiments this may be the case).

The composition of the slurry provided may be chosen as desired depending upon factors including the nature of the components, the parameters of the manufacturing process and the required properties of the final moulded end plug. The slurry may, in embodiments, have the consistency of a thick paste when introduced into the mould. This may resemble a batter using a waffle making process. The method advantageously does not include any step of dewatering the slurry prior to introduction to the mould.

The ranges below refer to the consistency of the slurry (at least) upon introduction to the mould. This advantageously corresponds to the consistency of the slurry when the slurry is initially mixed i.e. no dewatering occurs between initial mixing of the slurry and introduction of the slurry into the mould.

For example, in some embodiments the slurry may comprise less than 20%, or less than 15% or less than 12% liquid by weight. The slurry may comprise at least 5% or at least 8% liquid by weight. In some exemplary embodiments the slurry comprises about 10% liquid by weight.

The slurry may comprise at least 10% fibers by weight. The slurry may comprise less than 30% fibers by weight, or less than 25% fibers by weight. The slurry may comprise from 10-30% or 10-25% fibers by weight. In some preferred embodiments the slurry comprises form 12-23%, such as from 15-20% by weight fibers.

The slurry may comprise at least 50% binder by weight, and optionally at least 55% or at least 60% binder by weight. The slurry may comprise less than 75%, or less than 70% or less than 68% binder by weight. The slurry may comprise from 50% to 75% binder by weight, optionally from 55% to 70%, or from 60% to 70%. In some exemplary embodiments the slurry comprises from 63% to 68% by weight binder, such as around 65% by weight binder.

The total % starch, fibers and liquid may not add up to 100%. For example, in exemplary embodiments the slurry may comprise up to 25% or up to 22% by weight of a set of one or more additive substances as described above. The slurry may comprise at least 5%, or at least 10% or at least 12% by weight of the set of one or more additive substances. The slurry may comprise from 12 to 23% of the set of one or more additive substances, such as from 15-20% by weight of the set of one or more additive substances.

The slurry may be of any suitable consistency when introduced to the mould. In embodiments the slurry may be in the form of a thick paste. The slurry may comprise an amount of liquid in any of the ranges above when introduced into the mould. Thus the slurry may comprise less than 20%, or less than 15% or less than 12% liquid by weight. The slurry may comprise at least 5% or at least 8% liquid by weight. In some exemplary embodiments the slurry comprises about 10% liquid by weight when introduced into the mould.

The step of introducing the slurry into the mould may comprise injecting the slurry into the mould. The slurry is injected into a cavity defined between opposed mould parts of the mould.

In accordance with any of the aspects or embodiments of the invention, a mould used in producing the end plug may be of any suitable form. The mould is configured to produce the formations associated with the roll facing and dispenser facing sides of the end plug. The mould may comprise opposed mould parts, the mould parts respectively comprising internal formations for producing the formations associated with each side of the end plug. The mould may comprise a first part comprising internal formations for producing the formations associated with the roll facing side of the end plug, and a second part comprising internal formations for producing the formations associated with the dispenser facing side of the end plug. The formations associated with the roll facing side comprise the formations insertable into the opening in an end of a roll. The formations associated with the dispenser facing side comprise the formations for cooperating with formations of a holder portion of a dispenser. The internal formations associated with the first and second mould parts are complimentary to the formations to be produced on the respective sides of the end plug. The mould may be a two piece mould. Thus the mould parts may be mould halves. The mould may be transformable between open and closed configurations. Thus, the mould parts may be movable relative to one another to transform the mould between open and closed configurations.

A cavity is defined between the mould parts when the mould is in a closed configuration. The slurry is introduced into this cavity. The minimum dimensions of the cavity during the moulding process will determine the wall thickness of the resulting moulded end plug. It will be appreciated that the mould parts may be movable relative to one another after introduction of the slurry into the mould while the mould is in a closed configuration. This may reduce the dimensions of the cavity defined between the mould parts. Pressing the mould parts together may help to cause the slurry to fill all parts of the mould cavity. For example, one mould part may be pressed against the other. The separation of the mould parts may be progressively decreased, or decreased in a step at a given point e.g. after some initial evaporation of liquid from the slurry has occurred. In this case, the wall thickness will be determined by the minimum dimensions of the cavity attained during the moulding process. In other embodiments, the mould parts may have a fixed separation when the mould is in a closed configuration.

The method may comprise ejecting the moulded fibrous end plug from the mould once heating in the mould is complete. The ejection may occur upon opening of the mould. The moulded fibrous end plug advantageously does not undergo any further heating step. In embodiments only a single mould is used during manufacture of the moulded fibrous end plug.

The mould may be of any suitable material. In a preferred embodiment the mould is a metal mould, such as an aluminium mould. This enables the mould to withstand the high temperatures which are advantageously used to heat (e.g. bake) the slurry in the mould to obtain the final end plug. The mould may comprise a plurality of openings to enable liquid and/or vapour to move out of the mould e.g. during evaporation of liquid from the slurry.

The method preferably comprises heating the slurry in the mould to provide the moulded fibrous end plug. The heating step dries the moulded fibrous end plug to a final dryness in the mould. The heating step dewaters and bakes the slurry to provide the moulded fibrous end plug. Preferably the method comprises heating the slurry to a temperature of at least 100 degrees Celsius, and optionally at least 150 degrees Celsius, or at least 180 degrees Celsius, or at least 200 degrees Celsius. The slurry may be heated to a temperature of less than 300 degrees Celsius, or less than 250 degrees Celsius, or less than 220 degrees Celsius. In some exemplary embodiments the slurry is heated to a temperature of around 400 degrees Fahrenheit (204 degrees Celsius). The duration of the heating may be selected as desired, and may depend upon factors such as the viscosity of the slurry, proportion of binder used, the nature of the components of the slurry, and the shape of the moulded end plug to be produced.

The method may then comprise removing the moulded fibrous end plug from the mould.

This may involve opening the mould to eject the moulded fibrous end plug.

Thus, in these preferred embodiments, the final moulded fibrous end plug is produced from the slurry of fibers, binder and water using a single mould, in which the slurry is heated. This is in contrast to some pulp moulding techniques in which a first mould is used to dewater an initial fibrous slurry, with the dewatered moulded material being transferred to a second mould for drying to produce the final moulded article. It has been found that methods using the single mould may be advantageous in providing a moulded fibrous end plug with improved precision in shape and may enable a denser material to be obtained.

References herein to the roll facing side of the end plug or the dispenser facing side of the end plug comprising "formations" (e.g. formations configured to be insertable into an opening in an end of a roll of sheet material, formations for securing the end plug to the roll of sheet material, formations configured to cooperate with formations of a roll holder portion of a dispenser in use for mounting the end plug to the dispenser etc.) should be understood to encompass the roll facing side or dispenser facing side comprising a set of one or more, and optionally a plurality of such formations. Thus, the roll facing side of the end plug comprises a set of one or more formations configured to be insertable into an opening in an end of a roll of sheet material and including a set of one or more formations for securing the end plug to the roll of sheet material, and optionally comprises a plurality of formations configured to be insertable into the opening including a plurality of formations for securing the end plug to the roll of sheet material. The dispenser facing side of the end plug comprises a set of one or more, and optionally a plurality of formations which are configured to cooperate with formations of a roll holder portion to mount the end plug thereto. Thus, the dispenser facing side of the end plug comprises a set of one or more formations configured to cooperate with formations of a roll holder portion of a dispenser in use for mounting the end plug to the dispenser, and optionally comprises a plurality of formations configured to function in this manner.

Any of the structures defined by the roll facing or dispenser facing side of the end plug or the roll holder portion of a dispenser may be defined by one or more formations of the respective side of the end plug or roll holder portion, unless the context demands otherwise. It will be appreciated that any of the further aspects of the invention may include any or all of the features of the invention described in relation to any other aspects and embodiments of the invention to the extent they are not mutually inconsistent therewith. In particular, it will be appreciated that the invention in the second and further aspects may comprise any or all of the features described in respect of the method of the first aspect of the invention, and vice versa. Various features of embodiments of the invention will be described in further detail below.

BRIEF DESCRIPTION OF THE DRAWINGS

Various embodiments will now be described, by way of example only, and with reference to the accompanying drawings in which:

FIG. 1 illustrates one exemplary embodiment of a dispenser with which the end plugs described herein may be used. This dispenser is merely used as an example to illustrate how a roll holder portion may cooperate with the end plug to mount a roll to a dispenser. It will be appreciated that other dispenser types may be used. The configuration of the roll holder portion of the dispenser, and its relationship to other dispenser parts e.g. the configuration of any dispenser arms, may vary from that shown. Furthermore, while the invention will be exemplified in relation to a roll holder portion which is not rotatable relative to the dispenser arm, in other embodiments, the end plug may, as previously described, fixedly mount the roll to a roll holder portion, which is rotatable relative to another part of the dispenser. For example, the roll holder portion may be in the form of a rotatable hub.

The dispenser illustrated is a wall mounted dispenser, as may be found, for example in a washroom or other hand washing facility. However, end plugs may be used with other types of dispenser. The dispenser may be an electronic hands-free dispenser, although this is not necessarily the case.

Figure 1:
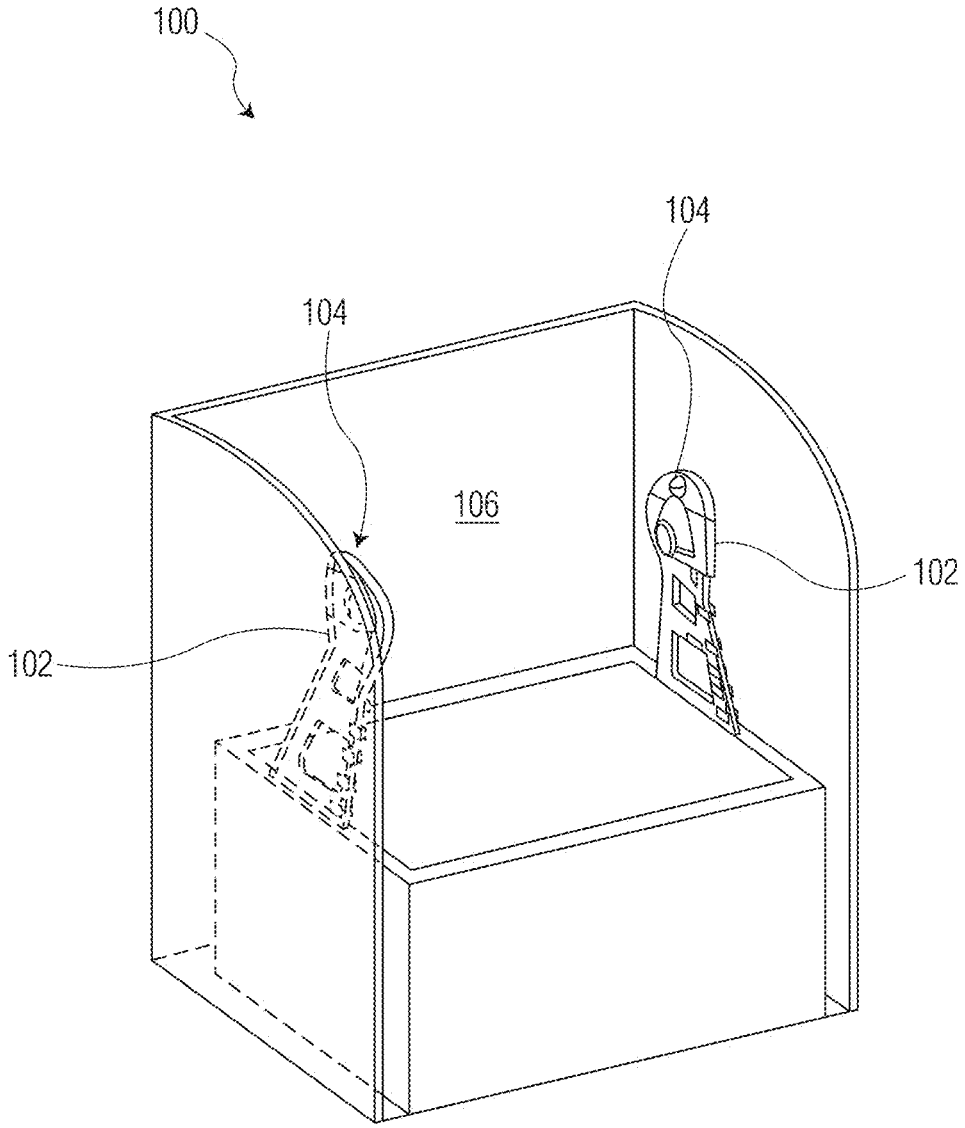
FIG. 1 illustrates one exemplary embodiment of a dispenser with which the end plugs described herein may be used.

Returning now to the exemplary arrangement of FIG. 1, which is in accordance with WO 2012/073203A2 (corresponding to US2012138723A1), the dispenser 100 includes a pair of dispenser arms 102, each having a roll holder portion 104 at the distal end thereof. A roll receiving space 106 is defined between the arms 102. The dispenser arms 102 are able to resiliently deflect outwardly relative to one another during insertion or removal of a roll, being biased to return to their original, closer position.

The roll holder portions of a dispenser with which an end plug of the present invention is used may be of the configuration illustrated in FIG. 1, or indeed any of the configurations described in WO 2012/073203A2 above, or indeed, any other desired configuration.

In use the end plug (already inserted in the end of a roll) is pushed on to the front face of the roll holder portion to mount the end plug, and hence the roll thereto.

The general principles of providing a mounting between an end plug and roll holder portion using cooperating formations on the dispenser facing side of the end plug and the roll holder portion of the dispenser are described in WO 2012/073203A2.

Figure 2:
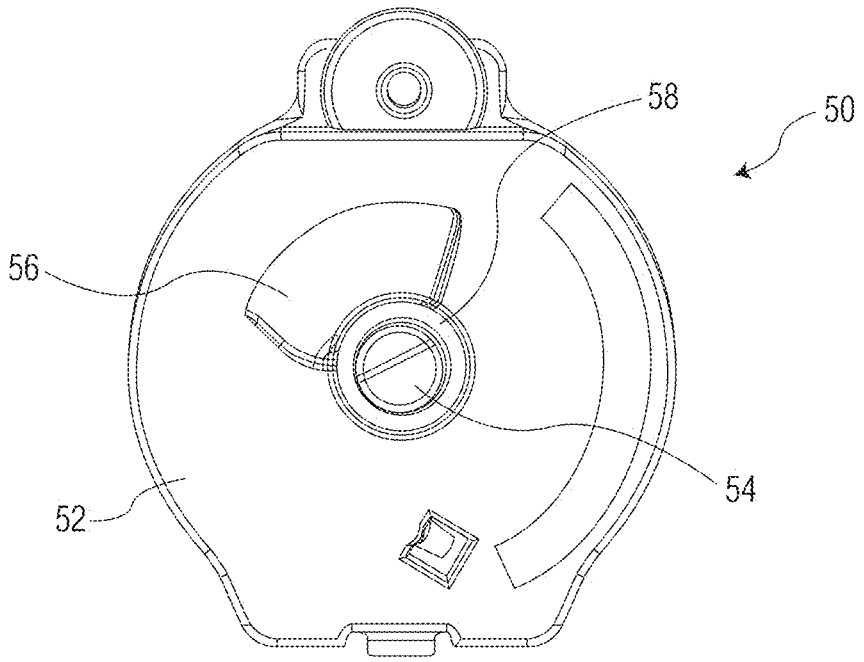
FIG. 2 is a front on view illustrating the front face of the roll holder portion which comprises formations which may cooperate with the formations of the dispenser facing side of an end plug in accordance with an embodiment of the invention to mount the end plug to the dispenser.

One alternative example of a roll holder portion 50 which may be used with end plugs in accordance with some exemplary embodiments of the invention is shown in FIG. 2.

Figure 3:
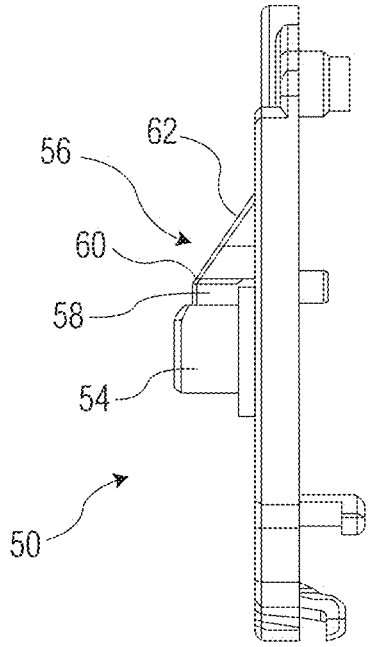
FIG. 3 is a side on view of the roll holder portion of the embodiment of FIG. 2.
Figure 4:
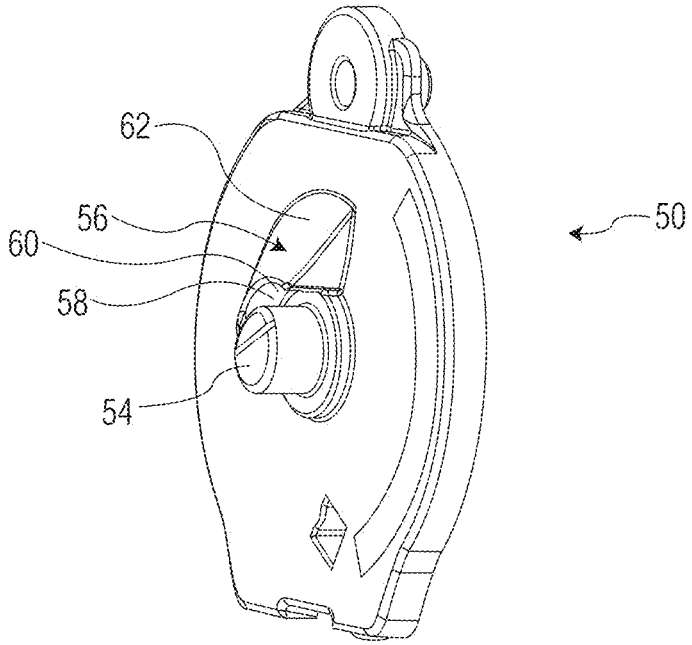
FIG. 4 is a perspective view of the roll holder portion of the embodiment of FIG. 2.

FIG. 2 is a front on view illustrating the front face of the roll holder portion which comprises formations which may cooperate with the formations of the dispenser facing side of an end plug in accordance with an embodiment of the invention to mount the end plug to the dispenser. In this example, the formations cooperate with one another to rotatably mount the end plug to the roll holder portion. FIG. 3 is a side on view of the roll holder portion of FIG. 2. FIG. 4 is a perspective view of the roll holder portion.

The roll holder portion 50 includes a base 52, defining a front face of the roll holder portion. A cylindrical projection 54 extends from the base 52. A circumferentially extending structure 56 partially surrounds the projection 54 so as to define an annular space 58 therebetween. The structure 56 defines a circumferentially extending wall 60 which defines the outer edge of the annular space 58. A ramp structure 62 extends from the top of the wall 60 to the base 52.

In this example, the roll holder portion 50 includes a male formation, the cylindrical projection 54. The formations of the dispenser facing side of the end plug may then comprise a female part for receiving the cylindrical projection. The cylindrical projection 54 and the female part of the dispenser facing side of the end plug are complimentary to one another. The formations of the dispenser facing side of the end plug are configured such that they may cooperate with the formations of the roll holder portion to mount the end plug to the roll holder portion. For example, the formations of the dispenser facing side may be configured such that a female part thereof may cooperate with the formations of the roll holder portion to enable the female part to receive the male part e.g. cylindrical projection. Thus, the female part may be configured such that it fits into the annular space 58 to mount the end plug to the dispenser. The formations of the dispenser facing side of the end plug should be such that they do not interfere with any of the formations of the roll holder portion i.e. the roll facing side thereof to prevent fitting together of the end plug and roll holder portion as required for providing a secure mounting, and, where applicable, to allow relative rotation between the end plug and roll holder portion.

Of course, the roll holder portion may differ from that shown, and the formations of the end plug should be configured as appropriate to enable the formations of the dispenser facing side of the end plug to cooperate with the formations of a particular roll holder portion with which the end plug is intended to be used. For example, rather than a single formation defining a cylindrical projection 54 of the roll holder portion, such a projection may formed by a plurality of formations. The cylindrical projection is then defined by a set of formations of the roll holder portion. This set of formations and a set of one or more formations of the dispenser facing side of the end plug (e.g. defining a cooperating female part thereof) may define ones of a pair of complimentary parts of the dispenser facing side of the end plug and the roll holder portion. The formations of the roll holder portion need not define a cylinder. For example, provided that an outer diameter corresponding to an outer circular boundary drawn around each of the formations defining the projection may snugly fit within the annular formation of the dispenser facing side of the end plug, the arrangement may operate in the same manner as the example of FIGS. 2-4. Likewise, an annular space may be defined surrounding the projection of the roll holder portion in a manner other than that shown e.g. by a plurality of formations surrounding the projection. The formations need not define a circumferentially extending structure. For example, a series of spoke-like formations extending radially on the face of the roll holder portion may be disposed with their proximal ends spaced from the outer edge of the projection to define an annular space. Similarly there may be more than one ramp portion.

An end plug may be used to ensure that a roll of sheet material is only used with a dispenser with which it is intended to be used e.g. to ensure optimum performance. For example, a dispenser, particularly although not necessarily an electronic dispenser, may be configured to operate most effectively with a particular type of sheet material (e.g. basis weight) and/or configuration of roll. This may ensure that the dispenser operates reliably without jamming, with greater energy efficiency if electronic, without risk of malfunction and/or safety risk etc. It will be seen from the above example, that the formations of the dispenser facing side of an end plug may be configured such that they will only allow the end plug to be mounted to a particular dispenser, having a roll holder portion with appropriate complimentary formations While the embodiment illustrated permits relative rotation between the end plug and roll holder portion, such that the end plug may rotate with a roll during dispensing, in alternative embodiments, the formations of the dispenser facing side of the end plug may cooperate to provide a keyed connection with the roll holder portion, such that the roll holder portion and end plug are maintained in a fixed rotational relationship. The roll holder portion may then be rotatably mounted to an adjacent portion of the dispenser to enable rotation of the roll and roll holder portion relative to another part of the dispenser during dispensing. For example, the keyed connection may be with a projecting sensor part of the roll holder portion. A recess on the dispenser facing surface of the end plug may cooperate with the sensor part to provide the keyed connection. The recess may, for example, be an opening in the end plug, or the reverse side of a dome of the end plug. The roll holder portion may then be rotatably mounted to an arm of the dispenser, such as via a mounting portion e.g. hub fixed to the distal end of the arm. In such embodiments the roll holder portion is rotatable relative to the mounting portion. The mounting portion of the dispenser may comprise a further sensor part forming a sensor arrangement together with the sensor part of the roll holder portion. For example, the roll holder portion may comprise a magnet, providing a "target" of a sensor arrangement for sensing rotation e.g. counting a number of rotations of the roll holder portion relative to the dispenser arm. The mounting portion may comprise a probe part of the sensor arrangement, which detects the proximity of the magnet as it moves past the probe on rotation of the roll holder portion.

Figure 5:
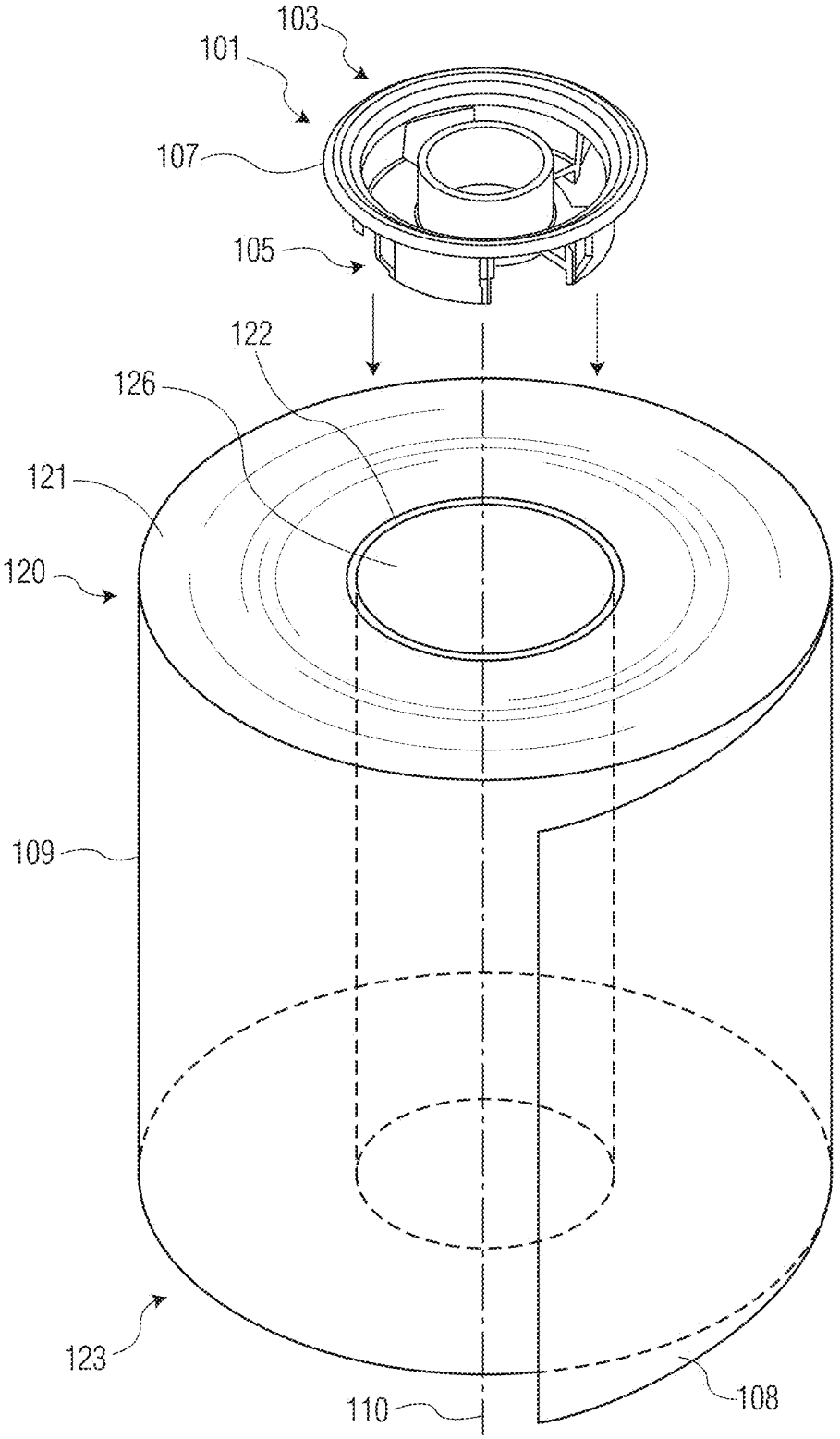
FIG. 5 illustrates the way in which the roll facing side of an end plug may be used to mount an end plug to a roll 120.

FIG. 5 illustrates the way in which the roll facing side of an end plug may be used to mount an end plug to a roll 120. The Figure illustrates one exemplary embodiment of a roll with which the end plug may be used. This Figure, which is in accordance with WO 2012/073203A2, is merely exemplary in general of the way in which an end plug is used. The end plug 101 includes a roll facing side 105 having formations which are insertable into an opening in an end of a roll of sheet material to secure the end plug to the roll, and a dispenser facing side 103 having formations which cooperate with a roll holder portion of a dispenser to mount the end plug thereto. The formations associated with the roll facing and dispenser facing sides 105, 103 of an end plug in accordance with the invention, which is made from a moulded fibrous material, may differ from those shown in FIG. 5, which illustrates a plastic end plug 101. Examples of such differences are discussed below in relation to certain exemplary embodiments. However, the principles of operation of the end plug will be the same. The roll is a roll of sheet material 108, such as paper towel. However, the sheet material may be of any other type of web material which is suitable for dispensing from a roll. For example, the roll may be a roll of paper material, e.g. for use in providing a hand towel, facial tissue, toilet tissue, or a nonwoven material, e.g. for use in providing a wiper etc. The sheet material may or may not include perforations. The roll dispenses sheet material from the periphery 109 thereof, and is rotatably mounted to a dispenser such that the roll may be rotated to allow the dispensing of material in use.

The roll has ends 121, 123. The roll 120 includes a central bore 126 extending from one end to the other along a central axis 110 thereof. In the illustrated embodiment, the bore 126 is defined by the central bore of a core 122 of the roll. The core 122 may be of any suitable material, such as cardboard, paperboard etc. For example, it may be spirally wound core. However, it will be appreciated that the end plugs described herein are not limited to use in the context of a cored roll, and may be used with any roll having an opening in an end thereof into which the formations of the roll facing side 105 may be inserted. For example, a coreless roll may include openings in the form of indentations extending only a small distance along the axis thereof at each end into which the formations of the roll facing side 105 can be inserted, or may similarly have a central bore, extending from one end to the other. Where the end plug is used with a cored roll, it may be referred to as a "core plug".

The end plug 101 is inserted into the opening provided by the end of the bore 126 at the end 121 of the roll with the roll facing side 105 leading as schematically shown in FIG. 5. The formations of the roll facing side which extend from the base 107, are inserted into the end of the bore 126 at the end 121 of the roll. The formations include formations which cooperate with the periphery of the bore 126, provided by the radially inner surface of the core 122 in this case, to provide an interference fit between the end plug 101 and the roll 120.

The end plug 101 may be mounted into the roll by pushing the end plug into the end of the bore 126 after manufacture of the roll, as part of a manufacturing process to provide a refill product comprising the roll with the end plugs fitted, which can be supplied to the user. Thus, in such arrangements, the end plugs are inserted by machine. The roll may be packaged with end plugs inserted in both ends for supply to a user.

While the insertion of the end plug has been illustrated by reference to the end 121 of the roll, it will be appreciated that another end plug of identical construction will be inserted into the opposite end 123 of the roll, in this case cooperating with the opposite end of the central bore 126. While the invention has been illustrated by reference to the case in which a roll includes end plugs at both ends, depending upon the configuration of a dispenser with which it is intended to be used, it is envisaged that an end plug might only be inserted into an opening at one end of a roll to mount the roll to a dispenser.

Certain embodiments of end plugs having a configuration which is particularly advantageous in the context of the use of a moulded fibrous material will now be described. It will be understood, however, that the provision of a moulded fibrous end plug is advantageous per se e.g. in comparison to the plastic end plugs described in WO 2012/073203A2, and the invention is not limited to the use of structures of the type described below.

Figure 6:
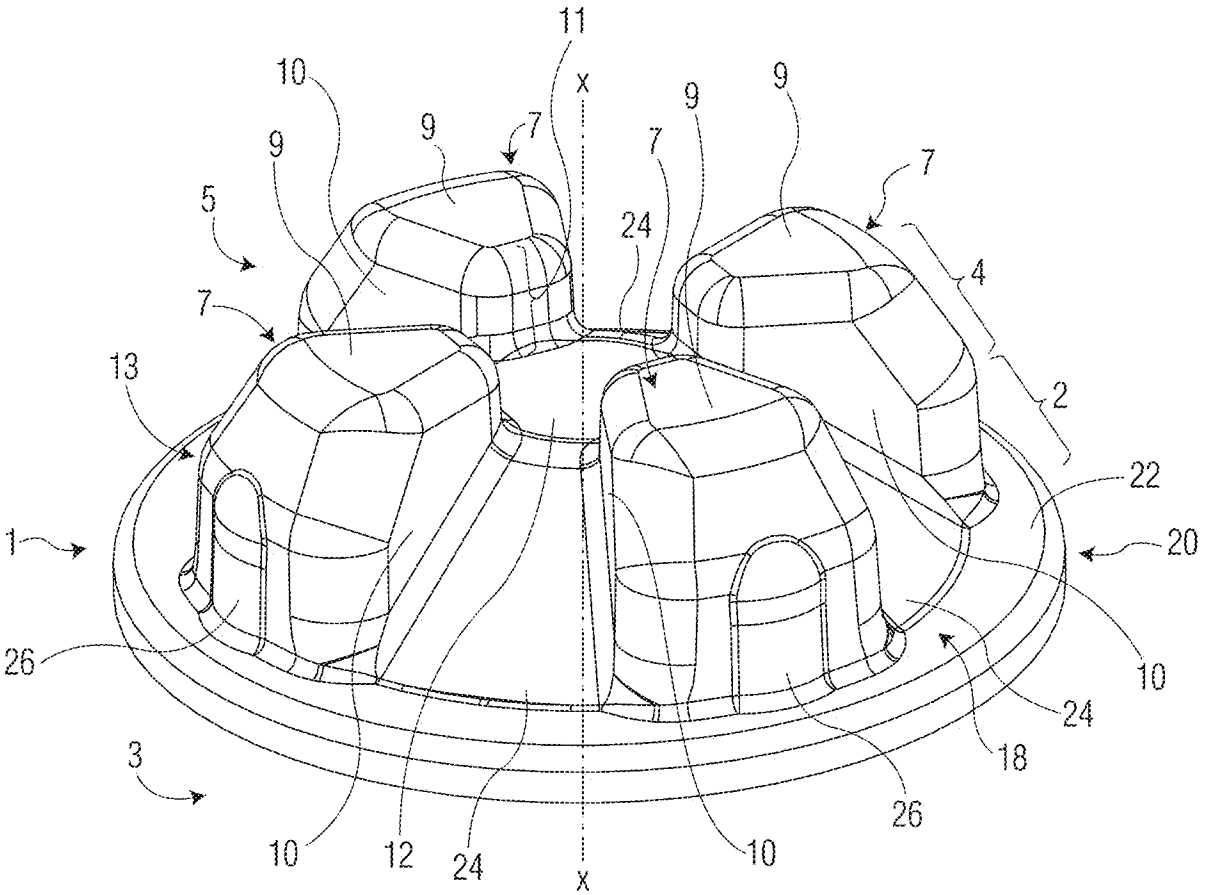
FIG. 6 illustrates a moulded fibrous end plug for a dispenser system in accordance with a first embodiment of the invention from the roll facing side.

FIG. 6 illustrates a moulded fibrous end plug 1 for a dispenser system in accordance with a first embodiment of the invention from the roll facing side.

The end plug 1 has a roll facing side 5, which is uppermost in FIG. 6, and a dispenser facing side 3, which is lowermost. The features of the roll facing side may be seen more clearly in FIG. 7, which is a view from above from the dispenser facing side. FIG. 8 illustrates the end plug of FIGS. 6 and 7 from one side, with the roll facing side uppermost as in FIG. 6.

The features of the end plug 1 will now be described by reference to FIGS. 6-8. The roll facing side 5 of the end plug 1 includes formations configured to be inserted into an opening in the end of a roll of sheet material in use in order to secure the roll cap 1 to the roll. The formations provide an interference fit to the outer periphery of the opening.

As seen in FIG. 6, the roll facing side 5 includes four domes 7. The domes 7 are of identical construction, and the features of each dome will be described by reference to one of the domes. It will be appreciated that it is not necessary for the end plug to include 4 domes. For example, the number of domes may be in the range of from 2-6 domes, such as from 3-5 domes.

The domes 7 surround a central portion 12 of the roll facing side of the end plug. The central portion 12 is centred about the axis X-X of the end plug 1. The central portion 12 may be substantially circular.

Each dome 7 includes a planar top surface 9, an inner wall 11 and an outer wall 13. The inner and outer walls 11, 13 and radially inner and outer walls with respect to a central axis X-X of the end plug. Each dome includes a base portion 2 and an upper portion 4. The outer wall 13 includes a first portion 15 in the base portion of the dome and a second, sloping portion 17 in the upper portion of the dome. The sloping portion 17 is inclined with respect to the base portion 15. The angle θ defined between the sloping portion 17 and the first portion 15 of the outer wall 13 may be selected as desired. For example, the angle θ may be in the range of from 20 to 40 degrees, and in some exemplary embodiments is 30 degrees.

The end plug includes a peripheral flange 20. The domes 7 are upstanding from a base 18 of the roll facing side of the end plug. The base 18 is defined by a roll facing surface 22 of the peripheral flange 20.

The first portion 15 of the outer wall 13 of the dome is upstanding from the base 18 and may extend substantially perpendicular to the base 18. A smooth transition region from the base to the bottom of the outer wall 13 may be disregarded in determining the orientation of the first portion 15 of the outer wall relative to the base 18.

The inner wall 11 of the dome extends between the top surface 9 of the dome and the central portion 12 of the end plug 1. The central portion 12 is located at a level between a level of the tops 9 of the domes 7 and the base 18 of the end plug. The top surfaces 9 of the domes, the central portion 12, and the base 18 all lie in different planes.

The domes further comprise sidewalls 10 connecting the inner and outer walls 11, 13 thereof.

Connecting portions 24 separate the domes from one another. Each connecting portion 24 extends between the central portion 12 of the roll facing side of the end plug and the base 18 thereof. Each connecting portion includes a sloping portion defining a sloping surface 37 on the roll facing side of the end plug, and, in the embodiment of FIG. 6 is a sloping connecting portion. In the embodiment illustrated in FIG. 6, the connecting portion slopes over the entire length thereof. It will be appreciated that the connecting portions may be of differing configuration to that shown in the embodiment of FIGS. 6-8. For example, they may comprise an upper sloping portion and a lower portion upstanding from e.g. substantially perpendicular to the base, or may include multiple panels in a circumferential direction at different orientations to one another, or may include an opening therein etc. While the sloping portions define a planar sloping surface 37 in the embodiment shown, other embodiments are possible e.g. exhibiting a curvature.

The domes are of a contoured shape as shown, and may include smooth transition regions between the walls thereof. Each wall may be made up of multiple portions, which may define a smooth transition or an inflection point therebetween. Any portion of a wall may be planar, or may be curved. The embodiment of FIG. 6 is only one possible example of a shape of the domes.

Figure 7:
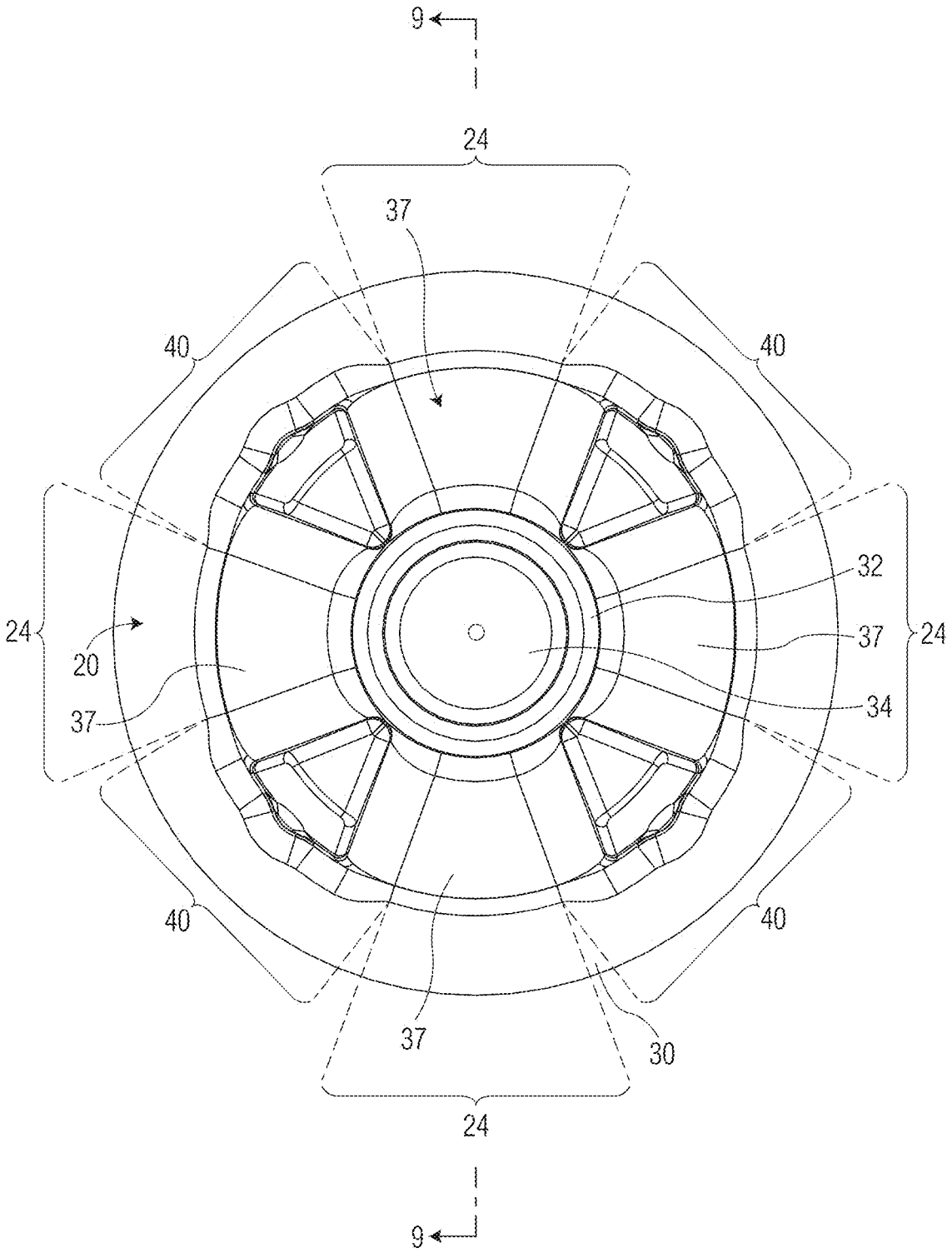
FIG. 7 is a view from above of the moulded fibrous end plug of FIG. 6 from the dispenser facing side.
Figure 8:
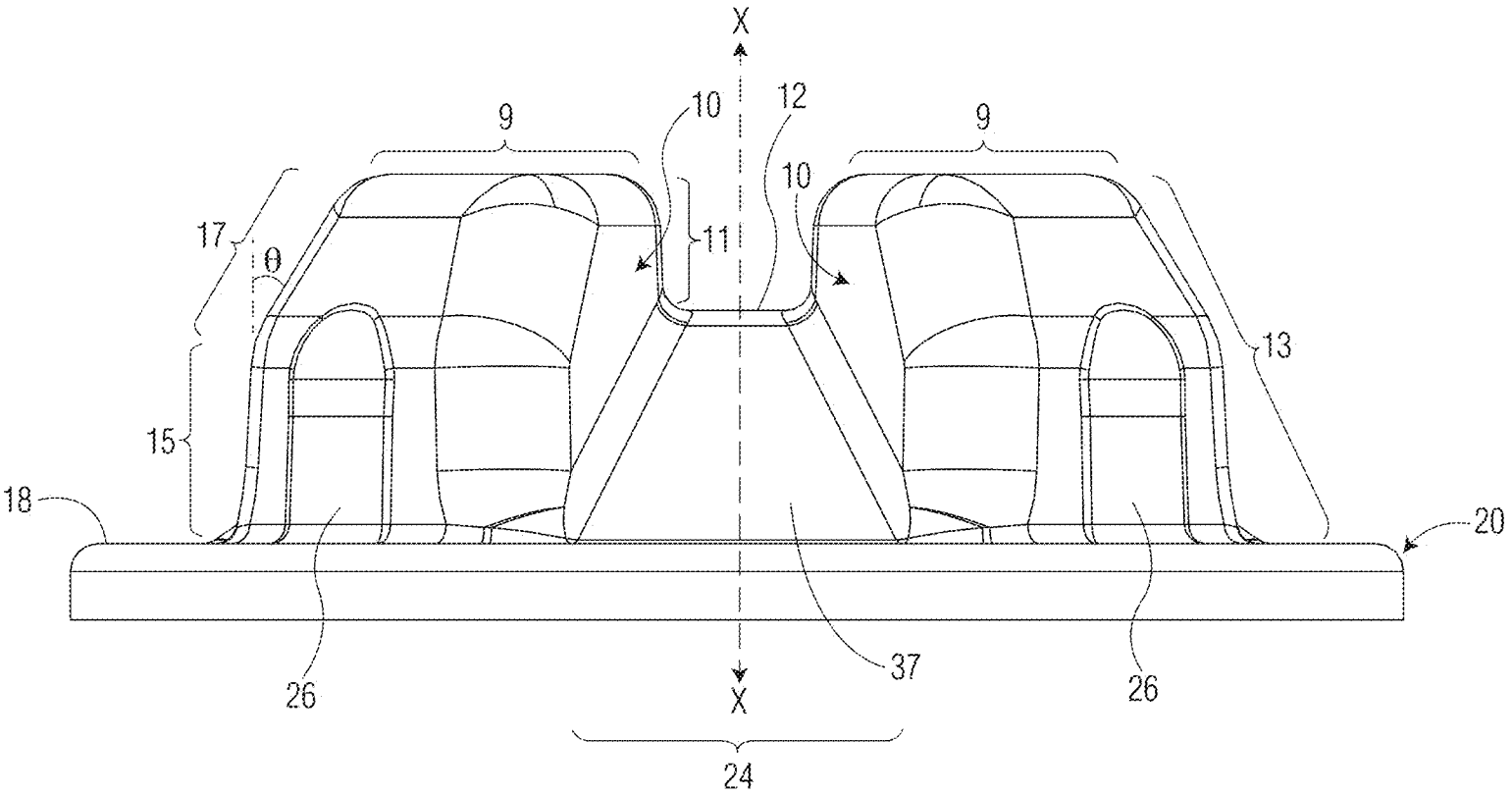
FIG. 8 illustrates the end plug of FIGS. 6 and 7 from one side, with the roll facing side uppermost as in FIG. 6.

The configuration and/or relative spacing of the domes may differ from that shown in the embodiment of FIGS. 6-8. For example, the domes may be more or less closely spaced, and need not necessarily have a planar top surface. The inclination of the outer wall may differ from that shown e.g. to include curved portions, or more than inflection point etc.

The outer walls 13 of the domes 7 include protuberances 26. One protuberance 26 is provided per dome, and is used in providing an interference fit to the periphery of an opening in an end of a roll of sheet material in use. The protuberances 26 are discrete protuberances. Each protuberance 26 is able to resiliently deflect in order to provide such an interference fit. The protuberance projects radially from the radially outer wall of the dome for engaging the periphery of an opening of a roll in use. As shown in FIGS. 6-8, the protuberances have a height that is at least as great as the height of the base portion 15 of the outer wall, and may extend through a transition between the base and upper regions (2, 4/15, 17) of the wall 13.

The number, configuration and/or position of the protuberances may differ from that shown. For example, the protuberances may be of lesser height, need not be provided in respect of each dome, and/or may be provided associated with the connecting portions 24 rather than the domes. From 2-6 protuberances may be provided in some exemplary arrangements. Where the protuberances are associated with the domes, the domes may help to support the protuberances and assist in obtaining a secure connection to the roll.

Figure 9:
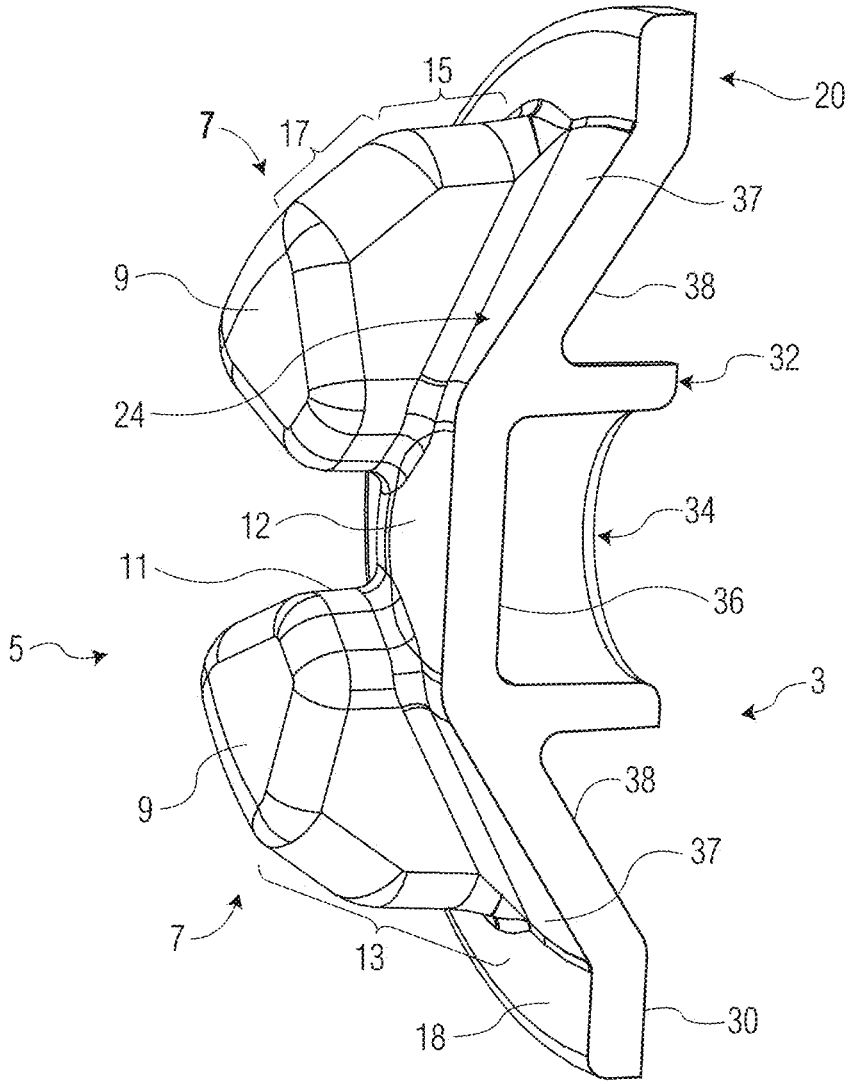
FIG. 9 is a section through the end plug of the embodiment of FIGS. 6-8 along the line 9-9 shown in FIG. 7, illustrating both the roll facing and dispenser facing sides thereof.

The domes, connecting portions and all formations located inboard of the flange 18 are inserted into the opening in an end of a roll in use to secure the end plug to the roll. The flange 18 will be pressed against the material defining the end of the roll and surrounding the opening. The features of the dispenser facing side 3 of the end plug 1 will now be described by reference to FIGS. 7 and 9. FIG. 9 is a section through the end plug along the line 9-9 shown in FIG. 7, illustrating both the roll facing and dispenser facing sides thereof.

The peripheral flange 20 defines a dispenser facing surface 30. This lies in a plane defining a front face of the dispenser facing side 3 (which may also be taken to define a base of the dispenser facing side).

The roll facing side includes an annular formation 32, which is shown as a cylinder. The annular formation 32 includes a central bore 34, coaxial with the central axis X-X of the end plug. The central bore 34 is closed at the distal end thereof i.e. the end closer to the interior of the end plug. The closed end 36 of the bore is provided by a dispenser facing surface of a portion of the end plug wall whose roll facing surface provides the central region 12 of the roll facing side. In other words, the closed end of the bore is corresponds to the dispenser facing surface of the central portion 12.

The annular formation 32 is configured to receive a projection of a roll holder portion of a dispenser in use to mount the end plug to the roll holder portion as will be described in more detail below.

The dispenser facing side further comprises sloping surfaces 38 provided by the dispenser facing surface of the portions of the end plug wall whose roll facing surface provides the sloping surfaces 37 of the connecting portions 24 of the roll facing side. The sloping surfaces 38 are configured to engage a ramp structure of the roll holder portion when the end plug is mounted thereto in use as will be described in more detail below.

As may be seen more clearly by reference to FIG. 7, the domes 7 create corresponding recesses 40 on the dispenser facing side 3.

The end plug illustrated in FIGS. 6-9 may be used with a dispenser as shown in FIG. 1, or FIGS. 2-4. These merely illustrates some embodiments of a dispenser with which the end plugs described herein may be used. It will be appreciated that other dispenser types may be used.

The way in which the formations of the dispenser facing side of the end plug of the embodiment of FIGS. 6-9 may cooperate with the formations of a roll holder portion of a dispenser as shown in FIGS. 2-4 to mount the end plug thereto will now be described.

Figure 10:
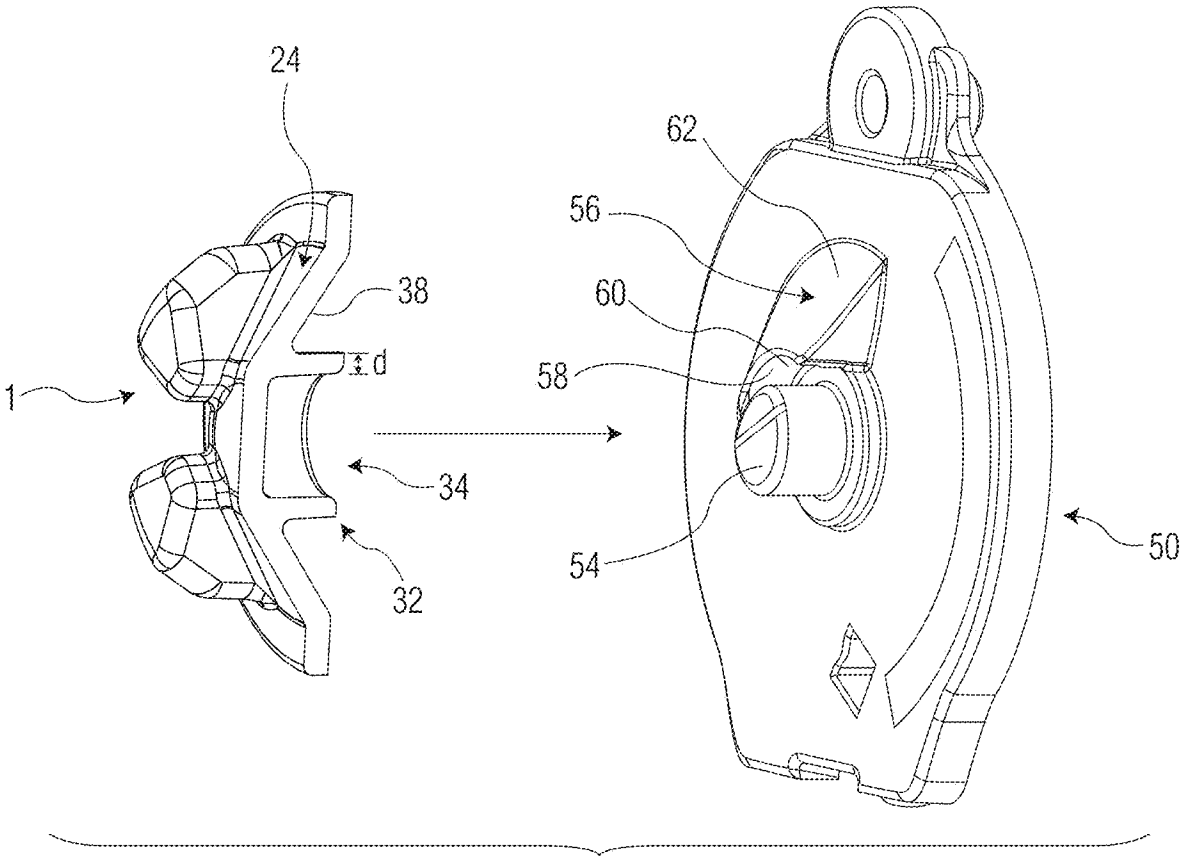
FIG. 10 is an exploded view showing how the end plug 1 may be moved in the direction of the arrow to engage the roll holder portion of a dispenser in accordance with FIGS. 2-4, and illustrating the cooperating features in more detail.
Figure 11:
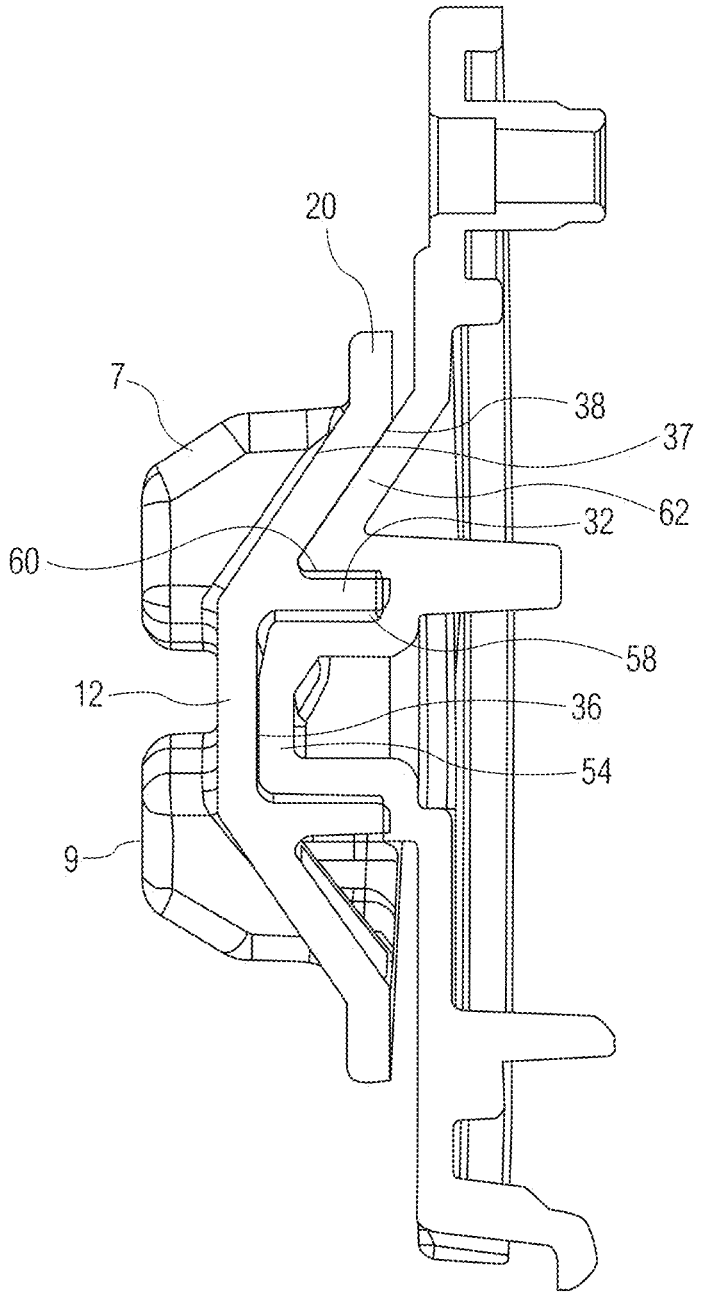
FIG. 11 is a cross sectional view which illustrates the end plug of FIGS. 6-10 once mounted to the roll holder portion.

FIG. 10 is an exploded view showing how the end plug 1 may be moved in the direction of the arrow to engage the roll holder portion, and illustrating the cooperating features in more detail. FIG. 11 is a cross sectional view which illustrates the end plug once mounted to the roll holder portion.

The width d of the wall of the annular formation 32 of the dispenser facing side of the end plug is such that it may be inserted into the annular space 58 to rotatably mount the end plug to the roll holder portion. The projection 54 is received in the annular formation 32. Thus, the bore 34 within annular formation 32 has a diameter to enable it to snugly receive the projection 54. The annular formation and projection thus define complimentary parts which mate with one another. The inclination of the sloping surfaces 38 of the dispenser facing surface is such that the surfaces may engage against the ramp 63 as the end plug rotates relative to the roll holder portion while permitting the annular formation 32 to be fully inserted into the annular space 58. It is not necessary for formations of the dispenser facing side of the end plug to necessarily engage a ramp, where provided, as long as the formations of the dispenser facing side are suitably configured so as not to interfere with the ability to properly fit the end plug onto the roll holder portion to obtain a secure mounting thereto, whether or not this is a rotatable mounting. Further, it will be appreciated that a ramp need not be used, but may be desirable in some cases to facilitate loading of a roll by a user. A suitable annular space similar to annular space 58 may similarly be defined where no ramp is used.

As mentioned above, the configuration of the roll holder portion may differ from that shown. The dispenser facing side of the end plug should be suitable configured to cooperate with the formations of a roll holder portion of a dispenser with which the end plug is intended to be used.

An end plug may be used to ensure that a roll of sheet material is only used with a dispenser with which it is intended to be used e.g. to ensure optimum performance. For example, a dispenser, particularly although not necessarily an electronic dispenser, may be configured to operate most effectively with a particular type of sheet material (e.g. basis weight) and/or configuration of roll. This may ensure that the dispenser operates reliably without jamming, with greater energy efficiency if electronic, without risk of malfunction and/or safety risk etc. It will be seen from the above example, that the formations of the roll holder portion of a dispenser may be configured in a particular manner such that they will only allow the correct end plug, with appropriate formations which may cooperate with those features, to be mounted thereto. The end plug and roll holder portion should cooperate with one another to enable any complimentary formations to fit together as intended, and to not interfere with the intended mounting of the end plug to the roll holder portion. This may be ensured by controlling the dimensions of the cooperating formations appropriately e.g. the wall of the annular formation of the end plug must have a thickness enabling it to provide a snug fit to the projection of the roll holding portion, but such that it may still fit and rotate within the annular space provided on the roll holder portion face. Similarly, as discussed below, a sloping formation of an end plug must not interfere with any ramp structure of the roll holder portion so as to prevent the projection from being properly received in the annular formation of the end plug to provide a secure mounting.

Figure 20:
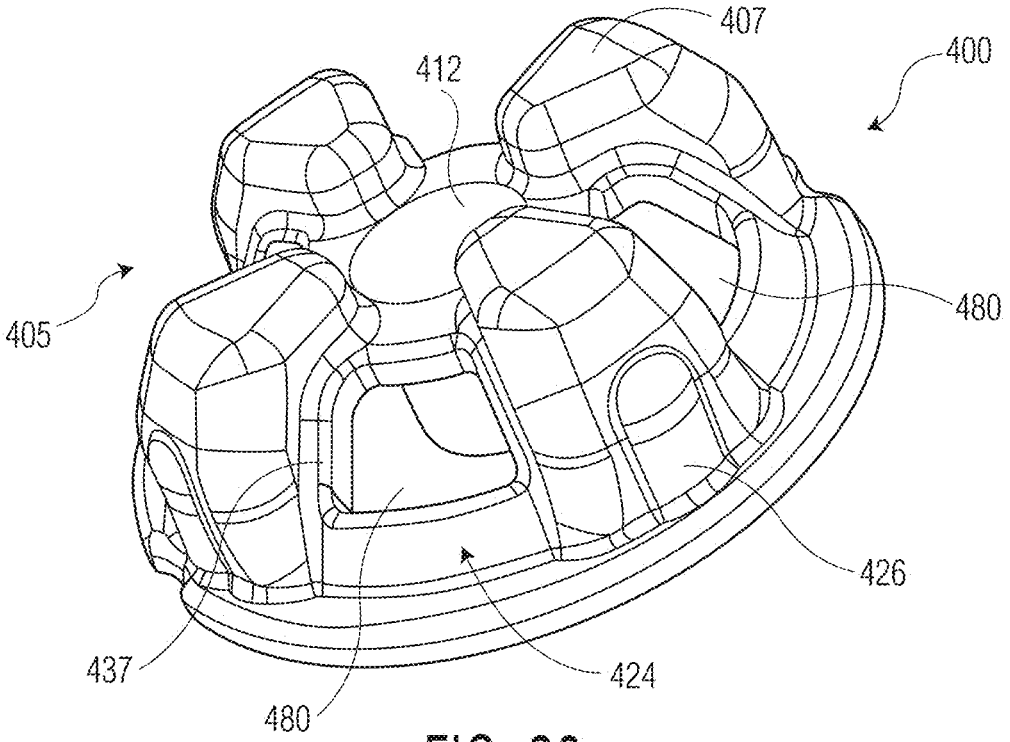
FIG. 20 is a perspective view from above from the roll facing surface of a moulded fibrous end plug in accordance with a yet further embodiment of the invention.
Figure 21:
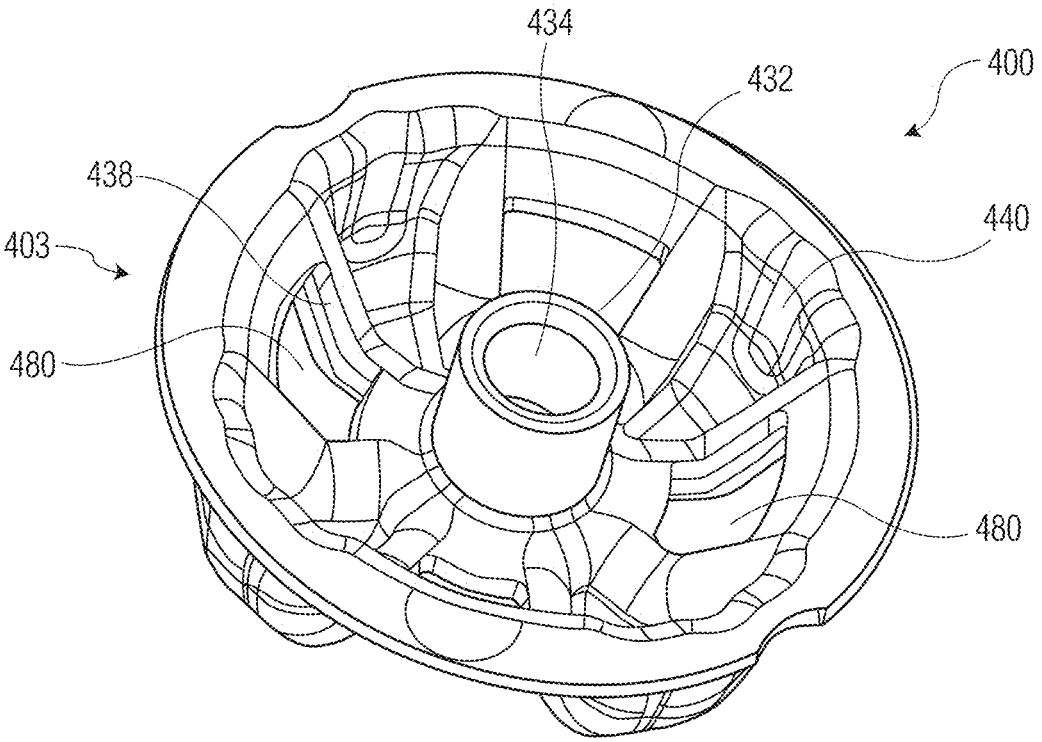
FIG. 21 is a view from above of the dispenser facing surface of the end plug of FIG. 20.

While the cooperation between the moulded fibrous end plug and the roll holder portion of a dispenser has been exemplified in relation to the case in which relative rotation is permitted between the end plug and roll holder portion, such that the end plug may rotate with a roll relative to the roll holder portion during dispensing, in alternative embodiments, the formations of the dispenser facing side of the end plug may cooperate with the formations of a roll holder portion to provide a keyed connection with the roll holder portion, such that the roll holder portion and end plug are maintained in a fixed rotational relationship. The roll holder portion may then be rotatably mounted to an adjacent portion of the dispenser to enable rotation of the roll and roll holder portion relative to another part of the dispenser during dispensing. For example, the roll holder portion may be rotatably mounted to a dispenser arm via a mounting portion e.g. hub fixed to the dispenser arm, with the roll holder portion rotating relative to the mounting portion. Depending upon the configuration of the roll holder portion, some modification to the moulded fibrous end plug may be required in order to provide a keyed connection. FIGS. 20 and 21 illustrate an exemplary embodiment of a moulded fibrous end plug which may provide a keyed connection to a dispenser roll holder portion.

The moulded fibrous end plug in accordance with the invention, as illustrated by reference to the exemplary embodiment of FIGS. 6-11 may be mounted to a roll in the manner described by reference to FIG. 5. Although FIG. 5 does not illustrate a moulded fibrous end plug in accordance with the invention, the principle of operation is the same.

The end plug 1 is inserted into the opening provided by the end of the bore 126 at the end 121 of the roll with the roll facing side 5 leading. The formations of the roll facing side which extend from the base 22, including the domes 7 are inserted into the end of the bore 126 at the end 121 of the roll. The protuberances 26 cooperate with the periphery of the bore 126, provided by the radially inner surface of the core 122 in this case, to provide an interference fit between the end plug 1 and the roll 120.

The end plug 1 may be mounted into the roll by pushing the end plug into the end of the bore 126 after manufacture of the roll, as part of a manufacturing process to provide a refill product comprising the roll with the end plugs fitted, which can be supplied to the user. Thus, in such arrangements, the end plugs are inserted by machine. The roll may be packaged with end plugs inserted in both ends for supply to a user.

While the insertion of the end plug has been illustrated by reference to the end 121 of the roll, it will be appreciated that another end plug of identical construction will be inserted into the opposite end 123 of the roll, in this case cooperating with the opposite end of the central bore 126. While the invention has been illustrated by reference to the case in which a roll includes end plugs at both ends, depending upon the configuration of a dispenser with which it is intended to be used, it is envisaged that an end plug might only be inserted into an opening at one end of a roll to mount the roll to a dispenser.

The use of the end plug 1 will now be described.

An end plug 1 as described by reference to FIGS. 6-11 is inserted into an opening at one end of a roll of sheet material to be mounted to a dispenser, in the same manner described by reference to FIG. 5. Typically another such end plug is also inserted into an opening at the other end of the roll of sheet material. This may be performed during manufacture of a refill roll product. The formations of the roll facing side of the end plug provide a secure interference fit to the roll. The roll and its end plug(s) provides a single unit for (re) filling a dispenser. The user may remove any outer packaging from the roll refill product before fitting the roll to a dispenser. The dispenser may be, but need not be of the type exemplified in FIG. 1 or 2-4.

In order to fit the roll to a dispenser, the user first removes any depleted roll along with its end plugs from the dispenser. The user then pushes the dispenser facing side of the end plug at one end of the roll onto the roll holder portion of a dispenser, such as described by reference to FIG. 1 or 2-4.

In the case of a dispenser of the type shown in FIG. 1, the dispenser arm 102 deflects outwardly to enable the roll to be pushed onto the roll holder portion. The formations associated with the dispenser facing side 3 cooperate with the formations of the roll holder portion 104 to mount the end plug, and hence that end of the roll, to the dispenser arm, for example in the manner described in FIGS. 10 and 11. Where an end plug is associated with the other end of the roll, as may be the case for use with a dispenser of the type shown in FIG. 1, the formations of the dispenser facing side of the end plug at that end of the roll similarly cooperate with the formations of the roll holder portion of the other dispensing arm, to mount that end of the roll to the dispenser. The ends of the roll may be mounted sequentially or substantially simultaneously. In this way, the end plug(s) securely mount the ends of the roll to the dispenser, in the illustrated embodiment, to permit rotation between the roll and the roll holder portions of the dispenser.

In use, the end plugs remain securely in place in the ends of the roll during use of the dispenser, e.g. during rotation of the roll relative to the roll holder portion. Once the roll is depleted, the roll along with the end plugs may be removed from between the dispenser arms in a reverse of the initial installation procedure. Where the roll is cored roll, the remainder of the roll product will be the core with the end plugs inserted in its ends. The end plug may be configured such that it may not be removed from the roll without damage, such that it is intended to be disposed of once the roll is depleted, rather than being reused. The end plugs of the present invention are made of a fibrous moulded material, and may therefore be recycled along with the core in a paper recycling stream. This avoids problems associated with conventional plastic end plugs which would need to be removed from the core to enable appropriate recycling of the plastic end plugs and paper core in separate streams. Even if the roll is not a cored roll, the end plugs of the present invention may readily be recycled in a standard paper stream.

The end plugs of the present invention are advantageously biodegradable. This offers further sustainability advantages, whether or not the end plugs are recycled in a paper stream. For example, the end plugs may be composted, whether at home or industrially.

It is believed that the domed structure of the end plugs described herein is particularly advantageous in providing a sustainable fibrous end plug which may function reliably in the same manner as a plastic end plug. It will be appreciated that plastic materials may be of inherently higher strength than moulded fibrous materials as used in the embodiments described herein. It has been recognised that in order to provide corresponding levels of strength, it is advantageous to modify the shape of the end plug in comparison to the shape of an end plug formed from plastic, in particular on the roll facing side.

It has been found that the domed configuration may assist in providing a fibrous end plug which has advantageous strength properties enabling it to function reliably to retain the roll mounted to the dispenser even during the forces which may arise in use during dispensing e.g. where the end plug rotates relative to a roll holder portion of the dispenser. The domed construction may assist in maintaining the secure fit to the roll, and may also assist in supporting the formations of the dispenser facing side which cooperate with the formations of the roll holder portion e.g. an annular formation which receives a projection of the roll holder portion. The domes also provide overall structural integrity to the end plug. The construction may also assist in providing the end plug with the strength to maintain its integrity when pushed into a roll e.g. during manufacture of a roll refill product.

The domes impart the surface of the roll facing side with a pattern of alternating peaks and troughs. It is believed that these peaks and troughs may impart strength to the overall structure of the end plug.

Of course, the provision of a fibrous moulded end plug is, in itself, advantageous. Thus, the invention resides in general in the provision of such an end plug, and the domed construction illustrated in the exemplary embodiments is an advantageous feature, but need not necessarily be used.

FIGS. 12-16 illustrate a moulded fibrous end plug 200 in accordance with another embodiment of the invention.

Figure 12:
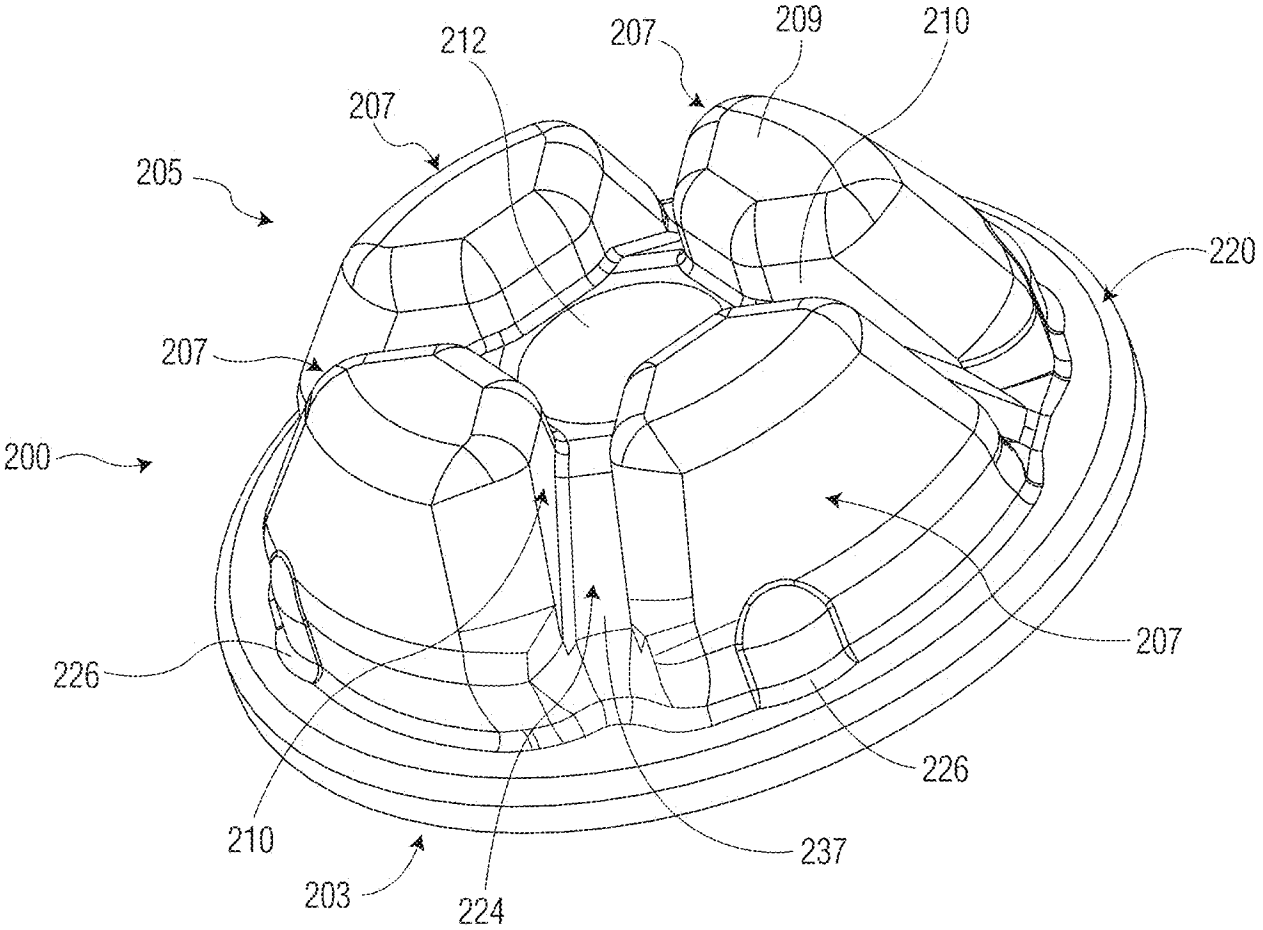
FIG. 12 illustrates a moulded fibrous end plug in accordance with another embodiment of the invention, being a perspective view of the end plug with the roll facing side uppermost.

FIG. 12 illustrates the end plug in a perspective view with the roll facing side uppermost.

The end plug 200 is similar to the end plug 1 previously described, and corresponding features are labelled incremented by 200. The end plug 200 is used in the same manner as the end plug 1. Only the significant differences will be described. As in the earlier embodiment, the roll facing side 205 includes four domes 207, with protuberances 226 and a peripheral flange 220. The domes have tops 209 and sidewalls 210. A central portion 212 is defined between the domes. This embodiment illustrates the different configurations the domes may have. In this embodiment, each dome extends around the central axis of the end plug by a greater angle than in the earlier embodiment of FIGS. 6-11, with the extent of the connecting portions 24 correspondingly reduced. As in the earlier embodiment, the connecting portions 224 include sloping portions defining sloping surfaces 237 on the roll facing side.

Figure 13:
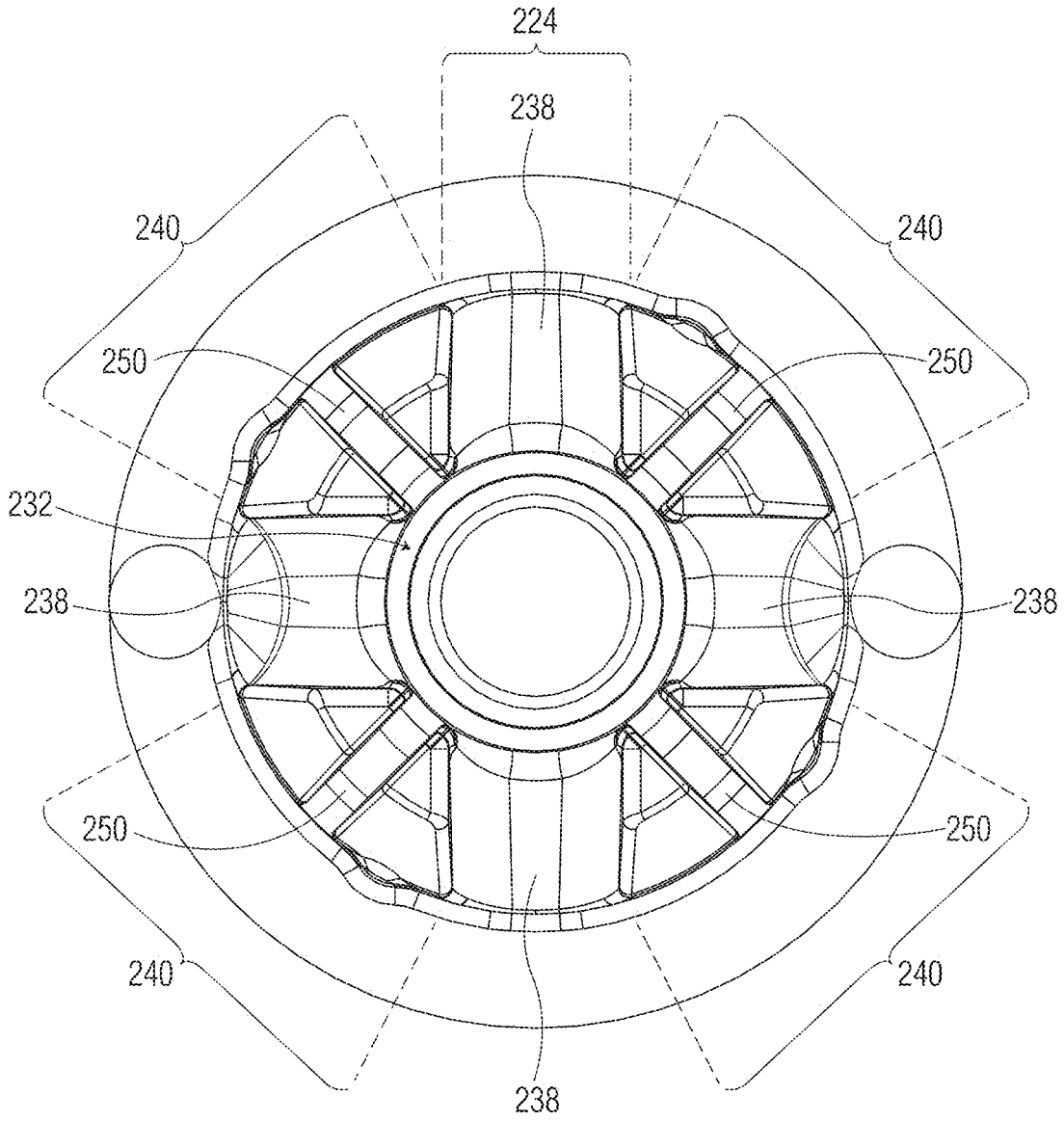
FIG. 13 is a top plan view of the dispenser facing side of the end plug of FIG. 12.
Figure 14:
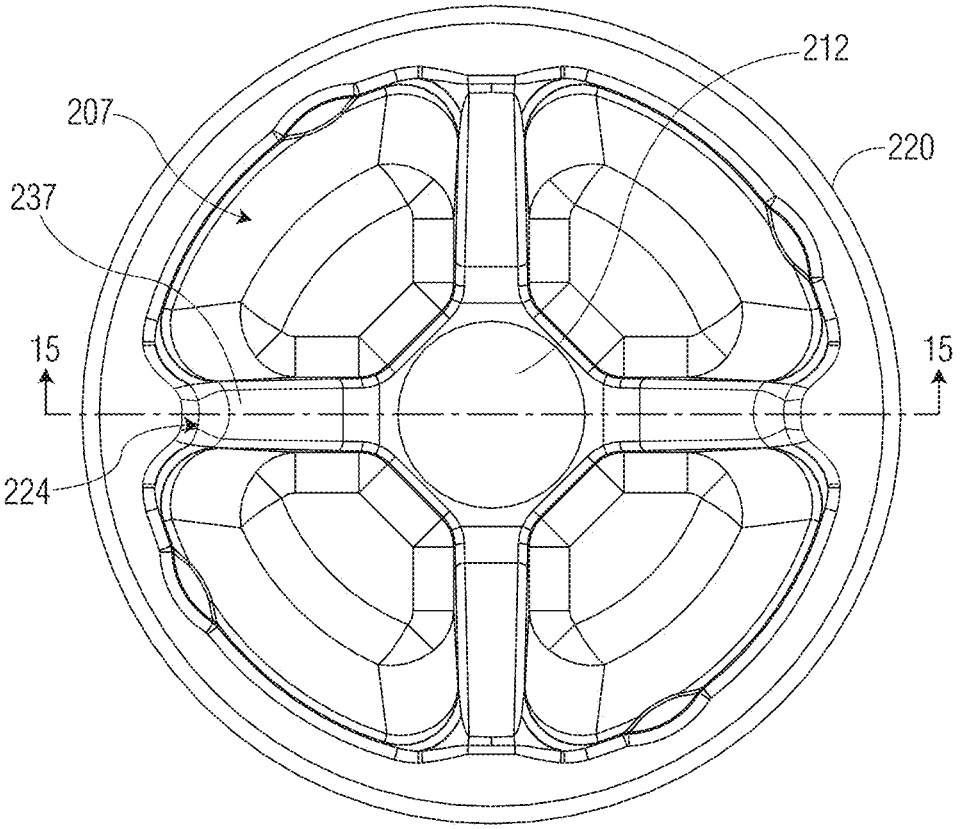
FIG. 14 is a view of the roll facing surface of the end plug of FIGS. 12 and 13 from above.
Figure 15:
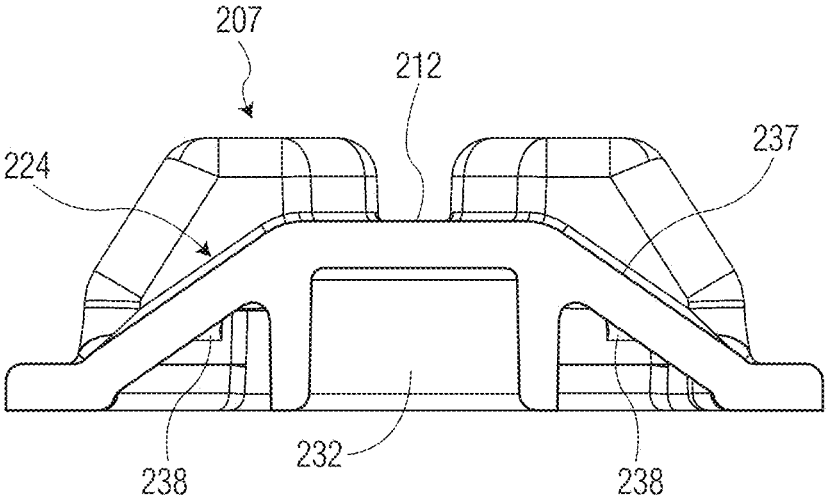
FIG. 15 is a section along the line 15-15 of FIG. 14.
Figure 16:
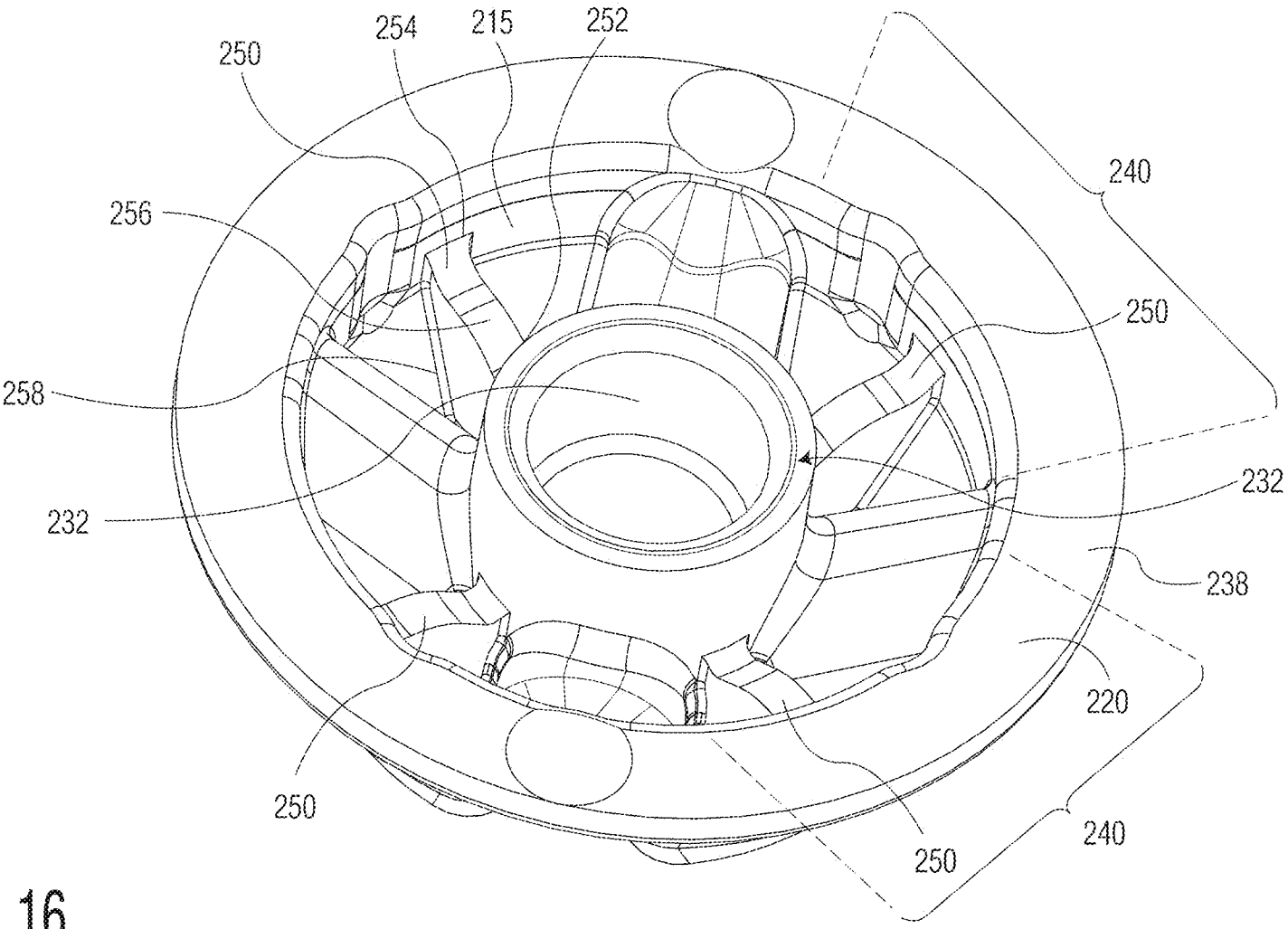
FIG. 16 is a perspective view of the dispenser facing side of the end plug of FIGS. 12-15.

FIG. 13 is a top plan view of the dispenser facing side 203. FIG. 14 is a view of the roll facing surface from above, while FIG. 15 is a section along the line 15-15 of FIG. 14, showing the sloping surfaces 238 and 237 more clearly. FIG. 16 is a perspective view of the dispenser facing side.

This embodiment illustrates an optional feature of reinforcing ribs 250 which may be associated with the dispenser facing side 205. Such ribs may be used with end plugs of other constructions, including any of the earlier and later described embodiments if desired.

The reinforcing ribs are seen more clearly in FIGS. 13 and 16, which respectively are a top plan view of the dispenser facing side 203, and a perspective view thereof. The dispenser facing side includes similar formations to the earlier embodiment, including an annular formation 232. Recesses 240 are defined corresponding to the reverse side of the domes on the roll facing side. Sloping surfaces 238 are defined corresponding to the reverse side of the sloping portion of the connecting portion 224 which defines the sloping surface 237 on the roll facing side. The sloping surfaces 238 cooperate with a ramp structure of a roll holder portion as in the earlier embodiment, while the annular formation 232 receives a projection thereof.

With reference to FIG. 16, each rib defines a proximal end 252 and a distal end 254. The proximal end is joined to a radially outer surface of a wall of the annular formation 232 at the base thereof on the dispenser facing side. The distal end 254 is connected to the interior surface of a peripheral wall of the dispenser facing side, corresponding to the dispenser facing surface of the first portion 215 of the outer wall of the dome 207 in the base region of the dome. A first radially extending surface 256 of the rib 250 is located closer to the roll in use. An opposite second radially extending surface 258 of the rib located further from the roll extends along the interior of the dome 207 on the dispenser facing side thereof i.e. along the surface of the recess defined by the dome on the dispenser facing side of the end plug. Each rib is of identical construction.

The ribs act to reinforce the end plug. The ribs may help to stabilise the annular formation 232 enabling it to better withstand forces arising in use, and may also stabilise the domes, extending along the dispenser facing surface thereof.

It will be appreciated that the number and position of the ribs may differ from that shown. For example, it is not necessary that one rib is provided per dome. The width and height of the ribs may vary. For example, the height over which the proximal and distal ends of the ribs extend over the peripheral wall of the dispenser facing side and/or the wall of the annular formation may vary. While the ribs 250 are shown as extending across the recesses 240 on the dispenser facing sides of the domes 207, alternatively ribs 250 could instead be provided on the dispenser facing side between the domes 207.

Figure 17:
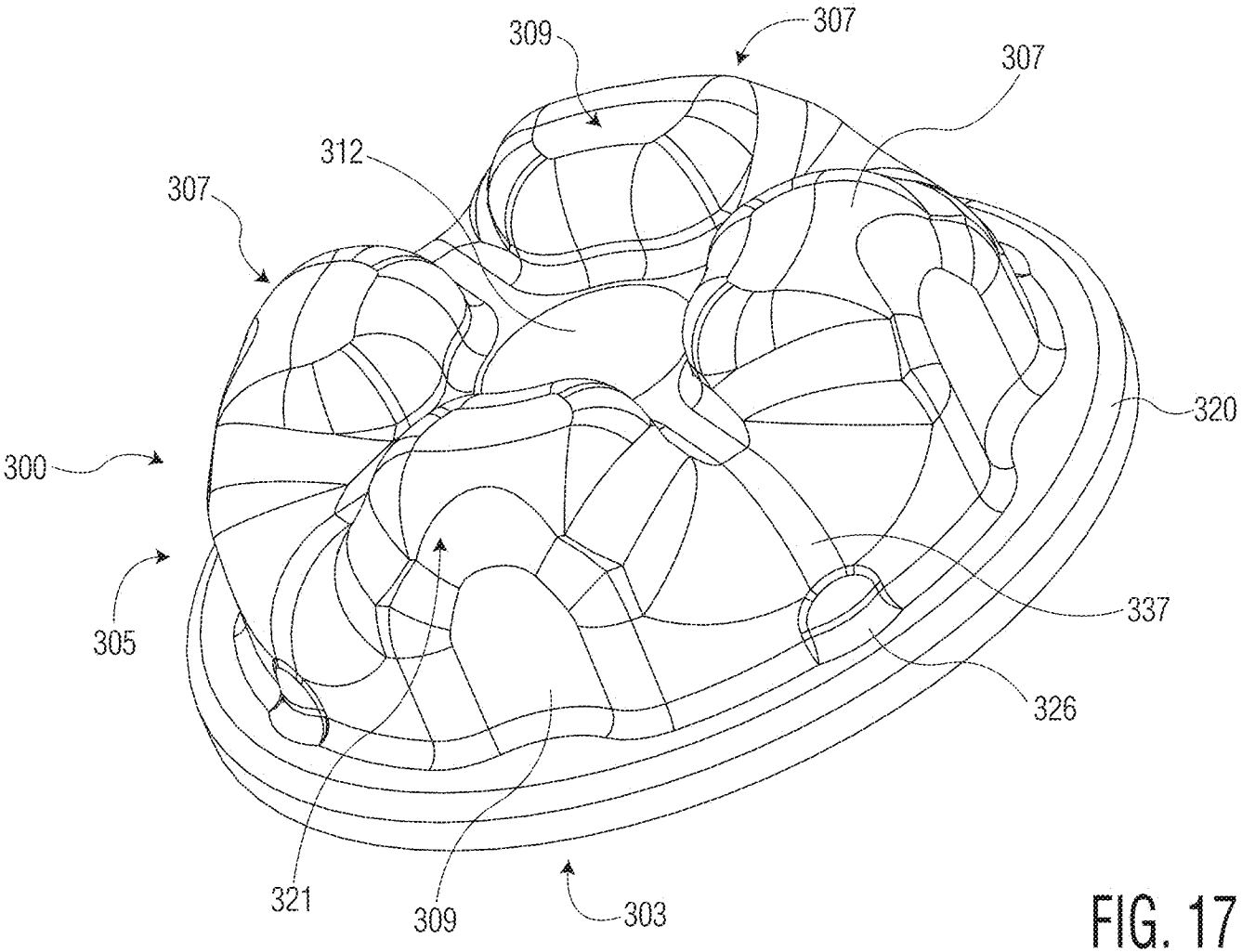
FIG. 17 is a perspective view of another embodiment of a moulded fibrous end plug in accordance with the invention, with the roll facing side uppermost.
Figure 18:
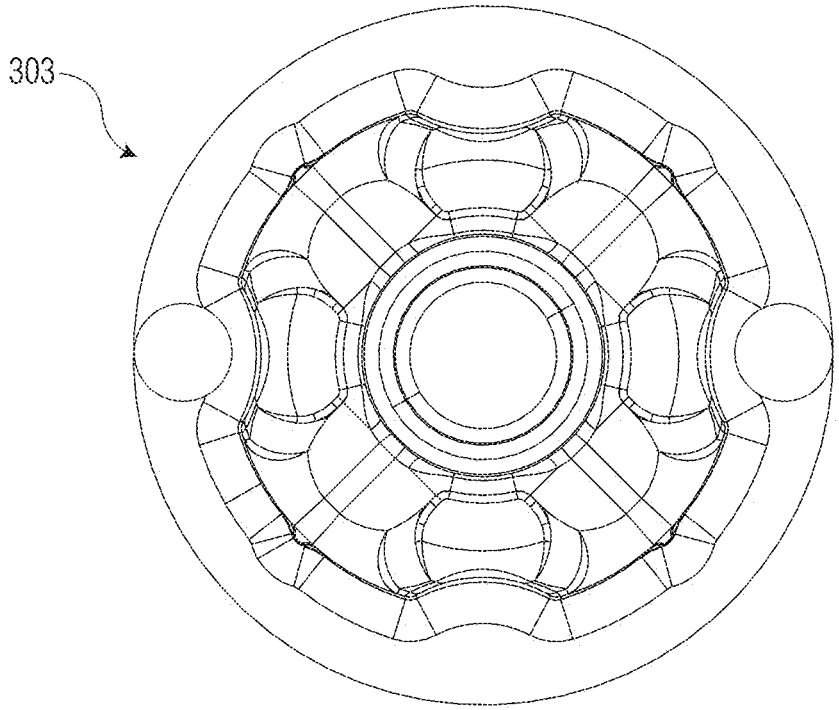
FIG. 18 is a top view from the dispenser facing side of the end plug of FIG. 17.
Figure 19:
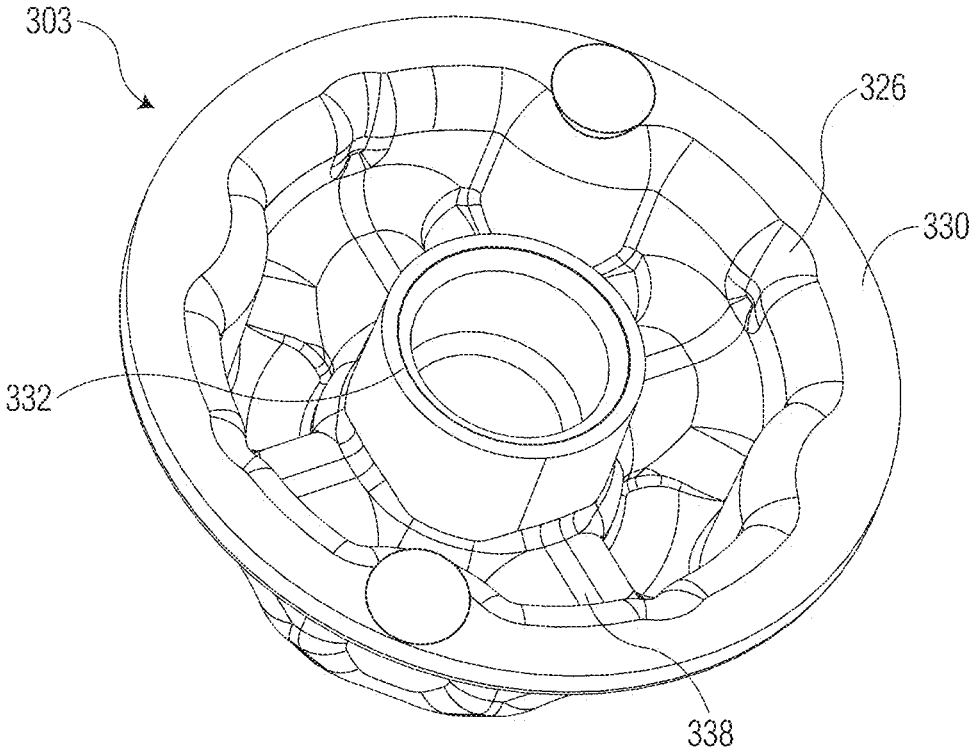
FIG. 19 is a perspective view from the dispenser facing side of the end plug of FIGS. 17 and 18.

A yet further exemplary embodiment of an end plug 300 in accordance with the invention is shown in FIGS. 17-19.

FIG. 17 is a perspective view of the end plug with the roll facing side 305 uppermost. FIG. 18 is a top view from the dispenser facing side 303, and FIG. 19 is a perspective view from the dispenser facing side.

As previously, corresponding reference numerals to those used with the first embodiment of FIGS. 6-11 will be used, incremented by 300. This embodiment illustrates a yet further possible configuration of the domes and the connecting portions therebetween. The end plug 300 is used in the same manner as the earlier embodiments. The protuberances 326 for providing an interference fit are associated with the connecting portions 324 rather than the exterior of the domes in this embodiment. Each dome includes a recessed portion 321 defined along the outer surface thereof. As previously, the dispenser facing side includes an annular formation 332 for receiving a projection of a roll holder portion, and the dispenser facing surfaces 338 of the sloping portions of the connecting portions 324 (which define sloping surfaces 337 on the roll facing side) may cooperate with a ramp structure of a roll holder portion as in the earlier embodiments. In this embodiment, the sloping portions of the connecting portions on the roll facing side are curved with increasing height from the base (and so the sloping surfaces 338 on the dispenser facing side are correspondingly curved).

A further embodiment of a fibrous end plug 400 in accordance with the invention is shown in FIGS. 20 and 21. This further embodiment is similar to the earlier embodiments, and the corresponding feature use the same reference numerals as those of the first embodiment, incremented by 400. Only the significant differences will be described.

FIG. 20 is a perspective view from above from the roll facing surface. FIG. 21 is a view from above of the dispenser facing surface 403.

As in the earlier embodiments, the end plug 400 includes a plurality of domes 407 surrounding a central portion 412 and separated by connecting portions 424. In this embodiment, the connecting portions include sloping portions including sloping surfaces 437 as previously, but in this embodiment, each connecting portion 424 includes an opening 480. The provision of openings in this manner may be useful in controlling the overall strength of the end plug. Introducing openings may be used to decrease the strength of the end plug if required to obtain a desired strength level. The reverse side of the connecting portion 424 defines sloping surfaces e.g. 438 on the dispenser facing side.

The dispenser facing side 403 includes various formations provided by the reverse side of formations of the roll facing side. Thus, recesses 440 are provided corresponding to the domes 407, and sloping surfaces are defined provided by the reverse of portions of the connecting portions 424. The formations on the dispenser facing side, as previously, are such that they do not interfere with the ability to mount the end plug securely to a dispenser, with a projection of the dispenser received in the bore 434 of the annular formation 432. Various surfaces on the dispenser facing side may engage a ramp of a dispenser where provided i.e. of the type shown in FIGS. 2-4, 10 and 11, while still permitting the end plug to be properly mounted on to the dispenser roll holder portion.

The end plug of FIGS. 20 and 21 is also suitable for use with other dispenser types, in which the end plug is required to be non-rotatably mounted thereto. One or more opening may receive a respective formation of the roll holder portion to retain the end plug in a fixed rotational position relative to the roll holder portion. The edges of the opening may cooperate with the formation of the roll holder portion to prevent relative rotation between the roll holder portion and end plug. For example, the edges of an opening may cooperate with a projecting sensor part of the roll holder portion in this way. An example of such a roll holder portion is described below in relation to FIGS. 20 and 21. Of course, other arrangements may be envisaged to provide a keyed fit, e.g. using a recess in the end plug, not necessarily in the form of an opening, which may receive a formation of the roll holder portion to provide a keyed fit therebetween. Examples are shown in FIGS. 23-31 below.

It will be appreciated that openings as shown in the embodiment of FIGS. 20 and 21 may be introduced into any of the other embodiments illustrated if desired. One or more openings may be provided even where a keyed connection between the roll holder portion and end plug is not required, e.g. to tailor the strength of the end plug for a desired application. Thus the embodiment of FIGS. 20 and 21 is not limited to use in arrangements where a non-rotatable connection is required between the end plug and roll holder portion. Similarly, the embodiment of FIGS. 20 and 21 may be produced without openings in the connecting portions if higher strength is required. A keyed fit to a dispenser may be provided in other ways e.g. by cooperation between a projecting portion of the roll holder portion and one of the recesses 440 provided by the reverse of the domes, if a keyed fit to a dispenser is required. Examples of such arrangements are described below by reference to FIGS. 21-31.

While in some exemplary embodiments above, a reverse side of connecting portions connecting domes has been illustrated as sloping, and cooperating with a ramp formation of a dispenser roll holder portion to permit mounting of the end plug thereto, it will be appreciated that more generally, the formations of the dispenser facing side should be configured so as not to interfere with the required mounting of the end plug to the roll holder portion, whether rotatable or not. Thus, any surfaces defined on the dispenser facing side, which may be provided by the reverse of formations on the roll facing side, should be configured so as not to interfere with the intended mounting of the end plug. Such surfaces may include sloping surfaces, and may, for example, be provided by the reverse of the domes and/or connecting portions.

The use of the end plug of the further embodiments is as described with respect to the first embodiment of FIGS. 6-11. The only difference is that, in some embodiments, the roll holder portion may rotate with the end plug relative to a cooperating portion of the dispenser. For example, the roll holder portion may be rotatable relative to a mounting portion e.g. hub fixed to the arm of the dispenser.

A further embodiment of a fibrous end plug 500 in accordance with the invention is shown in FIGS. 22-25. This further embodiment is similar to the earlier embodiments, and the corresponding feature use the same reference numerals as those of the first embodiment, incremented by 500. Only the significant differences will be described.

Figure 22:
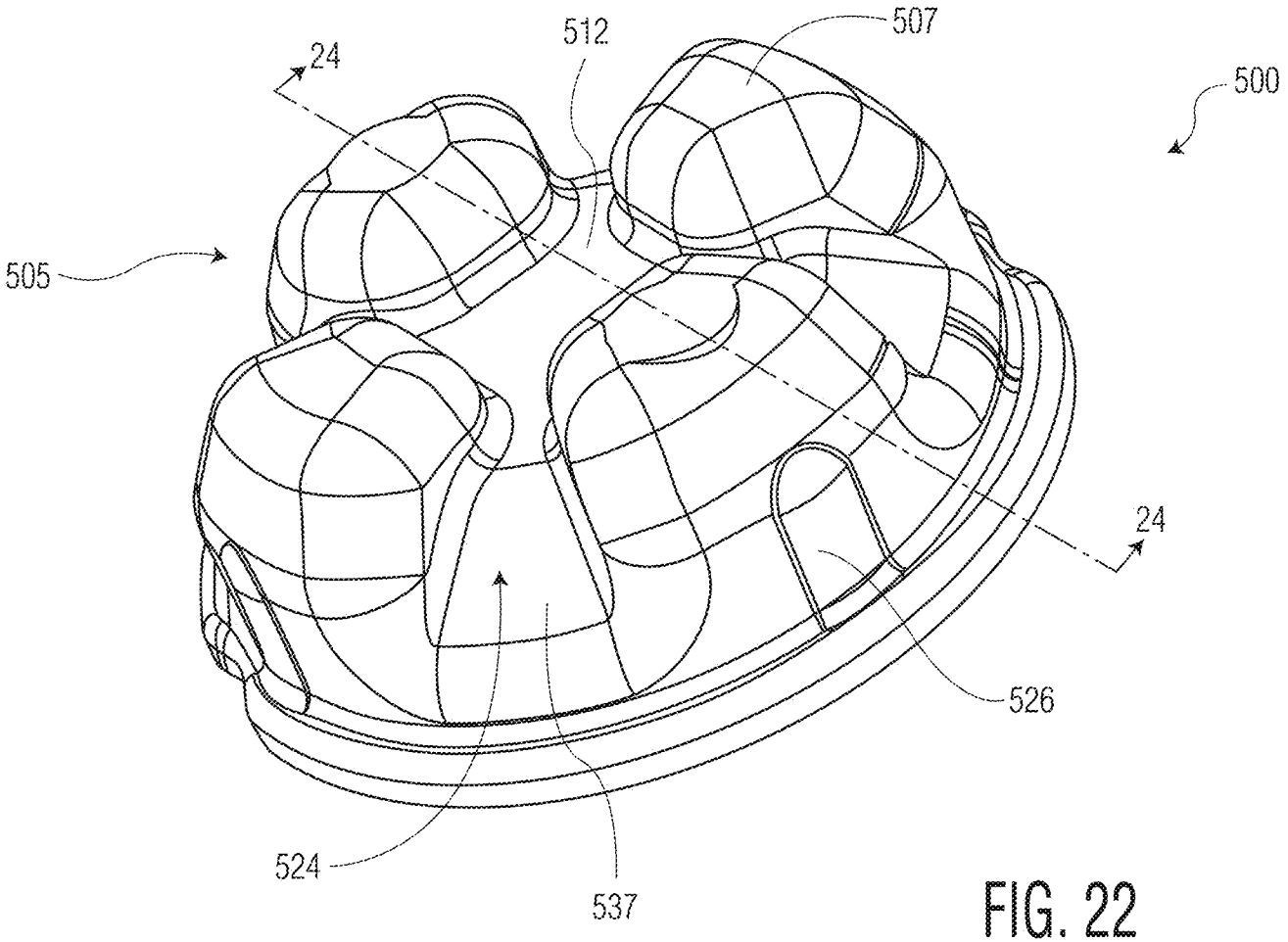
FIG. 22 is a perspective view from above from the roll facing surface of a moulded fibrous end plug in accordance with a yet further embodiment of the invention.
Figure 23:
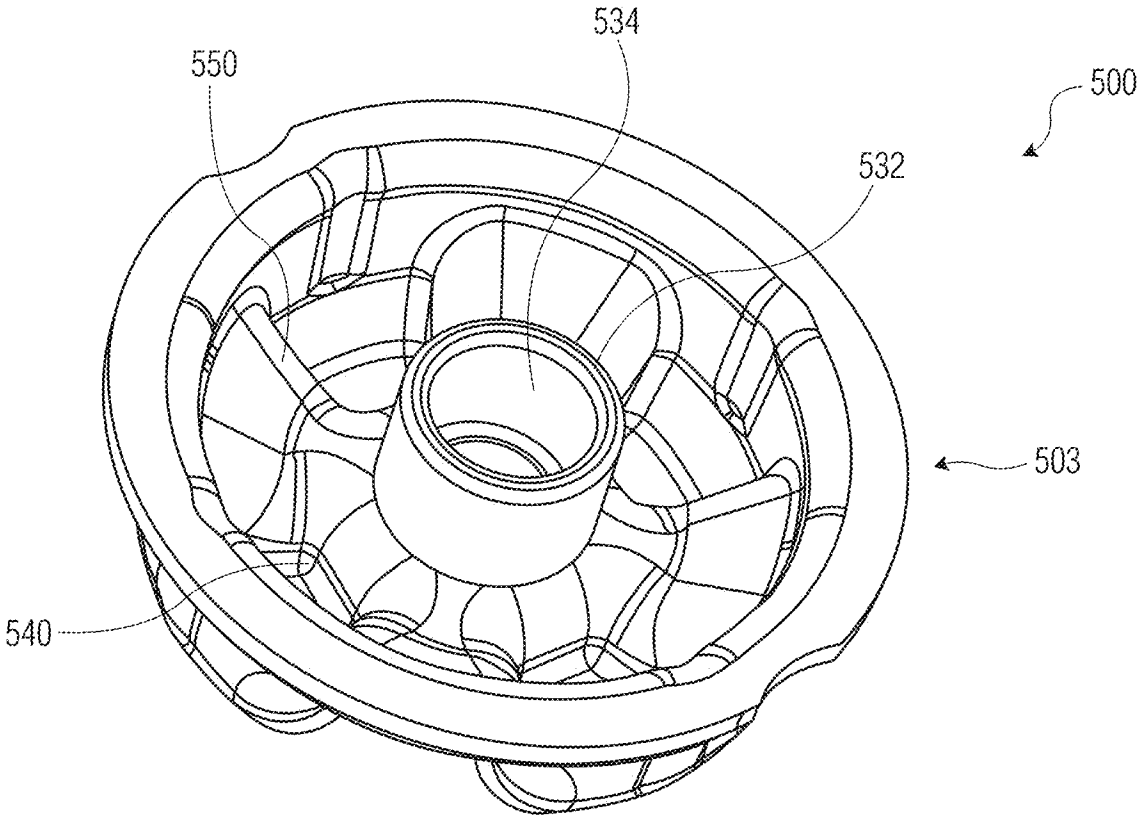
FIG. 23 is a view from above of the dispenser facing surface of the end plug of FIG. 22.
Figure 24:
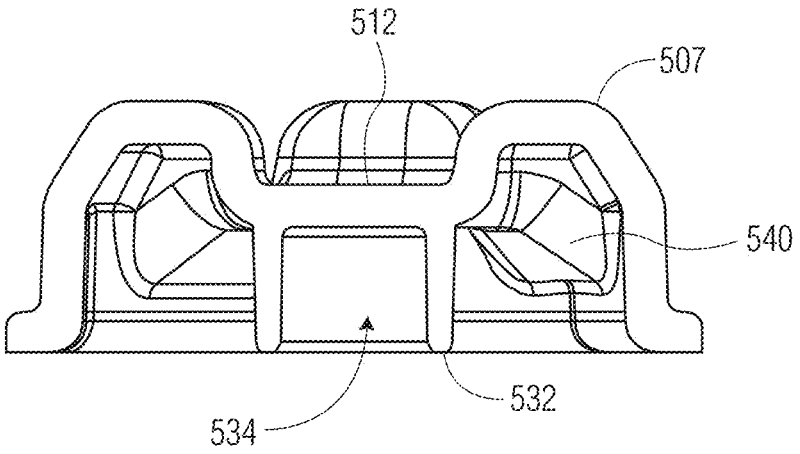
FIG. 24 is a cross sectional view of the end plug of the embodiment of FIGS. 22 and 23 taken along the line 24-24 of FIG. 22.

FIG. 22 is a perspective view from above from the roll facing surface. FIG. 23 is a view from above of the dispenser facing surface 503. FIG. 24 is a cross sectional view through the end plug 500 along the line 24-24 of FIG. 22.

As in the earlier embodiments, the end plug 500 includes a plurality of domes 507 surrounding a central portion 512 and separated by connecting portions 524. In this embodiment, the connecting portions include sloping portions including sloping surfaces 537 as previously. In this embodiment, in contrast to that of FIGS. 21 and 22, the connecting portions are free from openings. This may provide a stronger end plug.

The dispenser facing side 503 includes various formations provided by the reverse side of formations of the roll facing side. Thus, recesses 540 are provided corresponding to the domes 507, and sloping surfaces are defined provided by the reverse of portions of the connecting portions 524. The formations on the dispenser facing side, as previously, are such that they do not interfere with the ability to mount the end plug securely to a dispenser, with a projection of the roll holder portion received in the bore 534 of the annular formation 532.

Various surfaces on the dispenser facing side may engage a ramp or other formation of a dispenser where provided i.e. of the type shown in FIGS. 2-4, 10 and 11, while still permitting the end plug to be properly mounted on to the dispenser roll holder portion.

The end plug of FIGS. 22-24 is, like the end plug of FIGS. 20 and 21, also suitable for use with other dispenser types, in which the end plug is required to be non-rotatably mounted to a roll holder portion (which is, in turn, rotatably mounted to a mounting portion of the dispenser). One or more of the recesses 540 provided by the dispenser facing side of the domes 507 may receive a respective formation of the roll holder portion to retain the end plug in a fixed rotational position relative to the roll holder portion. The edges of the recess may cooperate with the formation of the roll holder portion to prevent relative rotation between the roll holder portion and end plug. In the illustrated embodiment, each of the domes is of identical construction, and thus defines a recess 540 on the reverse side thereof configured to receive a cooperating formation of the roll holder portion. This may provide greater ease of use, as the end plug may be mounted to the roll holder portion by locating the projecting part of the roll holder portion in the recess defined by any one of the domes. Of course, it is not necessary that each recess defined on the reverse side of a dome is capable of receiving a projecting part of the roll holder portion, provided that the or each projecting part of the roll holder portion present may be appropriately fitted within a recess associated with the dispenser facing side of the end plug to provide the desired connection therebetween. The domes may be configured so as to be tailored to receive the particular configuration of projecting part associated with a roll holder portion with which the end plug is intended to be used, so as to prevent the use of the end plug with a dispenser which is not that intended.

In the embodiment illustrated, the dispenser facing side of the end plug 500 does not include reinforcing ribs extending across the recesses 540 defined by the dispenser facing sides of the domes. This may avoid the ribs interfering with insertion of the projecting part of the roll holder portion into the recess 540 defined by a dome. It may be seen that ribs 550 are instead provided in the region between the domes on the dispenser facing surface. Such ribs are optional. It is also envisaged that ribs could be used e.g. being associated with some of the domes, e.g. other than the dome or domes which is to receive the projecting part, and/or being located elsewhere other than in the recesses defined by the domes.

The embodiment of FIGS. 22-24 illustrates how, by appropriate configuration of the domes, the reverse side of a dome may be used to provide a keyed connection to a projecting part of a roll holder portion. Thus, an end plug of this general construction may be used either to provide a keyed or rotatable connection with a roll holder portion. Some dimensional changes may be required to fit a given roll holder portion. Of course, the end plugs of the previously described embodiments (by reference to any one of FIGS. 1-21) may similarly be used to provide a keyed connection to a roll holder portion by appropriate configuration of the reverse side of the domes relative to a part of a roll holder portion with which they are to cooperate.

The use of the end plug of the further embodiments is as described with respect to the earlier embodiments. In some embodiments, as will now be exemplified, the roll holder portion may rotate with the end plug.

Figure 25:
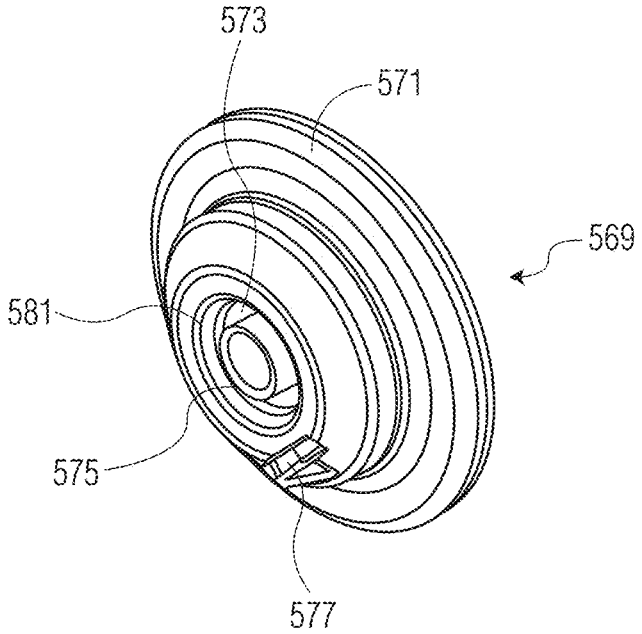
FIG. 25 is a perspective view of a roll holder portion of a dispenser from the roll facing side thereof suitable for use with the end plug of the embodiment of FIGS. 22-24.
Figure 26:
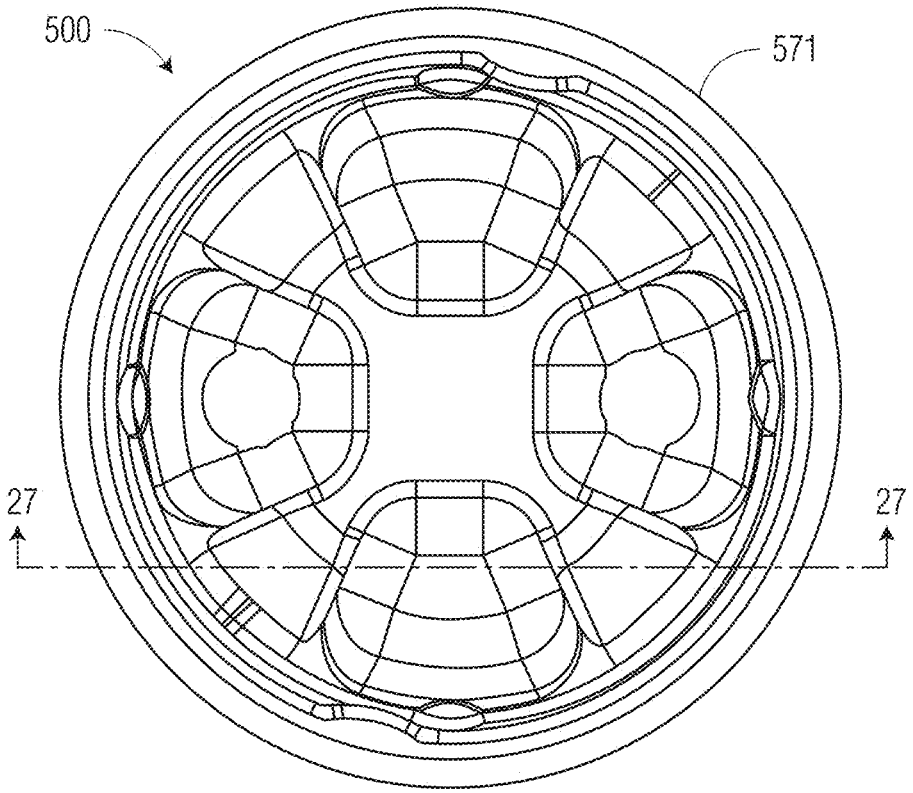
FIG. 26 is a view from above illustrating the end plug of FIGS. 22-24 mounted on the roll holder portion of FIG. 25.
Figure 27:
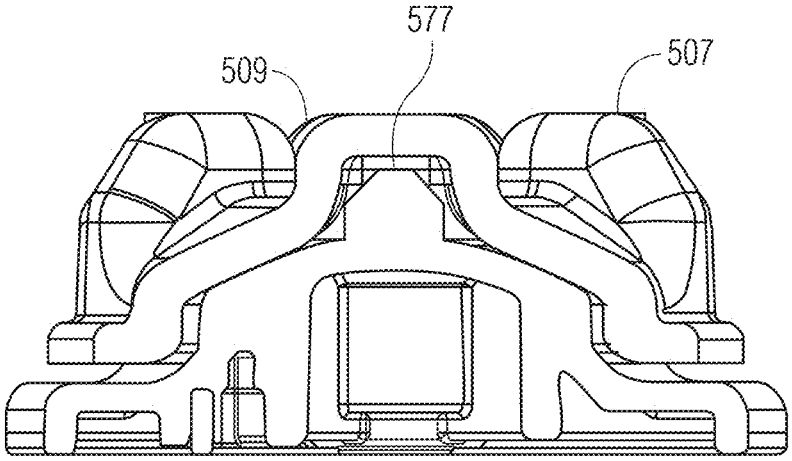
FIG. 27 is a sectional view along the line 27-27 of FIG. 26.

FIG. 25 is a perspective view from the front and one side illustrating the front face of a roll holder portion 569 with which the end plug 500 may be used. The roll holder portion 569 is in the form of a hub. The front face comprises formations which may cooperate with the formations of the dispenser facing side of an end plug in accordance with an embodiment of FIGS. 22-24 to mount the end plug to the dispenser. In this example, the formations cooperate with one another to provide a keyed connection between the end plug and the roll holder portion. FIG. 26 is a front on view showing the end plug mounted on the roll holder portion, and FIG. 27 is a sectional view along the line 27-27 of FIG. 26 showing the cooperation between formations of the roll holder portion 569 and the dispenser facing side of the end plug 500.

The roll holder portion 569 includes a cylindrical projection 575. An annular structure 581 circumferentially surrounds the projection 575 so as to define an annular space 573 therebetween. The structure 581 defines a circumferentially extending wall which defines the radially outer edge of the annular space 573. The roll holder portion 569 includes a peripheral flange 571 which defines a front face of the roll holder portion from which the annular structure 581 and cylindrical projection 575 are upstanding.

In this example, the cylindrical projection 575 of the roll holder portion 569 is received in the bore 534 of the annular formation 532 of the end plug. The annular formation 532 of the end plug fits within the annular space 575 of the roll holder portion.

The roll holder portion 569 also includes a projecting sensor part 577 which comprises a magnet. The sensor part 577 forms part of a sensor arrangement for sensing rotation of the roll (with the end plug and roll holder portion) relative to a dispenser arm in use. The sensor arrangement may be used to detect a number of revolutions of the roll. This may be used, e.g. to determine an amount of product remaining etc. The remainder of the sensor arrangement is associated with a portion of the dispenser with respect to which the roll holder portion rotates. For example, in embodiments, the roll holder portion 569 is rotatably mounted to a mounting portion e.g. hub, fixed on a distal end of an arm of the dispenser. Such an arrangement would be similar to that shown in FIG. 1, with the mounting portion provided in the position of the roll holder portion 104 as shown, and with the roll holder portion 569 rotatably mounted to the mounting portion. The mounting portion may comprise a probe portion of the sensor arrangement for detecting the proximity of the magnet part of the dispenser associated with the roll holder portion 569. The probe portion is thus rotationally fixed relative to the dispenser arm.

In some exemplary arrangements the probe portion may be electrically connected to a sensor module of the sensor arrangement e.g. using a wired connection. The sensor module may form part of a dispenser module for controlling operation of the dispenser where the dispenser is an electronic dispenser. The sensor module may comprise a processor. In this way, the probe may detect when the magnet passes the probe during rotation of the roll holder portion relative to the mounting portion in use, and hence may determine a number of rotations of the roll.

Referring to FIG. 27, when the end plug 500 is mounted to the roll holder portion 569, the sensor part 577 is located within the apex of one of the recesses 540 provided by the reverse of a dome 507 to provide a keyed connection between the end plug 500 and the roll holder portion 569. The apex is provided by the reverse of the top 509 of the dome 507. The roll facing side of the roll holder portion and the dispenser facing side of the end plug are configured to enable the end plug 500 to be fitted over the roll holder portion 569 to result in the sensor part 577 being located in the apex defined on the reverse side of the dome.

Figure 28:
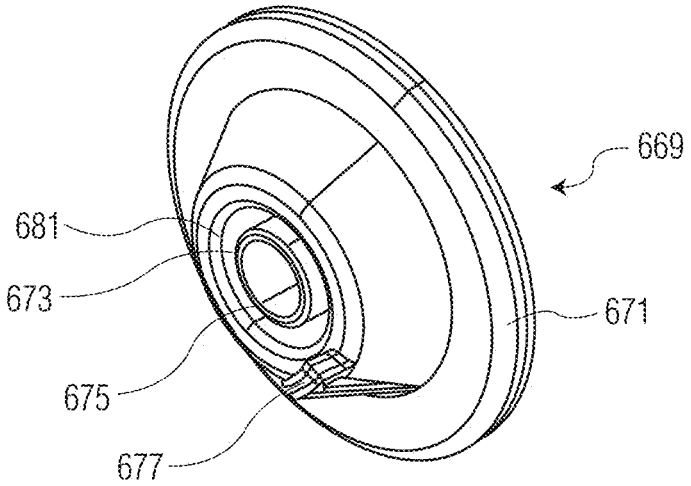
FIG. 28 is a perspective view of another roll holder portion of a dispenser from the roll facing side thereof suitable for use with the end plug of a further embodiment shown in FIGS. 29-31.
Figure 29:
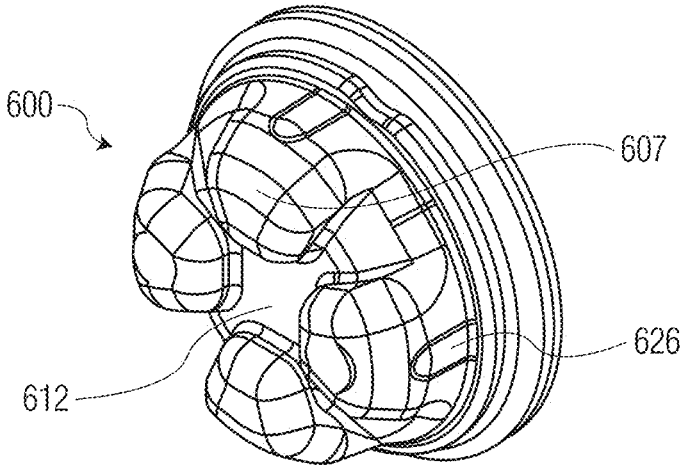
FIG. 29 is a view from above and one side illustrating the end plug of a further embodiment mounted on the roll holder portion of FIG. 28.
Figure 30:
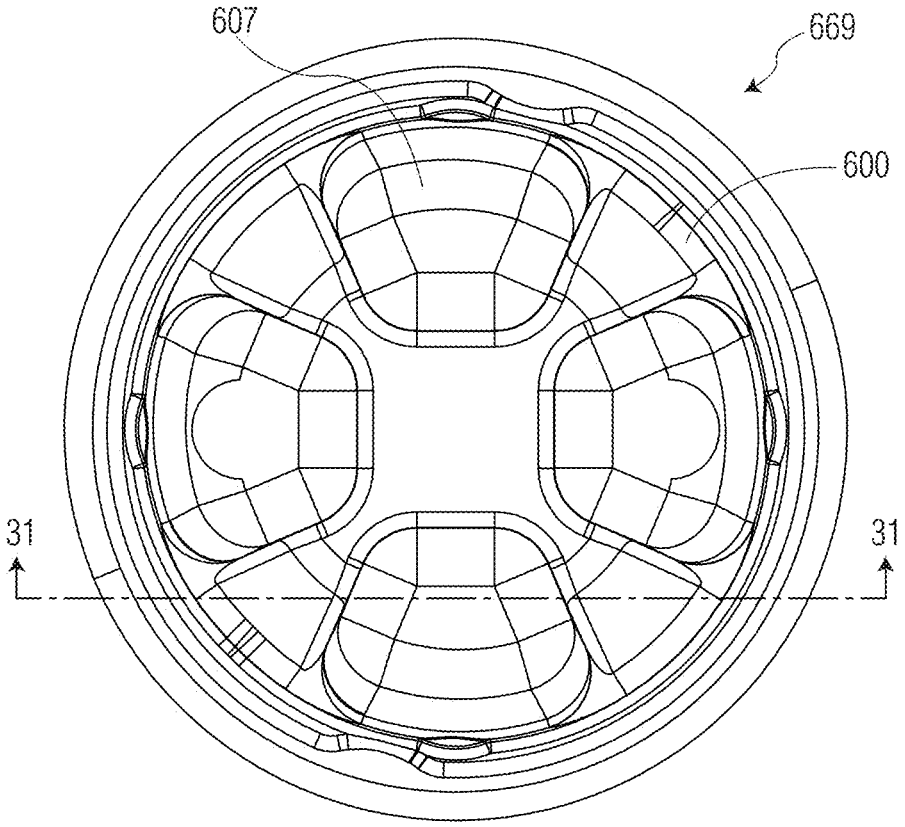
FIG. 30 is a view from above of the arrangement shown in FIG. 29 illustrating the end plug mounted on the roll holder portion of FIG. 28.

A further embodiment of an end plug 600 in accordance with the invention will be described with respect to FIGS. 28-31. FIG. 28 is a front perspective view of a roll holder portion 669 with which the end plug may be used to provide a keyed connection. FIG. 29 is a perspective view which illustrates the end plug 600 mounted on the roll holder portion 669 from the roll facing side, while FIG. 30 shows the end plug 600 mounted on the roll holder portion 669 from above.

The end plug 600 is of similar configuration to the end plug 500 described by reference to FIGS. 22-27, and may be used in a similar manner. The end plug 600 differs mainly in dimensional detail to accommodate the sensor portion of a roll holder portion 669 which differs in configuration to the roll holder portion 569. The end plug 600 includes domes 607, protuberances 626, a central portion 612 and a flange 671.

The end plug 600 includes domes 607 and other features corresponding to those of the earlier embodiment. The reference numerals denoting corresponding features have been incremented relative to the first embodiment by 600. The end plug 600 is configured to cooperate with the roll holder portion 669 such that the sensor portion 677 of the roll holder portion 669 fits within the apex defined on the reverse side of one of the domes 607 i.e by the recess 640 on the reverse side of the dome, to provide the keyed connection. The dispenser facing side of the end plug 600 is of a similar configuration to that of the end plug 500 i.e. including an annular structure defining a bore for receiving a cylindrical projection of the roll holder portion.

The roll holder portion 669 is similar to the roll holder portion 569, having a cylindrical projection 675 (which again is shown as a hollow cylinder), and an annular structure 681 surrounding the projection 675 and having a radially inner wall defining an annular space 673 between the annular structure 681 and the projection 675.

Figure 31:
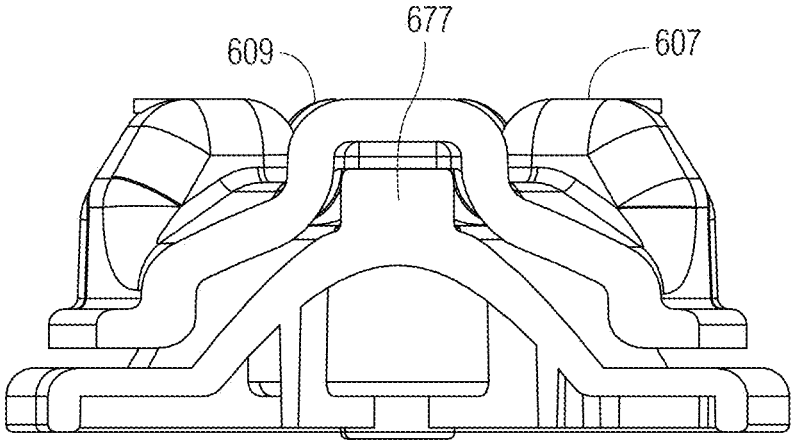
FIG. 31 is a sectional view along the line 31-31 of FIG. 30.

FIGS. 29 and 30 show the end plug 600 mounted on the roll holder portion 669. The cylindrical projection 675 is received in a bore of the annular formation of the roll facing side of the end plug 600. FIG. 31 is a section taken along the line 31-31 of FIG. 30 which illustrates how the projecting sensor 677 is received in the apex defined by the recess 640 on the reverse side of one of the domes 607 to provide a keyed connection between the roll holder portion and the end plug. The roll holder portion 669 is rotatably mounted to a dispenser as previously described with respect to the roll holder portion 559. Thus, the roll holder portion 669 may be rotatably mounted to a mounting portion e.g. hub fixed to an arm of the dispenser, and including a probe part of the sensor arrangement. Of course, the same end plug 600 could alternatively be used to provide a rotatable connection to a roll holder portion, where the roll holder portion and dispenser facing side of the end plug 600 are appropriately configured i.e. such that a keyed connection is not provided e.g. where the roll holder portion does not include a projecting part that is located within a dome to provide a keyed connection.

The end plug of the present invention in any of its embodiments is a fibrous end plug.

The end plug is formed from a mixture of fibers and binder. The binder provides a matrix holding the fibers in place. Any suitable binder may be used, but the binder is advantageously biodegradable. The binder preferably comprises one or more biodegradable biopolymer, and preferably comprises starch. In exemplary embodiments the starch is potato starch.

The fibres used in making the end plug may be of any suitable type, and are preferably biodegradable fibers, such as cellulosic fibers. Advantageously the fibers are recycled fibers.

The end plug may comprise one or more additional substances. For example, these may be residue from substances used to facilitate manufacture and/or may be substances added to impart the finished end plug with desired properties. The end plug may comprise one or more of; at least one colouring agent, at least one preservative, at least one strengthening agent, at least one stabilizer, at least one filler and at least one rising agent. Preferably any such additional substances are natural and/or biodegradable substances.

The material of the moulded end plug may comprise a foamed structure.

By way of example only, one suitable material for the moulded end plug is PaperFoam®, obtainable from the company PaperFoam® with headquarters in the Netherlands (currently of Hermesweg 22, 3771 ND Barneveld, The Netherlands).

A biodegradable end plug in accordance with the invention may comply with any one or ones (and preferably with each) of the following standards; EN 13432, ASTM D6868, TÜV Austria OK Industrial Compost or TUV Austria OK Home Compost. The end plug may alternatively or additionally be certified as biobased in accordance with any one or ones of; USDA Certified Biobased Product, TÜV Austria OK Biobased (rank 4). The end plug may alternatively or additionally be UL validated as recyclable. The end plug may be UL validated as recyclable with a 99% recovery rate of available fibers.

The end plug is obtained using a moulding process. The process may be an injection moulding process in which the material from which the end plug is to be formed is injected into an appropriately configured mould.

The mould may include two parts, having formations for producing the desired formations of the roll facing and dispenser facings sides of the end plug respectively. When closed, the mould may define a mould cavity corresponding the shape of the end plug to be produced.

Examples of materials which may be used in producing the end plug are described in U.S. Pat. No. 5,849,152A entitled "Process for the production of shaped bodies from biodegradable material and shaped body" of Rapido Waagen-und Maschinenfabrik GmbH. By way of example only, one suitable material for the moulded end plug is PaperFoam® obtainable from the company PaperFoam® with headquarters in the Netherlands (currently of Hermesweg 22, 3771 ND Barneveld, The Netherlands).

Figure 32:
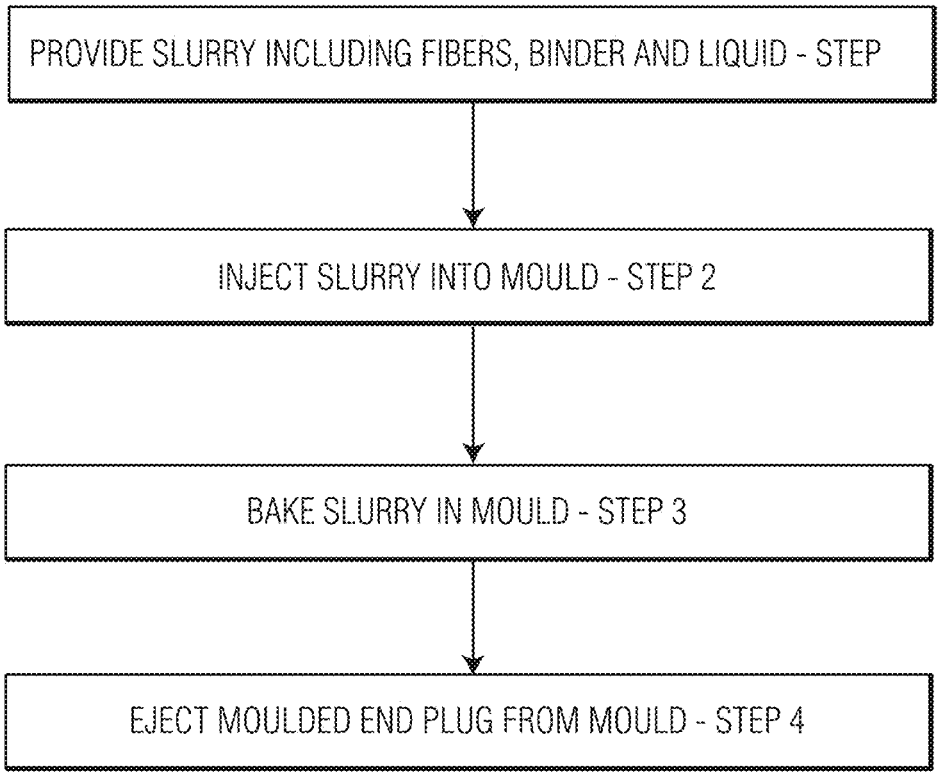
FIG. 32 is a flow chart illustrating certain steps in the manufacture of a moulded fibrous end plug in accordance with one exemplary embodiment of the invention.
Figure 33:
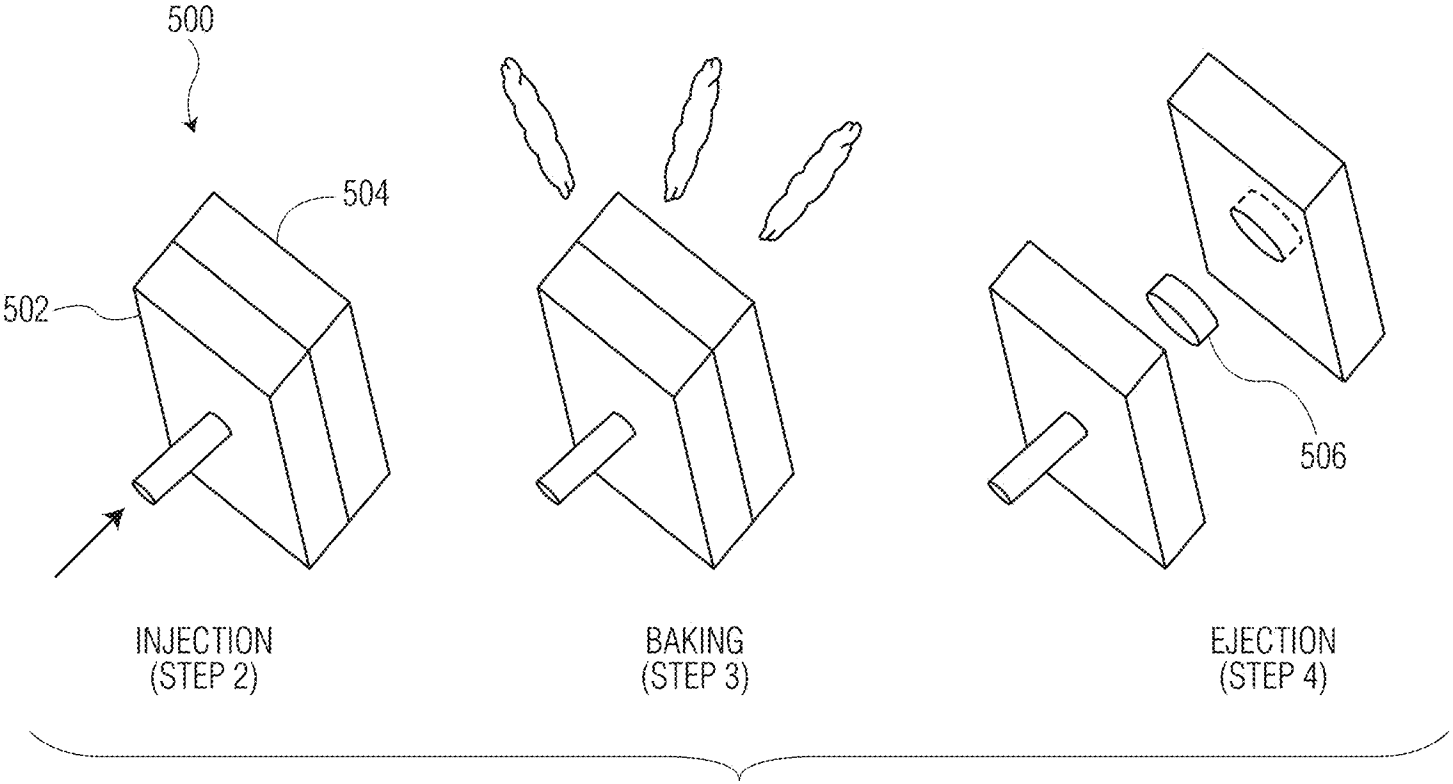
FIG. 33 schematically illustrates certain of the steps of FIG. 32.

One exemplary method for producing the end plug will now be described, by reference to FIGS. 32 and 33. FIG. 32 is a flow chart illustrating one exemplary method for making the end plug, while FIG. 33 illustrates schematically the steps of moulding the end plug in one exemplary embodiment, corresponding to steps 2-4 of FIG. 32.

In step 1, a slurry is produced comprising fibers, binder and liquid. In exemplary embodiments, the fibers are cellulosic fibers obtained from recycled material e.g. paper. The fibers may be obtained by comminuting waste paper material. The material may be comminuted in an initial step prior to producing the slurry. In exemplary embodiments the binder is starch, e.g. potato starch. The liquid is water. The starch may be added to the water in powder form to produce the slurry. One or more additives may be added into the mixture to provide the slurry. The additives may be used to impart the material of the final end plug with desired properties. For example, one or more colouring agent, one or more emulsifier, one or more preservative, one or more strengthening agent, one or more filler In exemplary embodiments the additives include a rising agent, such as yeast. This may provide a foamed material. The additives are sustainable e.g. biodegradable additives.

In one example, the slurry is composed of; 65% starch (e.g. potato or tapioca), 15-20% fibers e.g. cellulosic fibers, 10% liquid (e.g. water), and 15-20% additives, which may include additives of the type exemplified above, and preferably include a rising agent, such as yeast. The additives may be in the form of a sustainable pre-mix made up of biodegradable materials obtainable from PaperFoam®.

The components of the slurry are mixed together to combine them. In some exemplary embodiments, the components of the slurry are mixed by stirring in a tank for a given period, for example 3 minutes. This may help to obtain a desired consistency of the slurry for introduction to a mould, and, where a rising agent, such as yeast is used, may support action of the rising agent.

In step 2, the slurry is introduced to a mould 500. The slurry may optionally be transferred from a mixing tank to a holding tank for storage and/or transport to a moulding station prior to introduction to the mould.

The slurry is in the form of a thick paste when introduced to the mould. In preferred embodiments, no dewatering of the slurry occurs after initial formation of the slurry and before it is introduced into the mould.

The slurry is introduced through the mould by injecting the slurry under pressure into the closed mould e.g. along a path indicated by the arrow in FIG. 33 step 2. It will be appreciated that the slurry may be introduced into the mould at more than one location e.g. including one or more locations which will result in the slurry being introduced into the mould cavity at positions which will correspond to a centre and/or a periphery of the end plug to be produced.

The mould includes two parts 502, 504, having formations for producing the desired formations of the roll facing and dispenser facing sides of the end plug respectively. When closed, the mould defines a mould cavity corresponding the shape of the end plug to be produced. Once the slurry has been injected into the mould, the mould parts may be moved closer relative to one another. This may help to enable the slurry to fill the mould cavity. The dimensions of the cavity defined by the mould when in its closed configuration and with their mould parts located at their closest spacing, will define the wall thickness of the end plug. The mould is a metal mould, for example aluminium.

In step 3, the slurry is baked in the mould. At least some of the liquid content of the slurry introduced into the mould may evaporate from the mould during the baking step. The liquid may evaporate through openings provided for this purpose in the mould. The heating may bake the slurry in the mould. The step of baking the slurry in the mould may resemble a waffle baking process. The baking process may cause the binder material to form a matrix holding the fibres in place and retaining the resulting end plug in its moulded shape. For example, when the binder is starch, the heating step causes gelatinization and/or cross-linking of the starch material. The material of the end plug is heated to final dryness in the mould. In preferred embodiments no additional mould is used during the process of producing the end plug. During baking, the slurry may be heated to any suitable temperature, and in some exemplary embodiments heated to a temperature of around 400 degrees Fahrenheit (204 degrees Celsius). The duration of the heating may be selected as desired, and may depend upon factors such as the viscosity of the slurry, proportion of binder used, the nature of the components of the slurry, and the shape of the moulded end plug to be produced.

In step 4 the baked end plug 506 is ejected from the mould. The end plug is finished and ready to be inserted into the end of a roll. This may occur as part of a different process in a different location. Thus, the end plugs may be packaged and shipped for use in producing a refill roll product. It will be appreciated that FIG. 33 illustrates the mould and end plug produced therefrom in only a schematic manner, and does not show the formations on the dispenser and roll facing sides.

It has been found that a process as described above in which the end plug is produced by baking a slurry in a mould may be advantageous in providing improved definition in the shape of the end plug and surface properties.

List of Clauses:

1. A moulded fibrous end plug for use in mounting a roll of sheet material to a dispenser, wherein the end plug has a roll facing side comprising formations configured to be insertable into an opening in an end of a roll of sheet material in use, the formations of the roll facing side including formations for securing the end plug to the roll of sheet material;

and an opposite dispenser facing side comprising formations configured to cooperate with formations of a roll holder portion of a dispenser in use for mounting the end plug to the dispenser.

2. The moulded fibrous end plug of clause 1 wherein at least some of the formations of the dispenser facing side of the end plug are provided by a reverse side of formations of the roll facing side of the end plug.

3. The moulded fibrous end plug of clause 1 or clause 2 wherein the formations of the roll facing side configured to be insertable into the opening in the end of the roll of sheet material include a plurality of domes.

4. The moulded fibrous end plug of clause 3 wherein from 2-6 and optionally from 2-4 domes are provided.

5. The moulded fibrous end plug of clause 3 or clause 4 wherein the domes are of identical construction.

6. The moulded fibrous end plug of any one of clauses 3 to 5 wherein each dome is upstanding from a base of the roll facing side of the end plug, optionally wherein the end plug comprises a flange around the periphery thereof, the base of the roll facing side of the end plug comprising a roll facing surface of the peripheral flange.

7. The moulded fibrous end plug of any one of clauses 3 to 6 wherein the domes surround a central portion of the roll facing side of the end plug.

8. The moulded fibrous end plug of clause 7 wherein the central portion defines a planar roll facing surface.

9. The moulded fibrous end plug of clause 7 or clause 8 wherein the central portion is located at a level between the base of the roll facing side of the end plug and the tops of the domes.

10. The moulded fibrous end plug of any one of clauses 7 to 9 wherein each dome extends between the central portion of the roll facing side and the roll facing surface of a peripheral flange of the end plug.

11. The moulded fibrous end plug of any one of clauses 7 to 10 wherein the dispenser facing side of the end plug comprises an annular structure defining a central bore for receiving a projection defined by a roll holder portion of the dispenser, wherein the central bore is a closed ended bore, wherein the closed end of the bore is provided by a roll facing surface of a portion of the end plug whose opposite surface provides the central portion of the roll facing side of the end plug.

12. The moulded fibrous end plug of clause 11 wherein the dispenser facing side of the end plug comprises a plurality of reinforcing ribs extending between the annular structure and a peripheral region of the end plug on the dispenser facing side, optionally wherein each rib extends across a recess in the dispenser facing side of the end plug corresponding to a dispenser facing side of a dome.

13. The moulded fibrous end plug of any one of clauses 3 to 12 wherein each dome comprises a base portion and an upper portion, wherein an outer wall of the dome comprises a first portion in the base portion of the dome upstanding from a base of the roll facing side of the end plug and a second, sloping portion in the upper portion of the dome, the second, sloping portion being inclined relative to the first portion, optionally wherein an angle subtended between the first and second portions of the outer wall is in the range of from 20-40 degrees, such as 30 degrees.

14. The moulded fibrous end plug of any one of clauses 3 to 13 wherein the domes are spaced from one another by connecting portions, each connecting portion extending between the central portion of the roll facing side of the end plug and a base of the roll facing side of the end plug, wherein each connecting portion comprises one or more sloping portion; optionally wherein the connecting portion comprises an opening.

15. The moulded fibrous end plug of clause 14 wherein the dispenser facing side of the end plug comprises a plurality of sloping surfaces configured to cooperate with a surface of a ramp structure of the roll holder portion of the dispenser to enable the end plug to be mounted to the roll holder portion, wherein the sloping surfaces of the dispenser facing side are provided by the dispenser facing sides of sloping portions of the connecting portions.

16. The moulded fibrous end plug of any preceding clause wherein the dispenser facing side of the end plug comprises a plurality of reinforcing ribs, optionally wherein the formations of the roll facing side include a plurality of domes, and each rib extends across a recess in the dispenser facing side of the end plug corresponding to a dispenser facing side of a dome.

17. The moulded fibrous end plug of any one of clauses 1 to 16 wherein the dispenser facing side of the end plug further comprises one or more sloping surfaces configured to cooperate with a ramp structure of the roll holder portion, wherein the sloping surfaces are provided by a reverse side of formations on the roll facing side of the end plug.

18. The moulded fibrous end plug of any preceding clause wherein the formations of the roll facing side for securing the end plug to the roll of sheet material include formations configured to provide an interference fit securing the end plug to the roll.

19. The moulded fibrous end plug of clause 18 as dependent upon clause 3 wherein the formations for providing the interference fit comprise protuberances, wherein each protuberance projects outwardly from a respective one of the domes.

20. The moulded fibrous end plug of any preceding clause wherein the end plug is formed from a material comprising a mixture of fibres and binder.

21. The moulded fibrous end plug of clause 20 wherein the binder comprises one or more biodegradable biopolymer.

22. The moulded fibrous end plug of clause 20 or clause 21 wherein the binder comprises starch, for example potato or tapioca starch.

23. The moulded fibrous end plug of any one of clauses 20 to 22 wherein the binder provides a matrix holding the fibres of the moulded fibrous end plug in place.

24. The moulded fibrous end plug of any preceding clause wherein the fibers are cellulosic fibers.

25. The moulded fibrous end plug of any preceding clause wherein the end plug comprises from 10-40% fibers based on total solids content and/or wherein the end plug comprise at least 50% binder based on total solids content.

26. The moulded fibrous end plug of any preceding clause wherein the end plug is biodegradable.

27. The moulded fibrous end plug of any preceding clause, wherein the end plug is injection moulded.

28. A roll product comprising a roll of sheet material having an opening in an end thereof, and a moulded fibrous end plug in accordance with any one of clause 1 to 27 secured to the end of the roll with the formations of the roll facing side of the end plug configured to be insertable into an opening in an end of a roll of sheet material being inserted into the opening in the end of the roll.

29. A dispenser system comprising:

a moulded fibrous end plug in accordance with any one of clauses 1 to 27 and a dispenser comprising a roll holder portion comprising formations configured to cooperate with the formations of the dispenser facing side of the end plug for mounting the end plug to the dispenser in use.

30. A dispenser system comprising:

a dispenser for a roll of sheet material, the dispenser comprising a roll holder portion;

a roll of sheet material having an opening in an end thereof;

and a moulded fibrous end plug in accordance with any one of clauses 1 to 27 secured to the end of the roll of sheet material;

wherein the formations of the roll facing side of the end plug configured to be insertable into an opening in an end of a roll of sheet material are inserted into the opening in the end of the roll of sheet material;

and wherein the formations associated with the dispenser facing side of the end plug cooperate with formations of the roll holder position of the dispenser to mount the end plug to the dispenser.

31. The dispenser system of clause 30 wherein the dispenser facing side of the end plug cooperates with the holder portion to rotatably mount the end plug to the holder portion of the dispenser.

32. A method of using an end plug in accordance with any one of clauses 1 to 27 comprising using the end plug to mount a roll of sheet material to a roll holder portion of a dispenser.

33. The method or dispenser system of any one of clauses 29 to 32 wherein the formations of the dispenser facing side of the end plug and the formations of the roll holder portion which cooperate with one another include respective sets of one or more formations that are complimentary to one another.

34. A method of manufacturing a moulded fibrous end plug in accordance with any one of clauses 1 to 27 comprising providing the moulded fibrous end plug using a moulding process, optionally wherein the moulding process is an injection moulding process.

35. A method of manufacturing a moulded fibrous end plug in accordance with any one of clauses 1 to 27 comprising:

providing a slurry comprising fibers, binder and liquid;

introducing the slurry into a mould;

and heating the slurry in the mould to provide the moulded fibrous end plug.

36. The method of clause 35 wherein the binder comprises a polymeric binder, and the heating step causes gelatinization and/or cross-linking of the polymeric binder material to provide a matrix holding the fibers in place.

37. The method of clause 35 or 36 wherein the method comprises heating the mixture to a temperature of at least 150 degrees Celsius, or at least 180 degrees Celsius.

38. The method of any one of clauses 35 to 37 wherein the step of introducing the slurry in to the mould comprises injecting the slurry into the mould.

39. The method of any one of clauses 34 to 38 wherein the mould is a metal mould, for example an aluminium mould.

The invention claimed is:

1. A moulded fibrous end plug for use in mounting a roll of sheet material to a dispenser, wherein the end plug has a roll facing side comprising formations configured to be insertable into an opening in an end of a roll of sheet material in use, the formations of the roll facing side including formations for securing the end plug to the roll of sheet material, wherein the formations of the roll facing side configured to be insertable into the opening in the end of the roll of sheet material include a plurality of domes, wherein the domes are spaced from one another by connecting portions, each connecting portion extending between the central portion of the roll facing side of the end plug and a base of the roll facing side of the end plug, wherein each connecting portion comprises one or more sloping portion, optionally wherein the connecting portion comprises an opening; and an opposite dispenser facing side comprising formations configured to cooperate with formations of a roll holder portion of a dispenser in use for mounting the end plug to the dispenser.

2. The moulded fibrous end plug of claim 1, wherein the fibers are cellulosic fibers.

3. The moulded fibrous end plug of claim 1, wherein the end plug comprises from 10-40% fibers based on total solids content and/or wherein the end plug comprise at least 50% binder based on total solids content.

4. The moulded fibrous end plug of claim 1, wherein the dispenser facing side of the end plug further comprises one or more sloping surfaces configured to cooperate with a ramp structure of the roll holder portion, wherein the sloping surfaces are provided by a reverse side of formations on the roll facing side of the end plug.

5. The moulded fibrous end plug of claim 1, wherein the dispenser facing side of the end plug comprises a plurality of sloping surfaces configured to cooperate with a surface of a ramp structure of the roll holder portion of the dispenser to enable the end plug to be mounted to the roll holder portion, wherein the sloping surfaces of the dispenser facing side are provided by the dispenser facing sides of sloping portions of the connecting portions.

6. The moulded fibrous end plug of claim 1, wherein each dome comprises a base portion and an upper portion, wherein an outer wall of the dome comprises a first portion in the base portion of the dome upstanding from a base of the roll facing side of the end plug and a second, sloping portion in the upper portion of the dome, the second, sloping portion being inclined relative to the first portion.

7. The moulded fibrous end plug of claim 1, wherein each dome is upstanding from a base of the roll facing side of the end plug, wherein the end plug comprises a flange around the periphery thereof, the base of the roll facing side of the end plug comprising a roll facing surface of the peripheral flange.

8. The moulded fibrous end plug of claim 1, wherein the domes surround a central portion of the roll facing side of the end plug.

9. The moulded fibrous end plug of claim 8, wherein the central portion defines a planar roll facing surface.

10. The moulded fibrous end plug of claim 8, wherein the central portion is located at a level between the base of the roll facing side of the end plug and the tops of the domes.

11. The moulded fibrous end plug of claim 8, wherein each dome extends between the central portion of the roll facing side and the roll facing surface of a peripheral flange of the end plug.

12. The moulded fibrous end plug of claim 8, wherein the dispenser facing side of the end plug comprises an annular structure defining a central bore for receiving a projection defined by a roll holder portion of the dispenser, wherein the central bore is a closed ended bore, wherein the closed end of the bore is provided by a roll facing surface of a portion of the end plug whose opposite surface provides the central portion of the roll facing side of the end plug.

13. The moulded fibrous end plug of claim 12, wherein the dispenser facing side of the end plug comprises a plurality of reinforcing ribs extending between the annular structure and a peripheral region of the end plug on the dispenser facing side, optionally wherein each rib extends across a recess in the dispenser facing side of the end plug corresponding to a dispenser facing side of a dome.

14. The moulded fibrous end plug of claim 1, wherein the formations of the roll facing side for securing the end plug to the roll of sheet material include formations configured to provide an interference fit securing the end plug to the roll, wherein the formations for providing the interference fit comprise protuberances, and wherein each protuberance projects outwardly from a respective one of the domes.

15. The moulded fibrous end plug of claim 14, wherein a protuberance is associated with each dome.

16. The moulded fibrous end plug of claim 14, wherein each dome comprises a base portion and an upper portion, wherein an outer wall of the dome comprises a first portion in the base portion of the dome upstanding from a base of the roll facing side of the end plug and a second, sloping portion in the upper portion of the dome, the second, sloping portion being inclined relative to the first portion, wherein the protuberance has a height at least as great as a height of the base portion of the dome.

17. The moulded fibrous end plug of claim 1, wherein the end plug is formed from a material comprising a mixture of fibres and binder, and wherein the binder provides a matrix holding the fibres of the moulded fibrous end plug in place.

18. The moulded fibrous end plug of claim 17, wherein the binder comprises one or more biodegradable biopolymer or starch.

* * * * *